US009140444B2

(12) United States Patent
Connor

(10) Patent No.: US 9,140,444 B2
(45) Date of Patent: Sep. 22, 2015

(54) WEARABLE DEVICE FOR DISRUPTING UNWELCOME PHOTOGRAPHY

(71) Applicant: Robert A. Connor, Forest Lake, MN (US)

(72) Inventor: Robert A. Connor, Forest Lake, MN (US)

(73) Assignee: Medibotics, LLC, Forest Lake, MN (US)

( * ) Notice: Subject to any disclaimer, the term of this patent is extended or adjusted under 35 U.S.C. 154(b) by 209 days.

(21) Appl. No.: 13/967,987

(22) Filed: Aug. 15, 2013

(65) Prior Publication Data

US 2015/0049487 A1 Feb. 19, 2015

(51) Int. Cl.

| | |
|---|---|
| ***F21S 8/00*** | (2006.01) |
| ***F21V 33/00*** | (2006.01) |
| ***F21V 14/00*** | (2006.01) |
| ***F21L 4/00*** | (2006.01) |
| *F21W 131/304* | (2006.01) |

(52) U.S. Cl.

CPC ..... *F21V 33/0076* (2013.01); *F21L 4/00* (2013.01); *F21V 14/006* (2013.01); *F21V 33/0008* (2013.01); *F21W 2131/304* (2013.01)

(58) Field of Classification Search

CPC ..... F21V 33/0076; F21V 33/0008; F21V 14/006; F21L 4/00; F21W 2131/304

USPC ..... 362/277, 613, 103, 269, 285, 341, 157, 362/458; 315/149, 159; 346/600

See application file for complete search history.

(56) References Cited

U.S. PATENT DOCUMENTS

| | | | | |
|---|---|---|---|---|
| 3,946,233 | A | 3/1976 | Erben et al. | |
| 4,164,008 | A | 8/1979 | Miller et al. | |
| 4,283,127 | A | 8/1981 | Rosenwinkel et al. | |
| 4,836,672 | A | 6/1989 | Naiman et al. | |
| 4,959,760 | A | 9/1990 | Wu | |
| 5,019,438 | A | 5/1991 | Rapisarda | |
| 5,218,385 | A | 6/1993 | Lii | |
| 5,722,762 | A | 3/1998 | Soll | |
| 5,946,071 | A | 8/1999 | Feldman | |
| 6,018,374 | A | 1/2000 | Wrobleski | |
| 6,088,468 | A | 7/2000 | Ito et al. | |
| 6,106,130 | A | 8/2000 | Harding | |
| 6,111,364 | A * | 8/2000 | Davis et al. | 315/241 P |
| 6,351,208 | B1 | 2/2002 | Kaszczak | |
| 6,393,254 | B1 | 5/2002 | Pousada et al. | |

(Continued)

FOREIGN PATENT DOCUMENTS

| | | |
|---|---|---|
| WO | WO 0074366 A2 * | 12/2000 |
| WO | WO 0074366 | 5/2001 |

(Continued)

*Primary Examiner* — Andrew Coughlin
*Assistant Examiner* — Glenn Zimmerman

(57) ABSTRACT

This invention is a wearable device and method for disrupting unwelcome photography by a proximal imaging device in order to protect a person's privacy. This invention can be embodied in a device worn by the person whose privacy is to be protected comprising: a wearable light source; an ambient light sensor; an inbound light guide that harvests light from an ambient light source; a data processing unit that selects the use of light from the wearable light source, from the ambient light source, or from both the wearable light source and the ambient light source to disrupt unwelcome photography; and an outbound light guide that directs light from the wearable light source, from the ambient light source, or from both the wearable light source and the ambient light source toward the proximal imaging device in order to disrupt unwelcome photography.

13 Claims, 25 Drawing Sheets

(56) References Cited

U.S. PATENT DOCUMENTS 6,461,015 B1 10/2002 Welch
6,559,883 B1 5/2003 Fancher et al.
6,603,134 B1 8/2003 Wild et al.
6,665,079 B1 12/2003 Tocci et al.
6,674,561 B2 1/2004 Ohnishi et al.
6,687,497 B1 2/2004 Parvulescu et al.
6,738,572 B2 5/2004 Hunter
6,742,901 B2 6/2004 Kimura et al.
6,769,138 B2 8/2004 Golle et al.
6,771,349 B2 8/2004 Sitrick et al.
6,773,119 B2 8/2004 Kimura et al.
6,793,353 B2 9/2004 Kimura et al.
6,827,454 B2 12/2004 Kimura et al.
6,848,803 B2 2/2005 Spongberg
6,861,640 B2 3/2005 Light et al.
6,868,229 B2 3/2005 Balogh
6,937,163 B2 8/2005 Caulfield et al.
6,950,532 B1 9/2005 Schumann et al.
6,964,493 B1 11/2005 Whitlock
6,966,668 B2 11/2005 Cugini et al.
6,977,366 B2 12/2005 Light et al.
7,020,383 B2 3/2006 Light et al.
7,052,154 B2 5/2006 Vanderschuit
7,065,349 B2 6/2006 Nath et al.
7,144,127 B2 12/2006 Golle et al.
7,147,339 B2 12/2006 Golle et al.
7,170,577 B2 1/2007 Sitrick et al.
7,221,759 B2 5/2007 Nelson
7,229,183 B2 6/2007 Golle et al.
7,229,184 B2 6/2007 Golle et al.
7,271,898 B2 9/2007 Weber
7,281,813 B2 10/2007 Golle et al.
7,282,695 B2 10/2007 Weber et al.
7,326,911 B2 2/2008 Light et al.
7,332,706 B2 2/2008 Light et al.
7,348,584 B2 3/2008 Satou
7,414,529 B2 8/2008 Boss et al.
7,564,485 B2 7/2009 Nath et al.
7,568,813 B2 8/2009 Barker
7,574,220 B2 8/2009 Purkayastha et al.
7,656,294 B2 2/2010 Boss et al.
7,755,025 B2 7/2010 Light et al.
7,768,444 B1 8/2010 Rourk
7,795,596 B2 9/2010 Chowdhury
7,810,944 B2 10/2010 Liao
7,841,021 B2 11/2010 Golle et al.
7,896,509 B2 3/2011 Gallagher
7,922,349 B2 4/2011 Hunnewell et al.
7,934,836 B2 5/2011 Ito
7,940,302 B2 5/2011 Mehrotra et al.
7,948,375 B2 5/2011 Goldberg et al.
8,016,425 B2 9/2011 Ito
8,018,496 B2 9/2011 Nath et al.
8,073,438 B2 12/2011 McNally
8,077,209 B2 12/2011 Kamatani et al.
8,094,378 B2 1/2012 Kildishev et al.
8,111,968 B2 2/2012 Chakmakjian et al.
8,121,531 B2 2/2012 Brown et al.
8,132,491 B2 3/2012 Real et al.
8,148,673 B2 4/2012 Light et al.
8,154,578 B2 4/2012 Kurtz et al.
8,157,396 B2 4/2012 Smith et al.
8,184,175 B2 5/2012 Mooradian et al.
8,190,142 B2 5/2012 McNally
8,194,127 B2 6/2012 Kang et al.
8,212,872 B2 7/2012 Sablak
8,228,591 B1 7/2012 Towers et al.
8,235,524 B2 8/2012 Waters
8,253,770 B2 8/2012 Kurtz et al.
8,305,252 B2 11/2012 Bradley
8,384,555 B2 2/2013 Rosen
8,388,164 B2 3/2013 Waters
8,439,503 B2 5/2013 Reichow et al.
8,444,266 B2 5/2013 Waters
8,497,912 B2 7/2013 Wun
2002/0039896 A1 4/2002 Brown
2002/0106202 A1 8/2002 Hunter
2002/0171813 A1 11/2002 Kimura et al.
2003/0174986 A1 9/2003 Forbes et al.
2003/0219231 A1 11/2003 Vernon
2004/0046871 A1 3/2004 Ichikawa et al.
2004/0061676 A1 4/2004 Sitrick et al.
2004/0062393 A1 4/2004 Sitrick et al.
2004/0091110 A1 5/2004 Barkans
2004/0094697 A1 5/2004 Light et al.
2004/0109562 A1 6/2004 Ohnishi
2004/0150794 A1 8/2004 Kurtz et al.
2004/0182996 A1 9/2004 Light et al.
2004/0202382 A1 10/2004 Pilu
2004/0227634 A1* 11/2004 Caulfield et al. ..... 340/600
2004/0247120 A1 12/2004 Yu et al.
2004/0252835 A1 12/2004 Odgers
2005/0007456 A1 1/2005 Lee et al.
2005/0008324 A1 1/2005 Balogh
2005/0029456 A1 2/2005 Eggers et al.
2005/0194522 A1 9/2005 Light
2005/0242273 A1 11/2005 Light et al.
2005/0270371 A1 12/2005 Sablak
2006/0012974 A1 1/2006 Su
2006/0033017 A1 2/2006 Light et al.
2006/0064384 A1 3/2006 Mehrotra et al.
2006/0104043 A1 5/2006 Golle et al.
2006/0104044 A1 5/2006 Golle et al.
2006/0104048 A1 5/2006 Golle et al.
2006/0104049 A1 5/2006 Golle et al.
2006/0104050 A1 5/2006 Golle et al.
2006/0104051 A1 5/2006 Golle et al.
2006/0104052 A1 5/2006 Golle et al.
2006/0159440 A1 7/2006 Purkayastha et al.
2006/0215026 A1* 9/2006 Kamata et al. ..... 348/143
2006/0228003 A1 10/2006 Silverstein
2006/0291194 A1 12/2006 Golle et al.
2007/0000011 A1 1/2007 Golle et al.
2007/0002557 A1 1/2007 Golle et al.
2007/0034776 A1 2/2007 Weber et al.
2007/0056075 A1 3/2007 Golle et al.
2007/0103552 A1 5/2007 Patel et al.
2007/0115356 A1 5/2007 Kang et al.
2007/0116328 A1 5/2007 Sablak et al.
2007/0218267 A1 9/2007 Votel
2008/0030588 A1 2/2008 Boss et al.
2008/0030856 A1 2/2008 King
2008/0031596 A1 2/2008 Balogh
2008/0081552 A1 4/2008 Light et al.
2008/0165442 A1 7/2008 Cai et al.
2008/0174742 A1 7/2008 Ito
2008/0180640 A1 7/2008 Ito
2008/0198159 A1 8/2008 Liu et al.
2008/0267614 A1 10/2008 Boss et al.
2008/0283735 A1* 11/2008 Verenkoff ..... 250/221
2008/0316736 A1 12/2008 Hunnewell et al.
2008/0320606 A1 12/2008 Bishop
2009/0012433 A1 1/2009 Fernstrom et al.
2009/0080181 A1* 3/2009 Gallagher ..... 362/103
2009/0268942 A1 10/2009 Price
2010/0110559 A1 5/2010 Cai et al.
2010/0149782 A1* 6/2010 Smith et al. ..... 362/3
2010/0156573 A1 6/2010 Smith et al.
2010/0188843 A1 7/2010 Golle et al.
2010/0208445 A1 8/2010 Asvadi et al.
2010/0253501 A1 10/2010 Gibson
2010/0303449 A1 12/2010 Light et al.
2010/0323608 A1 12/2010 Sanhedrai et al.
2011/0075399 A1 3/2011 Yuan
2011/0122646 A1 5/2011 Bickham et al.
2011/0157875 A1 6/2011 Hunnewell et al.
2011/0292507 A1 12/2011 Hsu
2011/0305035 A1 12/2011 Bickham et al.
2012/0056546 A1* 3/2012 Harvey ..... 315/159
2012/0078393 A1 3/2012 Kotb et al.
2012/0099298 A1 4/2012 Hsu
2012/0118380 A1 5/2012 Leaback
2012/0138821 A1 6/2012 Joseph et al.

(56) References Cited

U.S. PATENT DOCUMENTS

| | | | |
|---|---|---|---|
| 2012/0140451 | A1 | 6/2012 | Araujo et al. |
| 2012/0170295 | A1 | 7/2012 | Ellenburg et al. |
| 2013/0017348 | A1 | 1/2013 | Sanada |

FOREIGN PATENT DOCUMENTS

| | | | |
|---|---|---|---|
| WO | WO 2005125193 | | 12/2005 |
| WO | WO 2005125193 | A1 * | 12/2005 |

* cited by examiner

WEARABLE DEVICE FOR DISRUPTING UNWELCOME PHOTOGRAPHY

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to wearable technology, imaging devices, and privacy.

Potential Benefits and Risks from Ubiquitous Wearable Imaging Devices

We are in a time of rapid technological progress in the development of wearable technology. There are numerous potential benefits from new developments in wearable technology including: more convenient and novel methods of access to information; new modes of communication; improved fitness, ambulatory motion capture, and enhanced sports performance; better physiological monitoring, medical diagnostics, and health outcomes; improved caloric intake monitoring, nutrition, and weight management; enhanced security and safety; new forms of entertainment and social interaction; and innovations in augmented reality, robotics, and telepresence.

Part of this technological progress in wearable technology is the development of wearable imaging devices. Although there are many potential benefits from widespread use of wearable imaging devices, there are also potential risks including the potential erosion of people's privacy. Some people dismiss concerns about potential privacy erosion by wearable technology as over-reactive "wearanoia" [heightened anxiety about wearable technology]. They note that wearable imaging devices come from the continued evolution of pervasive imaging technologies that began with hand-held cameras and has progressed to imaging-capable cell phones. However, while mobile imaging devices such as cell phones and digital cameras are already very common, wearable imaging devices are qualitatively different in some respects.

A first difference is that the use of cell phones and digital cameras for photography is generally accompanied by prominent and easily-recognized visual patterns of body-device motion (such as raising a cell phone up near one's eyes) and/or distinctive sounds (such as a mechanical or virtual "shutter click" sound). However, the activation of wearable imaging devices by voice commands, gentle taps, or subtle eye movements can be much less noticeable. Early models of wearable imaging devices may include a small light or sound cue that indicates when active imaging is occurring, but will such cues be as noticeable as those that are now used for cameras? Will such cues be mandatory for all future wearable imaging devices?

A second difference is that the video imaging functions of cell phones and cameras are generally not left on for long periods of time. However, due to the information access functionality of next generation wearable imaging devices, such devices will likely be left on for long periods of time. It is true that surveillance cameras are already common in public buildings, on major roadways, and throughout urban areas. It is also true that many of these surveillance cameras are left on for long periods of time. However, as widespread as surveillance cameras are, they are not everywhere that people are. Surveillance cameras remain uncommon in private homes, many rural settings, and public rooms where privacy is expected. In contrast, wearable imaging devices can become as ubiquitous as people.

For these reasons, wearable imaging devices have already generated controversy. There are many potential benefits from widespread use of next generation wearable imaging devices, but such wearable imaging devices also have considerable potential to erode everyone's privacy. Some people are very enthusiastic about how they can personally benefit from a wearable imaging device. Some people are concerned about how their privacy can be eroded when other people start constantly wearing such imaging devices.

This debate concerning conflicting rights with respect to wearable imaging devices is starting to become active in the formal arena of public policy and law, as well as in the informal arena of public manners and cultural norms. Some businesses and governments have already adopted policies which restrict the use of wearable imaging devices in selected locations (such as casinos) or during selected activities (such as driving). However, the wheels of public policy and legislation generally move slowly relative to the engine of technological development. It can take years for political processes to sort out an acceptable response to the challenges raised by new technology, especially when there are strong views on both sides of an issue. Also sometimes policy or legislative solutions to technological challenges are blunt instruments that are not ideal for dealing with the nuances and complexities of various situations.

For these reasons, it would be useful if there were a technology solution to the potential erosion of privacy by ubiquitous wearable imaging devices, instead of relying exclusively on a policy and legislative solution. It would be useful if there were a privacy-enhancing technology that would give people who do not want their privacy eroded another option in how to respond to the rise of ubiquitous wearable imaging devices. Specifically, it would be useful if there were a wearable device for disrupting unwelcome photography. That is the motivation for this invention.

The invention that is disclosed herein is a wearable device and method for disrupting unwelcome photography. This invention provides people with a new technology option that can actually enhance their privacy. This invention can provide people with a technology option that levels the playing field with respect to new wearable imaging technologies that may otherwise erode people's privacy. Giving people the options of both such technologies can help us as a society to gain the benefits from new types of wearable technology without losing the benefits of personal privacy.

There are some devices for disrupting photography in the prior art. Some of these devices prevent unauthorized recording of movies by including confounding images in movie projections that are only visible to recording devices. Some of these devices are limited to scanning and disrupting device operation in a fixed location, such as in a movie theater or corporate R&D building. Some of these devices only work in low ambient light conditions (not bright sunlight) or only for still photography. Some of these devices use high-power radiant energy emissions for military applications that would not be safe for use in public areas. Some of these devices use electromagnetic jamming signals that would not be allowed in many jurisdictions. Most of these devices have such significant power requirements that they would not work for long-term use as a wearable device. The ideal technological solution should be wearable, energy-efficient, safe, legal, effective in bright ambient light, affordable, and not-too-horrific in appearance.

None of the devices in the prior art are well-suited for addressing the pending proliferation of ubiquitous wearable imaging devices. There remains a need for a good wearable device for disrupting unwelcome photography. To be sure, the development of such a device is a challenging technological problem. The interaction between a wearable imaging device and a person within its field of view is complex. However, the wearable device for disrupting unwelcome photography that is disclosed herein has the potential to be wearable, energy-efficient, safe, legal, effective in bright ambient light, affordable, and not-too-horrific in appearance. Hopefully it will help us as a society to gain the benefits from new types of wearable technology without losing the benefits of personal privacy.

2. Categorization and Review of the Prior Art

Before disclosing this invention, it is useful to thoroughly review the related prior art. This is done in the following categorization and review of the relevant prior art. Categorizing relevant examples of prior art into discrete categories is challenging. Some examples in the prior art span multiple categories. Also, no categorization scheme is perfect. However, even an imperfect categorization scheme can serve a useful purpose for reviewing a voluminous body of prior art. Towards this end, 170 examples of relevant prior art have been grouped into four general groups and then classified into more-specific categories within those four general groups.

The four general groups are: (A) devices and methods which can detect and modify/disrupt the operation of an imaging device, but which require the cooperation of the manufacturer and/or user of the imaging device; (B) devices and methods which can detect an imaging device, but which do not offer an integrated method for modifying/disrupting the operation of the imaging device; (C) devices and methods which can generally modify/disrupt the operation of imaging devices, but which do not offer an integrated method for detecting a specific imaging device; and (D) devices and methods which can detect and modify/disrupt the operation of an imaging device.

Within these four general groups, more-specific categories were identified and the relevant prior art was classified into these categories. This resulted in the following 20 categories within the four general groups: (A1) imaging device with cooperative privacy-preserving hardware or software; (B1) imaging device detection via (radio frequency) electromagnetic emission without integrated device disruption; (B2) imaging device detection via non-visible spectrum light emission without integrated device disruption; (B3) imaging device detection via general-spectrum light emission without integrated device disruption; (B4) imaging device detection via visual pattern recognition without integrated device disruption; (B5) imaging device detection via ambient light reflection without integrated device disruption; (B6) imaging device detection via various or miscellaneous methods without integrated device disruption; (C1) imaging device disruption via confounding display without integrated device detection; (C2) clothing or other wearable technology that emits light without integrated device detection; (C3) clothing or other wearable technology that reflects light without integrated device detection; (C4) nanoscale/microscale metamaterials and/or light guides without integrated device detection; (C5) imaging device disruption via (radio frequency) electromagnetic emission without integrated device detection; (C6) imaging device disruption via light emission without integrated device detection; (C7) imaging device disruption via various or miscellaneous methods without integrated device detection; (D1) imaging device detection and disruption by (radio frequency) electromagnetic emission; (D2) imaging device detection by (radio frequency) electromagnetic emission and disruption by light emission; (D3) imaging device detection by proximity detection and disruption by light emission; (D4) imaging device detection and disruption by light emission; (D5) imaging device detection by various methods and disruption by light emission; and (D6) imaging device detection and disruption by various or miscellaneous methods.

In this categorization and review of the prior art, approximately 170 examples of prior art have been identified and categorized. Writing up individual reviews for each of these 170 examples would have been prohibitively lengthy and less useful for the reader, who would have had to wade through these 170 individual reviews. It is more efficient for the reader to be presented with these 170 examples of prior art having been grouped into categories, wherein each of these general categories is then reviewed and discussed. For readers who wish to dig further into examples within a particular category or to modify the categorization scheme, some details on each example of the prior art are provided including the patent (application) title and date in addition to the inventors and patent (application) number. Overall, this categorization and discussion should provide a thorough and helpful review of the spectrum and limitations of the relevant prior art.

A1. Imaging Device with Cooperative Privacy-Preserving Hardware or Software

Devices and methods in this category appear to be able to detect and modify/disrupt the operation of an imaging device. However, they require the cooperation of the manufacturer and/or user of the imaging device in order to work. In an example, such art requires that an imaging device includes special hardware or software that enables modification or disruption of the operation of the device in certain locations or during certain circumstances. If all manufacturers of imaging devices agree to include such privacy-preserving hardware or software in their imaging devices, then this can be a great voluntary solution. However, if even some manufacturers do not include such privacy-preserving elements in their imaging devices or if some users find ways to circumvent the operation of such elements, then this optimistic solution will not come to pass. Of course, if all imaging device users exercise good judgment and courtesy in their use of imaging devices, then this can also be a great solution. However, the intrusive behavior of some paparazzi suggests otherwise. Also, even people of good faith have differing views on which settings and interpersonal interactions should remain private. Accordingly, pinning all of one's hopes on such a cooperative solution may be too optimistic.

Prior art that appears to be best classified into this category includes U.S. Pat. No. 6,738,572 (Hunter, May 18, 2004, "Function Disabling System for a Camera Used in a Restricted Area"); U.S. Pat. No. 7,065,349 (Nath et al., Jun. 20, 2006, "Method for Automobile Safe Wireless Communications"); U.S. Pat. No. 7,414,529 (Boss et al., Aug. 19, 2008, "Disablement of Camera Functionality for a Portable Device"); U.S. Pat. No. 7,574,220 (Purkayastha et al., Aug. 11, 2009, "Method and Apparatus for Alerting a Target that it is Subject to Sensing and Restricting Access to Sensed Content Associated with the Target"); U.S. Pat. No. 7,656,294 (Boss et al., Feb. 2, 2010, "Disablement of Camera Functionality for a Portable Device"); U.S. Pat. No. 7,940,302 (Mehrotra et al., May 10, 2011, "Apparatus and Method for Privacy Protection of Data Collection in Pervasive Environments"); U.S. Pat. No. 8,154,578 (Kurtz et al., Apr. 10, 2012, "Multi-Camera Residential Communication System"); U.S. Pat. No. 8,194,127 (Kang et al., Jun. 5, 2012, "Method and Apparatus for Masking Surveillance Video Images for Privacy Protection"); U.S. Pat. No. 8,212,872 (Sablak, Jul. 3, 2012, "Transformable Privacy Mask for Video Camera Images"); U.S. Pat. No. 8,253,770 (Kurtz et al., Aug. 28, 2012, "Residential Video Communication System"); and U.S. Pat. No. 8,497,912 (Wun, Jul. 30, 2013, "System for Controlling Photographs Taken in a Proprietary Area").

Prior art that appears to be best classified into this category also includes U.S. Patent Applications: 20020106202 (Hunter, Aug. 8, 2002, "Portable Cameras"); 20040046871 (Ichikawa et al., Mar. 11, 2004, "Photographing Apparatus, Photographing Restrain System, and Photographing Restrain Release System"); 20040202382 (Pilu, Oct. 14, 2004, "Image Capture Method, Device and System"); 20050270371 (Sablak, Dec. 8, 2005, "Transformable Privacy Mask for Video Camera Images"); 20060064384 (Mehrotra et al., Mar. 23, 2006, "Apparatus and Method for Privacy Protection of Data Collection in Pervasive Environments"); 20070115356 (Kang et al., May 24, 2007, "Method and Apparatus for Masking Surveillance Video Images for Privacy Protection"); 20070116328 (Sablak et al., May 24, 2007, "Nudity Mask for Use in Displaying Video Camera Images"); 20080030588 (Boss et al., Feb. 7, 2008, "Disablement of Camera Functionality for a Portable Device"); 20080198159 (Liu et al., Aug. 21, 2008, "Method and Apparatus for Efficient and Flexible Surveillance Visualization with Context Sensitive Privacy Preserving and Power Lens Data Mining"); 20080267614 (Boss et al., Oct. 30, 2008, "Disablement of Camera Functionality for a Portable Device"); 20090012433 (Fernstrom et al., Jan. 8, 2009, "Method, Apparatus and System for Food Intake and Physical Activity Assessment").

B1. Imaging Device Detection Via (Radio Frequency) Electromagnetic Emission without Integrated Device Disruption This is the first category in the second group. Devices and methods in this group can detect an imaging device, but do not offer an integrated method of modifying or disrupting the imaging device. This first category in this group includes art that can detect an imaging device via electromagnetic emission (generally radio frequency emission) but which does not seem to offer an integrated method for modifying or disrupting the operation of an imaging device that is detected. For example, the distinction electromagnetic signature of a particular type of camera and/or phone with imaging functionality can be recognized. However, art in this category does not appear to include an integrated method for modifying or disrupting the operation of the camera or phone that is detected. The results of such detection can prompt an ad hoc response by humans, but this response is not an integral part of the device or method.

Such devices and methods for detecting cameras or phones can be very useful in movie theaters or in corporate R&D laboratories wherein there are readily-available humans to respond and wherein detection of the imaging device is the key problem. However, such devices and methods are less useful for responding to ubiquitous imaging devices in general environments. In the latter situation, a person whose privacy is to be protected may be well aware of a potentially privacy-eroding imaging device and have no need of being informed of its presence. The key issue for that person is what to do about the imaging device. Accordingly, devices and methods in this category are not ideal for a wearable device for disrupting unwelcome photography.

Prior art that appears to be best classified into this category includes: U.S. Pat. No. 7,795,596 (Chowdhury, Sep. 14, 2010, "Cloaking Device Detection System"); and U.S. Pat. No. 8,384,555 (Rosen, Feb. 26, 2013, "Method and System for Automated Detection of Mobile Phone Usage"); and U.S. Patent Application 20050029456 (Eggers et al., Feb. 10, 2005, "Sensor Array with a Number of Types of Optical Sensors").

B2. Imaging Device Detection Via Non-Visible Spectrum Light Emission without Integrated Device Disruption Devices and methods in this category appear to be able to detect an imaging device via non-visible spectrum light emission, but they do not seem to offer an integrated method for modifying/disrupting the operation of the imaging device. Generally, such devices and methods use infrared light to detect an imaging device. In an example, devices and methods in this category can detect and recognize infrared light emitted from an imaging device that is part of an auto-focusing or motion capture function. In an example, such devices and methods in this category can project infrared light and detect retroreflected light from an interior or exterior surface of the imaging device.

Many of the examples of art in this category were designed to detect and flag unauthorized video recording of movies or performances in theaters. As was the case in the previous category in this group, such devices and methods do not appear to include an integrated method for modifying or disrupting the imaging device. Also, such devices and methods may be less effective in bright sunlight (which includes infrared light) than in dim theaters. Accordingly, devices and methods in this category do not provide a complete solution to the issue of potential privacy erosion by ubiquitous wearable imaging devices.

Prior art that appears to be best classified into this category includes: U.S. Pat. No. 6,771,349 (Sitrick et al., Aug. 3, 2004, "Anti-Piracy Protection System and Methodology"); and U.S. Pat. No. 7,170,577 (Sitrick et al., Jan. 30, 2007, "Targeted Anti-Piracy System and Methodology"); and U.S. Patent Applications 20040061676 (Sitrick et al., Apr. 1, 2004, "Anti-Piracy Protection System and Methodology"); 20040062393 (Sitrick et al., Apr. 1, 2004, "Targeted Anti-Piracy System and Methodology"); and 20090268942 (Price, Oct. 29, 2009, "Methods and Apparatus for Detection of Motion Picture Piracy for Piracy Prevention").

B3. Imaging Device Detection Via General-Spectrum Light Emission without Integrated Device Disruption Similar to the previous category, devices and methods in this category detect an imaging device via light emission or reflection and do not seem to offer an integrated method for modifying or disrupting the imaging device. However, we have separated this category from the previous one because the previous one focuses on non-visible light and this one encompasses visible light. Some examples in this category use lasers. Much of the art in the previous category was designed for use in applications such as movies theaters in which visible light beams would be distracting to the customers, but much of the art in this present category is designed for use in military applications in which the use of visible laser beams can be acceptable. Some of the devices in this category use lasers to identify the location of optical elements in military applications. Although examples in this category do not include an integrated method of responding to detection of such optical elements, it is generally implied that some type of weapon (such as an exploding projectile or an energy beam) can be directed toward a hostile optical element in military applications. The use of a high-power laser to detect an imaging device and a weapon to disrupt such a device can be effective and appropriate in hostile military applications, but such technologies are neither safe nor appropriate for a civilian wearable device for disrupting unwelcome photography.

Prior art that appears to be best classified into this category includes: U.S. Pat. No. 6,665,079 (Tocci et al., Dec. 16, 2003, "Method and Apparatus for Locating Electromagnetic Imaging and Detection Systems/Devices"); U.S. Pat. No. 7,282,695 (Weber et al., Oct. 16, 2007, "Active Search Sensor and a Method of Detection Using Non-Specular Reflections"); U.S. Pat. No. 8,184,175 (Mooradian et al., May 22, 2012, "System and Method for Detecting a Camera"); and U.S. Pat. No. 8,228,591 (Towers et al., Jul. 24, 2012, "Handheld Optics Detection System"); and U.S. Patent Applications 20060228003 (Silverstein, Oct. 12, 2006, "Method and Apparatus for Detection of Optical Elements"); and 20070034776 (Weber et al., Feb. 15, 2007, "Active Search Sensor and a Method of Detection Using Non-Specular Reflections").

B4. Imaging Device Detection Via Visual Pattern Recognition without Integrated Device Disruption Devices and methods in this category use image analysis and/or pattern recognition to detect an imaging device. Like other categories in this general group, such devices and methods do not provide an integrated method for modifying/disrupting the operation of an imaging device that is detected. In an example, such devices and methods can take pictures of a given scene at different times to detect and recognize the addition and/or movement of a mobile imaging device in such a scene. This method can be very useful for deployment at fixed location, such as a fixed-location surveillance camera. This method can be challenging for use in a wearable device when the person who wears the device is moving. Also, as was the case with other categories in this group, devices and methods in this category do not offer an integrated method for modifying or disrupting an imaging device that is detected. Accordingly, such art does not provide a complete solution for addressing potential privacy erosion from ubiquitous wearable imaging devices. Prior art that appears to be best classified into this category includes U.S. Pat. No. 6,088,468 (Ito et al., Jul. 11, 2000, "Method and Apparatus for Sensing Object Located within Visual Field of Imaging Device").

B5. Imaging Device Detection Via Ambient Light Reflection without Integrated Device Disruption Devices and methods in this category appear to be able to detect an imaging device using ambient light reflection. They do not offer an integrated method of responding to an imaging device which is detected. Devices and methods in this category appear to be uncommon Only one example was found in the prior art. In this example, reflected solar light is used to detect a target in a military application. As with other military applications, some type of weapon (such as an exploding projectile or an energy beam) can be directed toward a target which is detected. Although use of ambient light in any form is innovative, relying on ambient light alone is limiting. Even a passing cloud could limit use of such technology. For this reason, and because such technology does not offer an integrated method of disrupting an imaging device, this technology does not appear to provide a complete solution for a wearable device for disrupting unwelcome photography. Prior art that appears to be best classified into this category includes U.S. Pat. No. 4,836,672 (Naiman et al., Jun. 6, 1989, "Covert Optical System for Probing and Inhibiting Remote Targets").

B6. Imaging Device Detection Via Various or Miscellaneous Methods without Integrated Device Disruption This miscellaneous category was created for prior art which can detect an imaging device, which does not offer an integrated method of disrupting such a device, and which does not fall neatly into one of the above categories. Some of the art in this category uses unusual methods to detect an imaging device, such as releasing a chemical. It is unclear how appropriate it would be for a person to wear a technology that releases chemicals into the air. Some of the art in this category mentions a wide range of possible detection methods without focusing primarily on any one of them. For these reasons, and because art in this category does not offer an integrated method of disrupting an imaging device, art in this category does not appear to provide a complete solution for a wearable device for disrupting unwelcome photography. Prior art that appears to be best classified into this category includes U.S. Pat. No. 7,948,375 (Goldberg et al., May 24, 2011, "Method and Apparatus for Detecting Portable Electronic Device Functionality").

C1. Imaging Device Disruption Via Confounding Display without Integrated Device Detection This is the first category in the third general group. Devices and methods in the preceding (second) group were incomplete as a technological solution because they could detect imaging devices, but did not offer a way to modify or disrupt them. Devices and methods in this present (third) group are incomplete as a technological solution because they can generally modify or disrupt an imaging device, but cannot detect one.

Devices and methods in this first category in the third group modify/disrupt the ability of imaging devices to take pictures of movies or other specific content by embedding confounding material in that content and/or by specialized projection methods. In an example, confounding material can include infrared material that is invisible to the human eye but not to imaging devices. In an example, specialized projection methods can include varying the frame rate or luminosity of a movie or other projected content. Use of devices and methods in this first category is limited to disruption of photography of specific content. Devices and methods in this category can be useful for thwarting unauthorized recording of movies or other projected content, but are not well-suited for general use in a wearable device for disrupting unwelcome photography of a person.

Prior art that appears to be best classified into this category includes: U.S. Pat. No. 6,674,561 (Ohnishi, et al., Jan. 6, 2004, "Optical State Modulation Method and System and Optical State Modulation Apparatus"); U.S. Pat. No. 6,950,532 (Schumann et al., Sep. 27, 2005, "Visual Copyright Protection"); and U.S. Pat. No. 7,221,759 (Nelson, May 22, 2007, "Projector with Enhanced Security Camcorder Defeat"); and U.S. Patent Applications 20040109562 (Ohnishi, Jun. 10, 2004, "Imaging Disturbing Method and System"); 20040150794 (Kurtz et al., Aug. 5, 2004, "Projector with Camcorder Defeat"); and 20040247120 (Yu et al., Dec. 9, 2004, "Methods and Apparatus for Digital Content Protection"); and WO 2000074366 (Mead, May 3, 2001, "Systems And Methods for Preventing Camcorder Piracy of Motion Picture Images").

C2. Clothing or Other Wearable Technology that Emits Light without Integrated Device Detection This category includes clothing or other wearable technology that emits light and has the potential to modify or disrupt the operation of imaging devices, but does not include a mechanism for detecting an imaging device. In the extreme, if one were to wear a 1,000-watt light bulb on one's head which shines continuously, this might be sufficient to disrupt being photographed (except perhaps in direct sunlight). However, this extreme example highlights the technical problems and high-energy requirements of art in this group which seeks to block photography without the ability to detect imaging devices. It is very energy-inefficient to emit high-energy light energy in all directions and at all times on the chance that there might be an imaging device somewhere nearby. In addition to its high energy requirements, such an approach can generate heat, be unsafe, and fail the "don't look too horrific" test. Devices and methods that can detect a nearby imaging device and only direct light energy in a particular direction at a particular time can be much more energy efficient, safe, and unobtrusive.

Most of the prior art in this example was not designed with photography-disruption in mind. Most of the prior art in this category involves incorporating lights (such as LEDS) into clothing or wearable accessories for safety, artistic, fashion, and/or basic illumination purposes. Incorporating a couple LEDs into clothing or wearable accessories can be useful for these purposes, but art in this category does not yet provide a good solution for a wearable device for disrupting unwelcome photography.

Prior art that appears to be best classified into this category includes U.S. Pat. No. 4,164,008 (Miller et al., Aug. 7, 1979, "Illuminated Article of Clothing"); U.S. Pat. No. 4,283,127 (Rosenwinkel et al., Aug. 11, 1981, "Novelty Eyeglasses"); U.S. Pat. No. 4,959,760 (Wu, Sep. 5, 1990, "Lighting Equipment for an Eyeglasses"); U.S. Pat. No. 5,019,438 (Rapisarda, May 28, 1991, "Leather Article Decorated with Light Emitting Diodes"); U.S. Pat. No. 5,218,385 (Lii, Jun. 8, 1993, "Flash Light Eyeglasses with Hinge Switch"); U.S. Pat. No. 5,722,762 (Soll, Mar. 3, 1998, "Illumination Device for Mounting on the Head of a User"); U.S. Pat. No. 5,946,071 (Feldman, Aug. 31, 1999, "Eyeglasses with Illuminated Frame"); U.S. Pat. No. 6,106,130 (Harding, Aug. 22, 2000, "Personal Lighted and Reflective Safety System with Shoulder Straps for Pedestrians"); U.S. Pat. No. 6,461,015 (Welch, Oct. 8, 2002, "Portable Wearable Strobe Light"); U.S. Pat. No. 6,769,138 (Golle et al., Aug. 3, 2004, "Safety Vest and Other Clothing Articles"); U.S. Pat. No. 6,848,803 (Spongberg, Feb. 1, 2005, "Illuminated Halloween Costume"); U.S. Pat. No. 6,964,493 (Whitlock, Nov. 15, 2005, "Method and Apparatus for Adding Light Transmission to an Article of Clothing"); U.S. Pat. No. 6,966,668 (Cugini et al., Nov. 22, 2005, "Wearable Light Device with Optical Sensor"); U.S. Pat. No. 7,052,154 (Vanderschuit, May 30, 2006, "Lighted Hat"); U.S. Pat. No. 7,144,127 (Golle et al., Dec. 5, 2006, "Single Assembly EL Lighting for Garments"); U.S. Pat. No. 7,147,339 (Golle et al., Dec. 12, 2006, "EL Lighted Garment with Reduced Glow Up"); U.S. Pat. No. 7,229,183 (Golle et al., Jun. 12, 2007, "EL Lighting for Safety Orange Garments"); U.S. Pat. No. 7,229,184 (Golle et al., Jun. 12, 2007, "EL Lighted Articles"); U.S. Pat. No. 7,281,813 (Golle et al., Oct. 16, 2007, "EL Lighted Articles"); U.S. Pat. No. 7,568,813 (Barker, Aug. 4, 2009, "Chest Height Light Emission System"); U.S. Pat. No. 7,810,944 (Liao, Oct. 12, 2010, "Illuminated Cap Having Optical Fiber Strand and Removable Pouch"); U.S. Pat. No. 7,841,021 (Golle et al., Nov. 30, 2010, "EL Lighted Articles"); U.S. Pat. No. 7,922,349 (Hunnewell et al., Apr. 12, 2011, "Portable Light"); U.S. Pat. No. 8,235,524 (Waters, Aug. 7, 2012, "Illuminated Eyewear"); U.S. Pat. No. 8,388,164 (Waters, Mar. 5, 2013, "Hands-Free Lighting Devices"); and U.S. Pat. No. 8,444,266 (Waters, May 21, 2013, "Illuminated Eyewear").

Prior art that appears to be best classified into this category includes U.S. Patent Applications: 20060012974 (Su, Jan. 19, 2006, "Multifunctional Glasses"); 20060104043 (Golle et al., May 18, 2006, "EL Lighting for Garments with Four Wire Circuit"); 20060104044 (Golle et al., May 18, 2006, "EL Lighting for Safety Orange Garments"); 20060104048 (Golle et al., May 18, 2006, "EL Lighted Garment"); 20060104049 (Golle et al., May 18, 2006, "Single Assembly EL Lighting for Garments"); 20060104050 (Golle et al., May 18, 2006, "EL Lighted Garment with Reduced Glow Up"); 20060104051 (Golle et al., May 18, 2006, "Single Continuous Assembly EL Lighting for Garments"); 20060104052 (Golle et al., May 18, 2006, "EL Garment Lighting Using Flexible Circuit Elements"); 20060291194 (Golle et al., Dec. 28, 2006, "EL Lighted Articles"); 20070000011 (Golle et al., Jan. 4, 2007, "EL Lighted Articles"); 20070002557 (Golle et al., Jan. 4, 2007, "EL Lighted Articles"); 20070056075 (Golle et al., Mar. 15, 2007, "EL Lighted Articles"); 20080316736 (Hunnewell et al., Dec. 25, 2008, "Portable Light"); 20100188843 (Golle et al., Jul. 29, 2010, "EL Power Unit"); 20100208445 (Asvadi et al., Aug. 19, 2010, "Multi-Layer Woven Fabric Display"); 20100253501 (Gibson, Oct. 7, 2010, "Synchronized Luminated Safety Apparel"); 20110075399 (Yuan, Mar. 31, 2011, "Foldable Water-Proof Light Emitting Clothing"); 20110122646 (Bickham et al., May 26, 2011, "Optical Fiber Illumination Systems and Methods"); 20110157875 (Hunnewell et al., Jun. 30, 2011, "Portable Light"); 20110305035 (Bickham et al., Dec. 15, 2011, "Optical Fiber Illumination Systems and Methods"); 20120078393 (Kotb et al., Mar. 29, 2012, "Self-Contained, Wearable Light Controller with Wireless Communication Interface"); 20120099298 (Hsu, Apr. 26, 2012, "Light-Emitting Clothing Structure"); 20120140451 (Araujo et al., Jun. 7, 2012, "Wearable Lighting Device"); and 20120170295 (Ellenburg et al., Jul. 5, 2012, "Personal Lighting Device").

C3. Clothing or Other Wearable Technology that Reflects Light without Integrated Device Detection This category is similar to the preceding category, except that it includes clothing or other wearable technology that reflects light instead of emitting light. Like art in the prior category, art in this category does not include a way to detect a nearby imaging device. Also like art in the prior category, art in this category was generally not designed to disrupt photography. It was generally designed for safety or artistic purposes. Such technology can be very useful, for instance, in detecting people wearing such clothing in dark conditions. However, it is not consistently effective for disrupting unwelcome photography.

Under certain conditions, such as bright direct sunlight, clothing or accessories that reflect light in multiple angles can disrupt photography by nearby imaging devices without requiring detection of a specific imaging device. In an extreme example, if one were to fasten a rotating mirror-ball to one's head and to stand outside in direct sunlight, then such a contraption would probably disrupt people taking pictures of you from multiple angles. (They probably would be running away from you in any event.) However, such a device would stop working effectively when a cloud passes. Also, such a reflective device would probably not work well under dim lighting conditions. For these reasons, devices and methods in this category are not a good solution for a wearable device to disrupt unwelcome photography.

Prior art that appears to be best classified into this category includes U.S. Patent Applications: 20070218267 (Votel, Sep. 20, 2007, "Reflective Composition and Garment"); 20080030856 (King, Feb. 7, 2008, "Breathable Retroreflective Material for High Visibility Safety Apparel and Reflective Apparel"); 20110292507 (Hsu, Dec. 1, 2011, "Structure, Manufacturing Method, and Applications of Reflective Material"); and 20120118380 (Leaback, May 17, 2012, "Solar Reflective Fibre").

C4. Nanoscale/Microscale Metamaterials and/or Light Guides without Integrated Device Detection This category focuses mainly on novel materials, including metamaterials, with special reflective and/or refractive properties. They can transmit light in novel ways. Early experiments with small-scale devices made from such materials suggest that these materials may someday enable cloaking devices which render an object invisible. For example, an object covered with metamaterial light guides may transmit the view from one side of an object and project this view out from the other side of the object. However, these experiments are at a very early stage with very small devices. There will be no cloaking of wizards or space ships any time soon. Further, it is highly unlikely that someone within such a cloaking device could see out of it. For these reasons, although devices and methods in this category are very interesting and have tremendous long-term potential, prior art in this category is not well-suited for use as a wearable device for disrupting unwelcome photography.

Prior art that appears to be best classified into this category includes: U.S. Pat. No. 8,094,378 (Kildishev et al., Jan. 10, 2012, "Planar Lens"); and U.S. Pat. No. 8,111,968 (Chakmakjian et al., Feb. 7, 2012, "Optical Devices for Guiding Illumination"); and U.S. Patent Applications 20030174986 (Forbes et al., Sep. 18, 2003, "Hollow Core Photonic Bandgap Optical Fiber"); 20080165442 (Cai et al., Jul. 10, 2008, "System, Method and Apparatus for Cloaking"); 20100110559 (Cai et al., May 6, 2010, "System, Method and Apparatus for Cloaking"); 20100156573 (Smith et al., Jun. 24, 2010, "Metamaterials for Surfaces and Waveguides"); and 20130017348 (Sanada, Jan. 17, 2013, "Invisible Enclosure").

C5. Imaging Device Disruption Via (Radio Frequency) Electromagnetic Emission without Integrated Device Detection This category includes devices and methods which modify and/or disrupt the operation of an imaging device by emitting (radio frequency) electromagnetic energy. This category includes electromagnetic "jamming" devices which disrupt the operation of mobile electronic devices within a given area. If such devices are used in a legally-restricted area in which mobile electronic devices are not supposed to be in use, then this can be a satisfactory solution to the problem of unwelcome photography.

However, there are laws against radio frequency jamming in public (non restricted) areas in many jurisdictions. Also, there are safety issues with respect to possible disruption of medical devices, vehicles, or other electronic systems which may be disrupted by jamming radio frequency emissions. For these reasons, devices and methods which disrupt imaging devices by emitting (radio frequency) electromagnetic emissions are not a robust solution to the problem of unwelcome photography.

Prior art that appears to be best classified into this category includes: U.S. Pat. No. 6,393,254 (Pousada et al., May 21, 2002, "Disabler for Mobile Communications"); U.S. Pat. No. 6,687,497 (Parvulescu et al., Feb. 3, 2004, "Method System and Structure for Disabling a Communication Device During the Occurrence of One or More Predetermined Conditions"); U.S. Pat. No. 8,073,438 (McNally, Dec. 6, 2011, "Method and System for Disabling a Wireless Communication Device"); U.S. Pat. No. 8,121,531 (Brown et al., Feb. 21, 2012, "Apparatus and Method for Selective Interfering with Wireless Communications Devices"); and U.S. Pat. No. 8,190,142 (McNally, May 29, 2012, "Method and System for Disabling a Wireless Communication Device"); and U.S. Patent Applications 20020039896 (Brown, Apr. 4, 2002, "Method and Apparatus for Disabling Mobile Telephones"); 20030219231 (Vernon, Nov. 27, 2003, "Method and System for the Prevention of Copyright Piracy"); and 20050007456 (Lee et al., Jan. 13, 2005, "System and Method for Restricting Use of Camera of a Mobile Terminal").

C6. Imaging Device Disruption Via Light Emission without Integrated Device Detection Devices and methods in this category can generally modify/disrupt the operation of imaging devices via light emission, but do not provide an integrated method for detecting an imaging device. Many examples of devices and methods in this category include content projection methods which project invisible (e.g. infrared) light in addition to visible light. The invisible (e.g. infrared) light is intended to disrupt the operation of any imaging devices which may be recording the content, without having to detect any specific imaging device.

However, such devices and methods only work if the imaging devices are vulnerable to disruption by the invisible (e.g. infrared) light and if the invisible (e.g. infrared) light is sufficiently powerful to disrupt the imaging devices. Not all imaging devices are vulnerable to disruption by infrared light. Also, there are limits to how much energy is available to power (continuous) infrared lights on a wearable device. Also, there can be safety issues. Finally, such methods work better in dim theaters than in bright sunlight. Accordingly, such methods are not ideal for use in a wearable device to disrupt unwelcome photography.

Other examples of devices and methods in this category are similar to light-emitting clothing, except that a light-emitting device is hand-held or mobile. Limitations for such devices are similar to those for light-emitting clothing. Without an automated or integrated method for detecting when and where there is an imaging device nearby, devices and methods in this category are generally energy inefficient. Unless aimed toward a specific imaging device by human action (such as having a human manually point a photography-disrupting device toward a camera), devices and methods in this category must direct light energy in multiple directions for extended periods of time to disrupt photography. This is very energy inefficient and potentially obtrusive as well.

It is possible to have a relatively energy-efficient device, such as a flashlight or laser pointer, which must be manually aimed toward a specific imaging device by human action. For example, someone can basically see a camera and just point a flashlight or laser pointer at the camera. One could possibly call a hand-held flashlight or laser pointer a "photography disrupting" device in this context, but the photography disruption process is so manual and so dependent on human action in this case that this label seems a stretch. In an absurd extreme, one could perhaps even call a hammer a "photography disrupting" device when a person sees a camera and uses the hammer to break it. However, this is clearly a stretch in use of the label. Ideally, a device should have at least some degree of automation (for either detecting an imaging device and/or for disrupting an imaging device) in order to really call it a "photography disrupting" device.

For these reasons, devices and methods in this category are not well-suited for use in a wearable device to disrupt unwelcome photography. Prior art that appears to be best classified into this category includes U.S. Pat. No. 6,018,374 (Wrobleski, Jan. 25, 2000, "Method and System for Preventing the Off Screen Copying of a Video or Film Presentation"); U.S. Pat. No. 6,351,208 (Kaszczak, Feb. 26, 2002, "Device for Preventing Detection of a Traffic Violation"); U.S. Pat. No. 6,559,883 (Fancher et al., May 6, 2003, "Movie Film Security System Utilizing Infrared Patterns"); U.S. Pat. No. 6,742,901 (Kimura et al., Jun. 1, 2004, "Imaging Prevention Method and System"); U.S. Pat. No. 6,773,119 (Kimura et al., Aug. 10, 2004, "Imaging Prevention Method and System"); U.S. Pat. No. 6,793,353 (Kimura et al., Sep. 21, 2004, "Imaging Prevention Method and System"); U.S. Pat. No. 6,827,454 (Kimura et al., Dec. 7, 2004, "Imaging Prevention Method and System"); U.S. Pat. No. 7,348,584 (Satou, Mar. 25, 2008, "Infrared Projector"); U.S. Pat. No. 7,934,836 (Ito, May 3, 2011, "Projector That Is Capable of Superimposing and Displaying a Visible Image and an Invisible Infrared Image"); U.S. Pat. No. 8,016,425 (Ito, Sep. 13, 2011, "Projector"); and U.S. Pat. No. 8,439,503 (Reichow et al., May 14, 2013, "Infrared Imaging Projection"); and U.S. Patent Applications 20020171813 (Kimura et al., Nov. 21, 2002, "Imaging Prevention Method and System"); 20040091110 (Barkans, May 13, 2004, "Copy Protected Display Screen"); 20040252835 (Odgers, Dec. 16, 2004, "Method for Spoiling Copies of a Theatrical Motion Picture Made Using a Video Camera and Recorder"); 20080174742 (Ito, Jul. 24, 2008, "Projector"); 20080180640 (Ito, Jul. 31, 2008, "Projector"); 20080320606 (Bishop, Dec. 25, 2008, "Device for Interfering with the Pirating of Movies and Artistic Mediums"); and 20120138821 (Joseph et al., Jun. 7, 2012, "Infrared Imaging Projection for Camera Blocking").

C7. Imaging Device Disruption Via Various or Miscellaneous Methods without Integrated Device Detection This miscellaneous category was created for prior art which can generally disrupt imaging devices, which does not provide a way to detect an imaging device, and which does not fall neatly into one of the above categories. In an example, a photography-disrupting device can emit electromagnetic signals which incorporate commands to an imaging device which disrupt operation of the imaging device. There are legal and technical challenges to intermittently or randomly issuing electromagnetic commands without an integrated method for detecting an imaging device. According, technology in this category is not well-suited for use in a wearable device for disrupting unwelcome photography.

Prior art that appears to be best classified into this category includes: U.S. Pat. No. 6,868,229 (Balogh, Mar. 15, 2005, "Interfering with Illicit Recording Activity by Emitting Non-Visible Radiation"); and U.S. Patent Applications 20050008324 (Balogh, Jan. 13, 2005, "Interfering with Illicit Recording Activity by Emitting Non-Visible Radiation"); 20060159440 (Purkayastha et al., Jul. 20, 2006, "Method and Apparatus for Disrupting an Autofocusing Mechanism"); and 20080031596 (Balogh, Feb. 7, 2008, "Interfering with Illicit Recording Activity").

D1. Imaging Device Detection and Disruption by (Radio Frequency) Electromagnetic Emission This is the first category in the fourth group of this review. Devices and methods in the fourth group appear to be able (to at least some extent) to detect and disrupt the operation of nearby imaging devices. This is an improvement over devices and methods in the prior three groups which do not disclose an integrated method of imaging device detection and disruption. However, even prior art in this fourth group falls short of providing people with technology for disrupting unwelcome photography that is wearable, energy-efficient, safe, legal, effective in bright ambient light, affordable, and not-too-horrific in appearance. We now discuss six categories of devices and methods in the prior art within this fourth group. Examples of prior art in these categories have different limitations which cause them to fall short of being wearable, energy-efficient, safe, legal, effective in bright ambient light, affordable, and not-too-horrific in appearance.

The first category in this fourth group includes devices and methods in the prior art which can detect and modify/disrupt the operation of an imaging device via (radio frequency) electromagnetic energy emission. Devices in this present category are an improvement over devices in category C5 which must emit continuous electromagnetic "jamming" energy or command signals because they do not include the capability to detect imaging devices. At least devices in this present category need only emit electromagnetic jamming energy or command signals when an imaging device is detected nearby. This technology can be very useful in restricted areas where unauthorized photography by electronic devices is prohibited.

Nonetheless, there remain legal, safety, and technical limitations to devices and methods in this present category. For example, many jurisdictions do not allow the broadcasting of electromagnetic jamming signals in public areas. Also, transmission of electromagnetic jamming signals at a power sufficient to disrupt the operation of nearby imaging devices can also disrupt the operation of medical devices, causing a safety hazard. Further, the imaging operation of some types of imaging devices is not adversely affected by electromagnetic jamming. For these reasons, devices and methods in this category do not provide an image-disrupting technology that is wearable, energy-efficient, safe, legal, effective in bright ambient light, affordable, and not-too-horrific in appearance.

Prior art that appears to be best classified into this category includes: U.S. Pat. No. 7,564,485 (Nath et al., Jul. 21, 2009, "Method for Deactivating an Image Capturing Device When Present in a Restricted or Prohibited Zone"); and U.S. Pat. No. 8,018,496 (Nath et al., Sep. 13, 2011, "Method for Deactivating an Image Capturing Device When Present in a Restricted or Prohibited Zone"); and U.S. Patent Applications 20100323608 (Sanhedrai et al., Dec. 23, 2010, "System and Method for Preventing Photography").

D2. Imaging Device Detection by (Radio Frequency) Electromagnetic Emission and Disruption by Light Emission Devices and methods in this category appear to be able to detect an imaging device via (radio frequency) electromagnetic emissions and to modify/disrupt the operation of the imaging device via emission of light energy. In an example, such devices can detect the unique electromagnetic signature of a nearby imaging device and disrupt the operation of that device by emitting light energy. This type of technology is promising, but thus far there does not appear to be a lot of prior art in this category. Some of the prior art in this category is designed for military applications, involving detection and destruction of hostile weaponry.

Use of such technology for civilian use in public areas depends on the ability of such technology to detect unique electromagnetic signatures from an imaging device and to direct sufficiently-powerful light energy in a sufficiently-focused manner toward the imaging device to disrupt its operation, without causing a safety hazard. Use of such technology depends on all imaging devices emitting distinctive electromagnetic signatures. Application of this technology to a wearable device also raises the issue of energy efficiency due to limited energy available from a wearable power source. A high-power laser would probably work in all ambient light conditions (including bright sunlight), but use of a high-power laser creates safety and energy-requirement issues in non-military, wearable applications. Use of non-collimated light may not work well in bright ambient light conditions (such as bright sunlight) and/or may require large amounts of energy from a wearable power source.

Overall, there are energy-requirement issues and safety issues that are concerns in civilian public applications that were not concerns in the development of large-scale devices for military purposes. Although one probably could ensure personal privacy by carrying around a high-power laser device which destroys any nearby imaging devices, this is not a constructive solution that would benefit our society. For these reasons, prior art in this category does not yet provide an image-disrupting technology that is wearable, energy-efficient, safe, legal, effective in bright ambient light, affordable, and not-too-horrific in appearance. Prior art that appears to be best classified into this category includes U.S. Pat. No. 7,768,444 (Rourk, Aug. 3, 2010, "Weapon Detection and Elimination System") and U.S. Pat. No. 7,896,509 (Gallagher, Mar. 1, 2011, "Anti-Picture Device").

D3. Imaging Device Detection by Proximity Detection and Disruption by Light Emission Devices and methods in this category are similar to those in the previous category, except that motion sensors (or other methods for detecting proximity) are used to detect a possible imaging device instead of detecting electromagnetic emissions. This approach appears to be relatively uncommon Only one such example was found in the prior art. In this example, electromagnetic radiation (especially light energy) is projected in a randomly-varying manner toward an object or area which is not supposed to be photographed. In an example, light energy is randomly projected toward this object or area in a continuous manner. In an example, light energy is randomly projected toward this object or area when triggered by detection of something near the object or area. Random energy projection tends to be energy inefficient.

Technology in this category can be very useful for applications involving confidential displays in a fixed location, wherein one wishes to activate random photography-disrupting lighting from multiple angles whenever someone approaches the location. However, this technology is less well-suited for a device for disrupting unwelcome photography that is worn by a person who moves and interacts with multiple other people. For example, there would be substantial energy requirements for random photography-disrupting lighting from multiple angles that operates continuously or whenever something approaches the person wearing the device. Lack of an integrated method to detect a specific imaging device and to direct light toward that imaging device makes such an approach energy inefficient.

Although this is an interesting category of technology and prior art in this category can be very useful for selected applications, devices and methods in this category do not yet provide an image-disrupting technology that is wearable, energy-efficient, safe, legal, effective in bright ambient light, affordable, and not-too-horrific in appearance. Prior art that appears to be best classified into this category includes WO 2005125193 (Ehrlich et al., Dec. 29, 2005, "Method and System for Preventing the Photography of Certain Objects").

D4. Imaging Device Detection and Disruption by Light Emission

Devices and methods in this category appear to detect and to modify/disrupt the operation of an imaging device via light emission. Some examples of prior art in this category use a counter-flash to disrupt flash photography. In these examples, a device detects a photography flash from an imaging device and generates a counter-flash to disrupt the picture. This can be useful for disrupting still photography in dim ambient light conditions, but is limited as a technology for disrupting video photography or photography in bright ambient light conditions. Also, light-aiming mechanisms are generally not very well developed in these examples of prior art.

Other examples of prior art in this category use high-power and/or collimated (laser) light to detect and destroy enemy optical and/or weapons systems in military applications. Although useful for military applications, such complex, high-energy, and destructive prior art is not well-suited for a wearable device for disrupting unwelcome photography. As we discussed in the context of previous categories, high-energy, large-scale, and destructive devices that are appropriate for use in military applications do not meet the wearability, energy-efficiency, and safety requirements of privacy-enhancing devices for civilian applications.

This category of technology has a lot of potential for possible future use for disrupting unwelcome photography. However, devices and methods in the prior art in this category do yet not disclose an image-disrupting technology that is wearable, energy-efficient, safe, legal, effective in bright ambient light, affordable, and not-too-horrific in appearance.

Prior art that appears to be best classified into this category includes: U.S. Pat. No. 3,946,233 (Erben et al., Mar. 23, 1976, "Weapon System for the Detection of and Use Against Stationary or Moving Objects"); U.S. Pat. No. 6,111,364 (Davis et al., Aug. 29, 2000, "Method and Device to Inhibit the Flash Photography of a Vehicle"); U.S. Pat. No. 6,603,134 (Wild et al., Aug. 5, 2003, "Optical Detection System"); U.S. Pat. No. 6,937,163 (Caulfield et al., Aug. 30, 2005, "Apparatus and Method for Preventing a Picture from Being Taken by Flash Photography"); U.S. Pat. No. 7,271,898 (Weber, Sep. 18, 2007, "Method and System for Remote Sensing of Optical Instruments and Analysis Thereof"); U.S. Pat. No. 8,077,209 (Kamatani et al., Dec. 13, 2011, "Imaging Preventing Apparatus and Imaging Preventing Method"); U.S. Pat. No. 8,132,491 (Real et al., Mar. 13, 2012, "Method and Apparatus for Detecting and Disabling Optical Weapon Sight"); and U.S. Pat. No. 8,305,252 (Bradley, Nov. 6, 2012, "Countermeasure Device for a Mobile Tracking Device"); and U.S. Patent Applications 20040227634 (Caulfield et al., Nov. 18, 2004, "Apparatus and Method for Preventing a Picture from Being Taken by Flash Photography"); and 20070103552 (Patel et al., May 10, 2007, "Systems and Methods for Disabling Recording Features of Cameras").

D5. Imaging Device Detection by Various Methods and Disruption by Light Emission Devices and methods in this category are similar to those in the previous category, except that they include a greater variety of methods to detect imaging devices, not just light-based detection methods. Some of the art mentions a variety of methods, but does not provide detailed explanations of how each method would be implemented. In an example, some of the methods mentioned include: visually observing an individual, using a viewfinder, using a motion detector, using night vision, using a heat sensor, and using a surveillance camera. Although some devices and methods in the prior art in this category are creative and incorporate a broader range of imaging device detection methods than prior art in the previous category, prior art in this category has similar limitations when it comes to imaging device disruption. Devices and methods in the prior art in this category do yet not disclose an image-disrupting technology that is wearable, energy-efficient, safe, legal, effective in bright ambient light, affordable, and not-too-horrific in appearance.

Prior art that appears to be best classified into this category includes: U.S. Pat. No. 8,157,396 (Smith et al., Apr. 17, 2012, "Inhibiting Unwanted Photography and Video Recording"); and U.S. Patent Applications 20100149782 (Smith et al., Jun. 17, 2010, "Inhibiting Unwanted Photography and Video Recording"); and 20120056546 (Harvey, Mar. 8, 2012, "Anti-Paparazzi/Identity Protection System").

D6. Imaging Device Detection and Disruption by Various or Miscellaneous Methods

This miscellaneous category was created for prior art which can, at least to some extent, detect and disrupt imaging devices, but which does not does not fall neatly into one of the above categories. Some examples of prior art in this miscellaneous category seek to stop unauthorized photography by: halting a playing medium; emitting de-focusing or thwarting signals; or transmitting commands that cause an imaging device to stop, rewind, or eject a recoding medium. Although some devices and methods in this category are very creative, prior art in this category does not yet disclose an image-disrupting technology that is wearable, energy-efficient, safe, legal, effective in bright ambient light, affordable, and not-too-horrific in appearance.

Prior art that appears to be best classified into this category includes U.S. Pat. No. 6,861,640 (Light et al., Mar. 1, 2005, "Detecting and Thwarting Imaging Systems at Theatrical Performances"); U.S. Pat. No. 6,977,366 (Light et al., Dec. 20, 2005, "Detecting and Thwarting Imaging Systems at Theatrical Performances"); U.S. Pat. No. 7,020,383 (Light et al., Mar. 28, 2006, "Detecting and Thwarting Imaging Systems at Theatrical Performances"); U.S. Pat. No. 7,326,911 (Light et al., Feb. 5, 2008, "Detecting and Thwarting Content Signals Originating from Theatrical Performances"); U.S. Pat. No. 7,332,706 (Light et al., Feb. 19, 2008, "Detecting and Thwarting Imaging Systems at Theatrical Performances"); U.S. Pat. No. 7,755,025 (Light et al., Jul. 13, 2010, "Detecting and Thwarting Content Signals Originating from Theatrical Performances"); and U.S. Pat. No. 8,148,673 (Light et al., Apr. 3, 2012, "Detecting and Thwarting Content Signals Originating from Theatrical Performances").

Prior art that appears to be best classified into this category also includes U.S. Patent Applications: 20040094697 (Light et al., May 20, 2004, "Detecting and Thwarting Imaging Systems at Theatrical Performances"); 20040182996 (Light et al., Sep. 23, 2004, "Detecting and Thwarting Imaging Systems at Theatrical Performances"); 20050194522 (Light, Sep. 8, 2005, "Detecting and Thwarting Imaging Systems at Theatrical Performances"); 20050242273 (Light et al., Nov. 3, 2005, "Detecting and Thwarting Imaging Systems at Theatrical Performances"); 20060033017 (Light et al., Feb. 16, 2006, "Detecting and Thwarting Content Signals Originating From Theatrical Performances"); 20080081552 (Light et al., Apr. 3, 2008, "Detecting and Thwarting Content Signals Originating from Theatrical Performances"); and 20100303449 (Light et al., Dec. 2, 2010, "Detecting and Thwarting Content Signals Originating from Theatrical Performances").

SUMMARY AND ADVANTAGES OF THIS INVENTION

This invention is a wearable device and method for disrupting unwelcome photography by a proximal imaging device in order to protect a person's privacy. This invention can be embodied in a device worn by the person whose privacy is to be protected comprising: a wearable light source; an ambient light sensor; an inbound light guide that harvests light from an ambient light source; a data processing unit that selects the use of light from the wearable light source, from the ambient light source, or from both the wearable light source and the ambient light source to disrupt unwelcome photography; and an outbound light guide that directs light from the wearable light source, from the ambient light source, or from both the wearable light source and the ambient light source toward the proximal imaging device in order to disrupt unwelcome photography.

This invention can also be embodied in a method for disrupting unwelcome photography in order to protect a person's privacy. In an example, this method can comprise: selecting one or more light sources from a set of two or more light sources that includes at least one wearable light source worn by a person whose privacy is to be protected from unwelcome photography and at least one ambient light source; and guiding light energy from the one or more selected light sources toward a proximal imaging device in order to disrupt unwelcome photography by the proximal imaging device.

This invention has potential advantages over devices and methods for photography-disruption in the prior art. First, this invention can be more energy-efficient, mobile, and wearable than photography-disrupting devices and methods in prior art that rely exclusively on light from an internal light source or exclusively on light from an ambient light source. Second, this invention can be more effective for disrupting photography in bright ambient light than devices and methods in the prior art than rely exclusively on light from an internal light source. Third, this invention can be more effective for disrupting photography than devices and methods in the prior art which do not automatically detect and/or tract an ambient light source and/or proximal imaging device. Overall, this device and method disclosed herein can be superior to the prior art by being wearable, energy-efficient, safe, legal, effective in bright ambient light, affordable, and not-too-horrific in appearance.

Although there are many potential advantages to society from the development of new imaging devices, including wearable imaging devices, there can also be potential erosion of people's privacy due to ubiquitous unwelcome photography. The wearable device for disrupting unwelcome photography that is disclosed herein provides a new technology that enhances privacy. This can provide people with options that balance out the new technologies that can otherwise erode privacy. Giving people the options of both such technologies can help us as a society to gain benefits from new types of wearable technology without losing the benefits of personal privacy.

INTRODUCTION TO THE FIGURES

FIGS. 1 and 2 show an example of a core device that tracks an ambient light source, tracks a proximal imaging device, harvests light from the ambient light source, and directs this light toward the proximal imaging device to disrupt unwelcome photography.

FIGS. 3 and 4 show this same device when ambient light alone is insufficient to disrupt unwelcome photography by the proximal imaging device, so light from a wearable light source is used as well.

FIGS. 5 and 6 show an example of a core device that harvests ambient light from multiple angles, tracks a proximal imaging device, and directs harvested light toward the proximal imaging device to disrupt unwelcome photography.

FIGS. 7 and 8 show this same device when ambient light alone is insufficient to disrupt unwelcome photography by the proximal imaging device, so light from a wearable light source is used as well.

FIGS. 9 and 10 show an example of a core device that harvests ambient light from multiple angles and directs harvested light toward a proximal imaging device to disrupt unwelcome photography.

FIGS. 11 and 12 show this same device when ambient light alone is insufficient to disrupt unwelcome photography by the proximal imaging device, so light from a wearable light source is used as well.

FIGS. 13 and 14 show an example of a core device that tracks a proximal imaging device and directs a sufficient quantity of light (based on overall ambient light level) from a wearable light source toward a proximal imaging device to disrupt unwelcome photography.

FIGS. 15 and 16 show an example of how the core device introduced in FIGS. 1 and 2 can be incorporated into eyewear. These figures show how the core device can look and function as wearable technology.

FIGS. 17 and 18 show the same eyewear when ambient light alone is insufficient to disrupt unwelcome photography by the proximal imaging device, so light from a wearable light source is used as well.

FIGS. 19 and 20 show an example of how the core device introduced in FIGS. 9 and 10 can be incorporated into eyewear. These figures show how the core device can look and function as wearable technology.

FIGS. 21 and 22 show the same eyewear when ambient light alone is insufficient to disrupt unwelcome photography by the proximal imaging device, so light from a wearable light source is used as well.

FIGS. 23 and 24 show an example of how the core device introduced in FIGS. 13 and 14 can be incorporated into eyewear. These figures show how the core device can look and function as wearable technology.

FIGS. 25 and 26 show an example of a wearable device for disrupting unwelcome photography that is embodied in a baseball cap that harvests ambient light from multiple angles and directs this light toward a proximal imaging device.

FIGS. 27 and 28 show an example of a wearable device for disrupting unwelcome photography that is embodied in a necklace that harvests ambient light and directs this light toward a proximal imaging device.

FIGS. 29 and 30 show an example of a wearable device for disrupting unwelcome photography that is embodied in a hat with a full circular brim that harvests ambient light from multiple angles and directs this light at multiple angles toward a proximal imaging device.

FIG. 31 shows additional internal components, including a ring of LEDs, for the hat embodiment introduced in FIGS. 29 and 30.

FIG. 32 shows additional internal components, including a data processing unit and wireless communications unit, for the hat embodiment introduced in FIGS. 29 and 30.

FIG. 33 shows a "light loop" embodiment of this device which is worn around a person's ear.

FIGS. 34 through 40 show flow charts for alternative method embodiments of this invention for disrupting unwelcome photography using light from an ambient light source, wearable light source, or both ambient and wearable light sources.

DETAILED DESCRIPTION OF THE FIGURES

Figure 1:
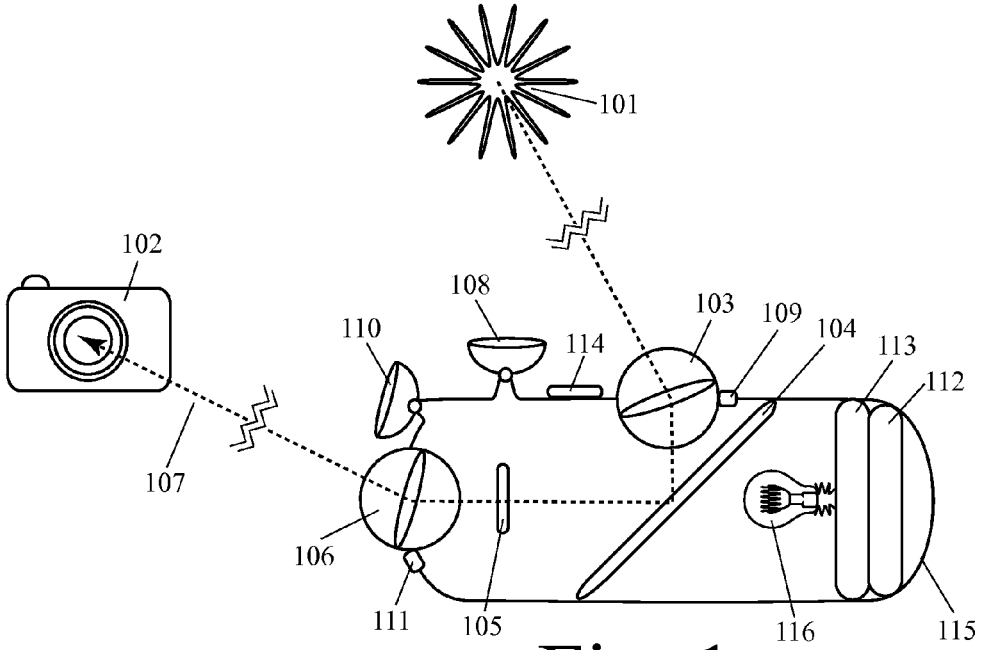
FIGS. 1 through 40 show some examples of how this invention can be embodied in a device and method for disrupting unwelcome photography, but these examples do not limit the full generalizability of the claims.

In addition to providing a narrative to accompany and describe FIGS. 1 through 40 in detail, this section also provides an introduction to the key issues involved in the design of a wearable device for disrupting unwelcome photography. The introductory portions of this section provide the reader with a conceptual framework that can enable quicker understanding of the specific examples that are disclosed in FIGS. 1 through 40. FIGS. 1 through 40 show several examples of how this invention can be embodied in a device and method for disrupting unwelcome photography to protect a person's privacy. However, these figures do not limit the full generalizability of the claims.

1. Detecting a Proximal Imaging Device

A proximal imaging device can be defined with respect to a selected person as a device which: is capable of recording images and/or taking pictures; has a direct line-of-sight to the selected person; and is within a sufficiently short distance from the selected person to record identifiable images and/or take identifiable pictures of that person. In an example, these images or pictures can be still images or pictures. In an example, these images or pictures can be moving images, moving pictures, and/or videos. In an example, these images or pictures can be recorded in analog form. In an example, these images or pictures can be recorded in digital form.

In an example, a proximal imaging device can be a camera or other device whose primary or sole function is to record images and/or take pictures. In an example, a proximal imaging device can be selected from the group consisting of: 35 mm camera, analog or film camera, bracelet camera, button camera, camcorder, CCD camera, CMOS camera, digital camera, eyewear-based camera, motion picture camera, SLR camera, surveillance camera, TV camera, video camera, wrist-based camera, and smart watch camera.

In an example, a proximal imaging device can be a mobile communication or data processing device whose functions include the ability to record images and/or take pictures. In an example, a proximal imaging device can be selected from the group consisting of: cell phone with imaging capability, electronic tablet with imaging capability, holophone, laptop computer, mobile phone with imaging capability, and smart phone with imaging capability.

In an example, a proximal imaging device can be a wearable device whose functions include the ability to record images and/or take pictures. In an example, a proximal imaging device can be selected from the group consisting of: augmented reality eyewear, camera-embedded eyewear, contact lenses with imaging capability, eyewear with imaging capability, smart watch with imaging capability, smart ring, smart clothing, visor or helmet with imaging capability, and wearable button, pendant, or medallion with imaging capability.

In an example, a proximal imaging device can be detected and/or tracked based on the detection and/or tracking of a distinctive pattern of electromagnetic (EM) energy that is emitted from the device. In an example, the electromagnetic energy which is detected to identify and track a proximal imaging device can be in the form of radio frequency (RF) signals. In an example, this electromagnetic energy can be short-range wireless transmissions. In an example, a wearable device for disrupting unwelcome photography can actively scan various frequencies of the electromagnetic spectrum to detect frequencies and signal patterns that indicate that an imaging device is in operation nearby. In an example, a wearable device for disrupting unwelcome photography can continually monitor one or more selected frequencies or signal patterns that are associated with specific types of proximal imaging devices.

In an example, a wearable device for disrupting unwelcome photography can analyze and/or decode electromagnetic signals from a proximal imaging device to determine whether the proximal imaging device is in active use for imaging purposes or not. In an example, a wearable device for disrupting unwelcome photography can analyze and/or decode electromagnetic signals from a proximal imaging device with respect to the location and orientation of the imaging device to determine whether the imaging device is focused toward the person who is wearing the photography-disrupting device.

In an example, a proximal imaging device can be detected and/or tracked based on the detection and/or tracking of infrared energy that is emitted or reflected from the proximal imaging device. For example, some imaging devices actively emit infrared energy emissions for auto-focusing, range finding, gesture recognition, eye movement detection, motion capture, and/or night vision. A wearable device for disrupting unwelcome photography can detect and track these imaging devices by detecting and tracking these infrared emissions. Some imaging devices do not actively emit infrared energy, but nonetheless reflect infrared energy in a distinctive manner when infrared energy from another source is directed toward them.

In an example, a proximal imaging device can be detected and/or tracked based on the detection and/or tracking of a Charged Couple Device (CCD), Complementary Metal Oxide Semiconductor (CMOS), or Single Lens Reflex (SLR) component. In an example, a distinctive pattern of retroreflected visible or infrared light coming from a proximal imaging device's CCD, CMOS, or SLR component can be detected and tracked by a wearable device for disrupting unwelcome photography. In an example, a proximal imaging device can be detected based on electromagnetic emissions from a pixilated array. In an example, a proximal imaging device can be detected and tracked based on the detection and/or tracking of an automatic focusing mechanism. In various examples, an automatic focusing mechanism that can be detected and tracked can be selected from the group consisting of: infrared (IR); sound navigation; and/or ultra-high frequency (UHF) pulses.

In an example, retroreflection of radiant energy from the surface of a selected component of a proximal imaging device can be detected and/or tracked. In an example, retroreflection of radiant energy from the surface of a CCD or CMOS can be used to detect and/or track a proximal imaging device. In an example, retroreflection of radiant energy from a view-finder mirror can be used to detect and/or track a proximal imaging device. In an example, retroreflection of radiant energy from a lens can be used to detect and/or track a proximal imaging device.

In an example, a beam of retroreflected light that is distinctively focused, narrow, collimated, and/or coherent can be used to detect and/or track a proximal imaging device. In an example, retroflection of substantially parallel rays of light from a particular location in a field of view can be used to detect and/or track a proximal imaging device. In an example, specular reflection or transmission of light can be used to detect and/or track a proximal imaging device. In an example, non-specular reflection or transmission of light can be used to detect and/or track a proximal imaging device. In an example, a spot of retroreflected light with a luminosity level that is above a selected level of absolute or relative luminosity can be used to detect and/or track a proximal imaging device. In an example, a local maximum of reflected light can be used detect and/or track a proximal imaging device. In an example, a spot of retroreflected light using a filter for a selected wavelength or wavelength range can be used to detect and/or track a proximal imaging device.

In an example, a photographic flash for still photography or continuous artificial light for video photography can be recognized, particularly under conditions of low ambient light, to detect and/or track a proximal imaging device. In an example, a flash or continuous light from a proximal imaging device can be identified based on its sudden onset, brightness relative to general ambient light level, and/or wavelength spectrum. In an example, an LED or other specific type of light that indicates active use of a proximal imaging device when lit can be used to detect and/or track a proximal imaging device.

In an example, pattern recognition and/or visual object recognition can be used to detect and/or track a proximal imaging device. In an example, the visual shape, color, texture, and/or size of a specific type or brand of proximal imaging device can be recognized by a wearable device in order to detect and/or track that imagining device. In an example, a logo, text, or graphic pattern located on a specific type or brand of proximal imaging device can be recognized by a wearable device in order to detect and/or track that imagining device. In an example, generic features of proximal imaging devices, such as optical apertures, can be recognized by a wearable device in order to detect and/or track a proximal imagining device. In an example, a specific type or brand of camera, communication device with imaging capability, or wearable imaging device can be recognized by its shape, color, texture, size, text, and/or logo. In an example, a proximal imaging device can be identified based on a sequential pattern of movement with respect to a human hand, face, and/or eye.

In an example, the position and/or movement of a proximal imaging device relative to a person's face and/or eyes can be used to detect and/or track a proximal imaging device. In an example, face recognition technology can be used to locate a person's face and/or eyes and then the area surrounding the person's face can be searched for a proximal imaging device. In an example, a proximal imaging device can be detected by its being raised up to a person's face in a manner which obscures one of the person's eyes and then be tracked by its position relative to the person's face. In an example, a proximal imaging device can be detected by following a person's gaze to a hand-held object with retroreflection indicating an optical aperture. In an example, eyewear with imaging capability can be detected and tracked by detection of the camera aperture on an eyewear frame or otherwise within a selected distance from an eye.

In an example, a proximal imaging device can be detected by multivariate analysis of multiple factors selected from the group consisting of: recognition of the shape, color, texture, size, text, and/or logo of a hand-held or wearable imaging device; retroreflection from an exterior or interior surface of the imaging device; position or movement of the device relative to a person's eyes; recognition of a command gesture that is associated with taking a picture by the device; recognition of a verbal command associated with taking a picture by the device; recognition of eye movements associated with taking a picture by the device; recognition of hand or arm movements associated with taking a picture by the device; recognition of a sound associated with taking a picture by the device; and recognition of light activation associated with taking a picture by the device.

In an example, a wearable device for disrupting unwelcome photography can have a wide field of view within which it scans in order to detect and track one or more proximal imaging devices. In an example, a wearable device can detect and track multiple imaging devices in the local environment. In an example, a wearable device for disrupting unwelcome photography can have a wide-angle lens to visually scan a wide field of view for possible proximal imaging devices. In an example, a wearable device for disrupting unwelcome photography can have a compound lens and/or fly's eye lens to visually scan a wide field of view for proximal imaging devices. In an example, a wearable device for disrupting unwelcome photography can have multiple lenses to visually scan a wide field of view for proximal imaging devices. In an example, a wearable device for disrupting unwelcome photography can have a general undirected search function to monitor the local environment for possible proximal imaging devices. In an example, a wearable device for disrupting unwelcome photography can have a directed search function to monitor a subset of the local environment for a known proximal imaging device.

In an example, a proximal imaging device can be detected and/or tracked by detecting and/or tracking one or more sounds associated with a proximal imaging device or the operation of such a device. In an example, a wearable device for disrupting unwelcome photography can have a microphone to detect and/or track sound patterns that are associated with the operation of a proximal imaging device. In an example, shutter clicking sounds (either mechanical or digitally simulated) can be detected and/tracked. In an example, voice commands associated with taking pictures by an imaging device can be recognized to detect and/or track the operation of a proximal imaging device. In an example, ultrasonic signals associated with the operation of an imaging device can be recognized to detect and/or track a proximal imaging device.

In an example, the unexpected movement or unexpected presence of a person in a particular location or setting can be used to focus scanning or monitoring for one or more proximal imaging devices. In an example, if the person wearing a privacy-enhancing device is in a private location in which no other people are expected, then the detection of unexpected movement can trigger intensive scanning for a proximal imaging device. In an example, an unexpected gesture or voice command in the local environment can trigger intensive scanning for a proximal imaging device. In an example, detection of an EEG and/or brainwave pattern indicating surprise or device recognition can trigger intensive scanning for a proximal imaging device.

In an example, a privacy-enhancing wearable device for disrupting unwelcome photography can actively and continuously scan the local environment surrounding the person wearing the privacy-enhancing device in order to detect proximal imaging devices. In an example, the degree of active scanning can be adjusted by the person wearing the privacy-enhancing device based on the desired level of privacy in a given setting. In an example, active scanning of the local environment can comprise coordinated focal movement spanning polar coordinates and up-and-down coordinates. In an example, active scanning of the local environment can comprise coordinated focal movement spanning latitudinal and longitudinal coordinates.

In an example, a privacy-enhancing wearable device can focus on a particular area for intensive scanning based on the gaze direction of the person wearing the privacy-enhancing device. In an example, a privacy-enhancing wearable device can focus on a particular area for intensive scanning based on a gesture by the person wearing the privacy-enhancing device. In an example, a privacy-enhancing wearable device can focus on a particular area for intensive scanning based on EEG or EMG signals from the person wearing the privacy-enhancing device. In an example, a privacy-enhancing wearable device can focus on a particular area from which unwelcome photography is particularly likely to occur, such as doorway through which the person wearing the device will walk or the sidewalk onto which the person will step when they get out of a car.

2. Using Ambient and Wearable Light Sources to Disrupt Photography

In an example, a wearable device for disrupting unwelcome photography can respond to the detection of one or more proximal imaging devices in order to disrupt photography by these imaging devices. In an example, a wearable device for disrupting unwelcome photography can respond by directing radiant energy toward a proximal imaging device to disrupt unwelcome photography by that imaging device. In an example, radiant energy directed toward a proximal imaging device can disrupt unwelcome photography by one or more means selected from the group consisting of: flooding an imaging device with bright light; causing images to be over-exposed; causing blooming or lens flares in images; optically or electronically interfering with the imaging operation of a Charged Couple Device (CCD) or Complementary Metal-Oxide Semiconductor (CMOS); interrupting the autofocus mechanism of an imaging device; causing the imaging device to malfunction; and blocking, obscuring, inhibiting, disabling, or jamming image transmission by the imaging device.

In an example, a wearable device for disrupting unwelcome photography can be used by the wearer to direct light energy toward one or more proximal imaging devices in order to disrupt photography by those imaging devices. In an example, light energy from an actinic light source can be directed toward a proximal imaging device to disrupt unwelcome photography by that device.

In an example, the source of light energy that is used to disrupt unwelcome photography by one or more proximal imaging devices can be an ambient light source. In an example, the source of light energy that is used to disrupt unwelcome photography by one or more proximal imaging devices can be a wearable light source. In an example, light energy to disrupt unwelcome photography by one or more proximal imaging devices can be a combination of light energy from an ambient light source and light energy from a wearable light source.

In an example, light energy from an ambient light source can be reflected, refracted, focused, collimated, directed, guided, channeled, harvested, and/or transduced in order to direct light energy toward a proximal imaging device to disrupt unwelcome photography. In an example, light energy from a wearable light source can be reflected, refracted, focused, collimated, directed, guided, and/or channeled in order to direct light energy toward a proximal imaging device to disrupt unwelcome photography.

In an example, the use of light energy from an ambient light source, the use of light energy from a wearable light source, or the use of a combination of light energy from both ambient and wearable sources can depend on one or more factors selected from the group consisting of: the absolute amount of ambient light energy from an ambient light source; the amount of ambient light energy that can be harvested from an ambient light source; the variation in light energy from an ambient light source over time; the area variability (or homogeneity) of ambient light; the area concentration (or diffusion) of ambient light; the total amount of ambient light energy (from all ambient light sources); the movement of a person wearing a photography-disrupting device relative to an ambient light source; the movement of an ambient light source relative to the person wearing a photography-disrupting device; the type (natural or artificial) of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device (such as determined by a GPS system); the movement of a person wearing a photography-disrupting device relative to the pull of gravity, the earth, or a GPS system; and current or predicted weather conditions.

In an example, an ambient light source can be a natural light source such as the sun or moon. In an example, an ambient light source can be an artificial light source. In an example, a wearable light source can be an artificial light source. In an example, a light source for disrupting unwelcome photography can be selected from the group consisting of: a polarized light source, a collimated light source, and a coherent light source. In an example, light from a non-polarized light source can be polarized by a wearable device, light from a non-collimated light source can be collimated by a wearable device, and/or light from a non-coherent light source can be made coherent by a wearable device.

In an example, one or more artificial ambient light sources and/or artificial wearable artificial light sources for disrupting unwelcome photography can be selected from the group consisting of: a Light Emitting Diode (LED), an infrared (IR) light source, a laser, an ultraviolet (UV) light source, a fluorescent light source, a halogen lamp, a Liquid Crystal Display (LCD), a photoluminescent light source, a quartz lamp, an Electro Luminescent (EL) light source, and an incandescent light source. In an example, a Light Emitting Diode (LED) or an array of LEDs for disrupting unwelcome photography can be selected from the group consisting of: white LED, color LED, infrared (IR) LED, Organic Light-Emitting Diode (OLED), and ultraviolet LED. In an example, one or more wearable light sources can be selected from the group consisting of: actinic light source, fluorescent light, halogen lamp, incandescent light, infrared (IR) light, laser, Light Emitting Diode (LED) array, optical fiber, Organic Light Emitting Diode (OLED), photoluminescent light, quartz lamp, and regular Light Emitting Diode (LED).

In an example, an infrared (IR) light source for disrupting unwelcome photography can be selected from the group consisting of: a LWIR (Long Wave Infrared) light source; and a MWIR (Mid Wave Infrared) light source. If feasible to implement in a safe manner, a laser for disrupting unwelcome photography can be selected from the group consisting of: a low-energy laser, a solid state laser, a semiconductor laser, a diode laser, a monochromatic laser, a visible light laser, an infrared (IR) laser, a near-infrared laser, an ultraviolet (UV) laser, a tunable laser, and a scanning laser.

In an example, a wearable device for disrupting unwelcome photography can harvest light energy from an ambient light source such as the sun or artificial lighting. In an example, a wearable device can include an ambient light sensor to measure the total level of ambient light and a harvested light sensor to measure the amount of ambient light harvested by the wearable device for direction toward a proximal imaging device. In an example, if there is sufficient harvested ambient light energy relative to the total amount of ambient light energy, then harvested ambient light alone can be used to disrupt photography by the proximal imaging device. If there is not sufficient harvested ambient light relative to the total amount of ambient light energy, then the wearable device can use light energy from a wearable light source in addition to, or instead of, light energy from an ambient light source.

In an example, a wearable device for disrupting unwelcome photography can monitor the environment to detect, identify, analyze, and/or track one or more qualified ambient light sources. In an example, a qualified light source is a light source which can provide sufficient light energy for use by the wearable device to disrupt unwelcome photography by a proximal imaging device. In an example, one or more factors affecting qualification of an ambient light source can be selected from the group consisting of: amount of light energy from the ambient light source; variation over time in energy from the ambient light source; type and spectrum of ambient light source; size of the ambient light source; distance, location, and/or direction of the light source; relative movement between the person wearing the photography-disrupting device and the ambient light source; and number and characteristics of potential alternative ambient light sources. In an example, a wearable device for disrupting unwelcome photography can have one more sensors to analyze ambient light wherein these sensors are selected from the group consisting of: photocell, photodiode, phototransistor, photovoltaic cell, light wavelength or color sensor, and spectrometer.

In an example, a wearable device for disrupting unwelcome photography can reflect, refract, direct, guide, harvest, and/or transduce light energy from an ambient light source toward a proximal imaging device to disrupt unwelcome photography by that imaging device. In an example, a wearable device can comprise multiple fixed-location inbound light guides which can harvest light from ambient light sources from different directions. In an example, a wearable device can comprise one or more moveable inbound light guides which can be moved to more efficiently harvest light from an ambient light source from a particular direction. In an example, one or more inbound light guides can be moved manually by the person wearing the device which includes them. In an example, one or more inbound light guides can be moved automatically by an actuator that is part of the device which includes them. In an example, a device can track the location and/or movement of an ambient light source relative to the person and can move one or more light guides to more efficiently harvest light from that ambient light source.

In an example, a wearable device for disrupting unwelcome photography by a proximal imaging device can reflect, refract, direct, and/or guide light energy from an ambient light source toward the proximal imaging device in real time. In an example, one or more reflective surfaces such as mirrors can be used to direct light energy from an ambient light source toward a proximal imaging device. In an example, one or more refracting surfaces such as lenses can be used to direct light energy from an ambient light source toward a proximal imaging device. In an example, fiber optics can be used to direct light energy from an ambient light source toward a proximal imaging device. In an example, light from one or more ambient light sources can be reflected, refracted, directed, and/or guided by one or more inbound light guides. In an example, a light guide can be part of a device that is worn as an accessory by a person whose privacy is to be protected by disrupting unwelcome photography. In an example a light guide can be part of an article of clothing that is worn by this person.

In an example, a wearable device for disrupting unwelcome photography can monitor one or more ambient light sources to determine whether they can provide sufficient light energy to disrupt unwelcome photography when light from an ambient light source is directed toward a proximal imaging device. In an example, a "qualified" ambient light source is an ambient light source that can provide sufficient harvested or redirected light energy to disrupt unwelcome photography by a proximal imaging device. In an example, a qualified ambient light source can be an ambient light source that exceeds a selected absolute level of local luminosity. In an example, a qualified ambient light source can be an ambient light source with local luminosity that exceeds overall ambient luminosity by a selected amount or percent. In an example, a wearable device for using ambient light to disrupt unwelcome photography can include an ambient light sensor. If a qualified ambient light source is not detected, or if insufficient ambient light is harvested as measured by a harvested ambient light sensor, then a wearable light source can be used instead of an ambient light source or to supplement an ambient light source.

In various examples, a wearable device that uses light energy to disrupt unwelcome photography can evaluate whether an ambient light source is qualified based on one or more factors selected from the group consisting of: absolute amount of radiant energy from the ambient light source; spectral frequencies of energy from the ambient light source; amount of energy from the light source relative to overall ambient light; consistency of light from the ambient light source; stationary or moving nature of the ambient light source; angle or position of the ambient light source relative to person; and angle or position of the ambient light source relative to a proximal imaging device.

In various examples, a wearable device that uses light energy to disrupt unwelcome photography can evaluate whether an ambient light source is qualified based on one or more factors selected from the group consisting of: average amount of radiant energy available locally from all ambient light sources in the environment; the variability of radiant light energy with respect to one or more ambient light sources in the environment; selection of a specific ambient light source for potential energy harvesting; the consistency of light from an ambient light source over time; the locational stability of a candidate light ambient source; the spectrum of light from an ambient light source; a direct line of sight to an ambient light source; whether the ambient light source is a natural or artificial light source; current or predicted weather; and time of day.

In various examples, the best ambient light source can be selected based on one or more factors selected from the group consisting of: locally-harvested radiant energy, concentration of radiant energy per local area measure, amount of absolute movement, amount of movement relative to the person, consistency in terms of energy variation over time, wavelength frequency range or distribution, spanning the person's current location and likely future location, energy level relative to overall ambient level, and energy level relative to that of a wearable light source.

In an example, light from an ambient light source can be reflected, refracted, guided, focused, and/or directed in real time toward one or more proximal imaging devices to disrupt unwelcome photography. In an example, light from an ambient light source can be transduced and/or stored for later conversion into light energy to disrupt unwelcome photography. In an example, light from an ambient light source can be reflected, refracted, guided, focused, and/or directed toward a proximal imaging device in a continuous manner. In an example, light from an ambient light source can be reflected, refracted, guided, focused, and/or directed toward a proximal imaging device in a non-continuous manner, such as in one or more flashes or bursts of light. In an example, the luminosity and/or strength of a beam of light directed toward a proximal imaging device can be varied or adjusted in an iterative manner in order to most efficiently disrupt photography by a proximal imaging device.

In an example, a wearable device for disrupting unwelcome photography can direct a single flash, pulse, or burst of light toward a proximal imaging device to disrupt photography by that device. In an example, a series or pattern of light flashes, pulses, or bursts can be directed toward a proximal imaging device. In an example, a series or pattern of light flashes of different colors and/or wavelengths can be directed toward a proximal imaging device. In an example, a repeated or random pattern of light flashes can be selected to prevent the light sensor on a proximal imaging device from adapting and thus disrupt photography by that imaging device. In an example, one or more light flashes can be sufficiently brief that they disrupt photography without being detected by the human eye. In an example, a flash or burst of light can be sufficiently rapid and/or brief that it can disrupt photography by a proximal imaging device without substantive detection by a human eye. In an example, a flash or burst of light can be sufficiently rapid and/or brief that it can disrupt photography by a proximal imaging device without harming a human eye.

In an example, one or more attributes of light harvested from an ambient light source can be modified by a wearable device for disrupting unwelcome photography before this light is directed toward a proximal imaging device. These one or more attributes can be selected from the group consisting of: travel vector, luminosity, intensity, collimation, focal length, polarization, duration, color and wavelength. In an example, non-collimated ambient light can be collimated before being directed toward a proximal imaging device. In an example, non-polarized ambient light can be polarized before being directed toward a proximal imaging device. In an example, broad-spectrum ambient light can be filtered to create narrow-spectrum light which is directed toward a proximal imaging device. In an example, continuous ambient light can be transduced into non-continuous light flashes before being directed toward a proximal imaging device.

In an example, collimated or coherent light that is directed toward a proximal imaging device can be at an energy-level, wavelength, and/or duration such that it would not cause harm if it is inadvertently directed into a human eye. In an example, a wearable device for disrupting unwelcome photography can have a safety mechanism that detects human eyes and avoids directing a beam of light into a human eye. In an example, facial recognition software can be used to detect the location of a human eye and avoid direction of a beam of light into an eye. In an example, a wearable device for disrupting unwelcome photography can recognize the distinctive pattern of reflection from a human retina and use such detection to immediately change the direction of a beam of light that hits a human retina.

In an example, a wearable device for disrupting unwelcome photography can direct light in a selected wavelength or wavelength range toward a proximal imaging device. In an example, this light can be visible light, infrared light, or ultraviolet light. In an example, the wavelength of light directed toward a proximal imaging device can be varied or adjusted in an iterative manner in order to optimally disrupt photography by the proximal imaging device. In an example, the intensity, duration, angle, color, focal length, polarization, and/or collimation of a beam of light directed toward a proximal imaging device can be varied or adjusted in an iterative manner in order to optimally disrupt photography by the proximal imaging device.

In an example, light from an ambient light source can be redirected in random directions in the absence of a detected proximal imaging device. In an example, light from an ambient light source can be redirected in a selected direction based on the location of a detected proximal imaging device or the probable location of a proximal imaging device. In an example, light from one or more ambient light sources can be collected from multiple inbound light guides, lenses, optical fibers, mirrors, and/or optical pathways that collect light from different directions. In an example, light from one or more ambient light sources can be collected by a single inbound light guide, lens, optical fiber, mirror, and/or optical pathway that moves to collect light from different directions. In an example, a wearable device can track the changing location of one or more ambient light sources and move an inbound light guide to more efficiently collect light from this moving light source.

In an example, a wearable device for disrupting unwelcome photography can direct a beam of light toward a selected location where a specific proximal imagining device is detected. In an example, a wearable device for disrupting unwelcome photography can direct a beam of toward a selected area where there is a high probability of there being one or more imaging devices. In an example, a wearable device for disrupting unwelcome photography can direct a beam of light in a selected pattern or in a random manner so as to disrupt photography by any proximal imaging devices without requiring detection of specific imaging device in a particular location. In an example, the extent to which a beam of light energy is focused or concentrated toward a particular place can depend on the certainty with which a proximal imaging device is located at the place. In an example, the extent to which a beam of light energy is collimated can depend on the size and/or distance of the area within which a proximal imaging device is likely to be located.

In an example, the strength or luminosity of a beam of light that is directed toward a proximal imaging device to disrupt photography can depend on the level of overall ambient light. In an example, the strength or luminosity of a beam of light that is directed toward a proximal imaging device to disrupt photography can depend on the amount of light energy harvested from an ambient light source. In an example, the strength or luminosity of a beam of light that is directed toward a proximal imaging device to disrupt photography can depend on the amount of energy available in a wearable power source to power a wearable light source. In an example, the strength or luminosity of a beam of light that is directed toward a proximal imaging device to disrupt photography can depend on the type of proximal imaging device that is detected.

In an example, light energy from an ambient light source and light energy from a wearable light source can be combined, blended, mixed, and/or merged to form a beam of light that is directed toward a proximal imaging device to disrupt unwelcome photography. In an example, the relative mixture or blend of light energy from an ambient light source and a wearable light source can depend on factors selected from the group consisting of: overall ambient light level; amount of light energy harvested from an ambient light source; variability of light energy harvested from an ambient light source; wavelength or spectrum of light energy harvested from an ambient light source; amount of light energy produced by a wearable light source; amount of energy available to power the wearable light source; type, number, and/or location of proximal imaging devices; level of privacy manually set by the person wearing a photography-disrupting device; and level of privacy automatically determined based on the setting (including location and time).

In an example, a wearable device for disrupting unwelcome photography can be powered by an ambient light source, by a wearable light source, or by a combination of an ambient light source and a wearable light source. In an example, when light energy harvested from an ambient light source is insufficient to disrupt photography by a proximal imaging device, then light from a wearable light source will to used to supplement and/or replace light energy from the ambient light source. In an example, when there is a limited amount of energy available to power a wearable light source, then light from an ambient light source can be used to supplement and/or replace light from the wearable light source. In an example, when there is limited remaining energy in a wearable battery to power a wearable light source, then light from an ambient light source can be used to supplement and/or replace light from the wearable light source.

In an example, a wearable device for disrupting unwelcome photography can include an ambient light sensor to detect the overall level of ambient light. In an example, a wearable device for disrupting unwelcome photography can include a harvested ambient light sensor to detect the amount of ambient light energy that is harvested by the wearable device and available for direction toward a proximal imaging device.

In an example, the use of an ambient light source versus a wearable light source can be adjusted over time based on the availability of ambient light vs. energy to power the wearable light. In an example this adjustment of using ambient versus wearable light sources can be done automatically by a data processor. In an example this adjustment of using ambient vs. wearable light sources can be done manually by a person wearing a device for disrupting unwelcome photography. In an example, a device can harvest ambient light energy, store this energy in the form of electricity, and use this electricity later to power a wearable light source. In an example, a wearable device can harvest, collect, and/or transduce energy from an ambient light source for later use of that energy to disrupt unwelcome photography by a proximal imaging device. In an example, light energy can be transduced into electricity when no imaging device is present, stored in a battery as electricity, and then later transduced back into light energy when an imaging device is present.

In an example, a wearable device for disrupting unwelcome photography can adjust the relative use of ambient light versus light from a wearable light source based on present or expected weather conditions when a person wearing the device is outside. In an example, a wearable device can harvest direct or reflected sunlight to disrupt unwelcome photography in a sunny environment. In an example, a wearable device for disrupting unwelcome photography can adjust the relative use of ambient versus light from a wearable light source based on the time of day when a person is wearing the device outside. In an example, a wearable device can use light from a wearable light source in a dark night environment.

In an example, a wearable device for disrupting unwelcome photography can disrupt photography by one or more proximal imaging devices within a first selected distance of the person wearing the device by means of one or more beams of non-collimated, non-coherent light. In an example, a wearable device for disrupting unwelcome photography can disrupt photography by one or more proximal imaging devices within a second selected distance of the person wearing the device by means of one or more beams of collimated and/or coherent light, wherein the second distance is greater than the first distance. In an example, the first distance can be up to 10 feet away. In an example, the second distance can be up to 100 feet away.

In an example, a wearable device for disrupting unwelcome photography can disrupt photography by one or more proximal imaging devices within a first selected field of view with a beam of light with a first luminosity level. In an example, a wearable device for disrupting unwelcome photography can disrupt photography by one or more proximal imaging devices within a second selected field of view with a beam of light with a second luminosity level.

In an example, a first field of view can comprise the field of view that is visible from the eyes of a person wearing the device. In an example, a first field of view can span between 90 degrees and 180 degrees. In an example, a first field of view can be the view that is substantially "in front of" the person. In an example, the first field of view can include locations from which a proximal imaging device can photograph the face of the person wearing the device.

In an example, a second field of view can comprise lines-of-sight that are outside the field of view that is visible from the person's eyes. In an example, a second field of view can span between 180 degrees and 270 degrees. In an example, the first luminosity level can be greater than the second luminosity level. In an example, a wearable device for disrupting unwelcome photography can focus more disruptive light energy toward imaging devices that have a direct line-of-sight to the face of the person wearing the photography-disrupting device.

In an example, a wearable device for disrupting unwelcome photography can track the relative movement of a proximal imaging device in order to keep a beam of light directed toward the proximal imaging device. In an example, a wearable device for disrupting unwelcome photography can track the movement of a proximal imaging device relative to the person wearing photography-disrupting device. In an example, a wearable device can control for movement of the person wearing the device through the use of one or more wearable motion sensors, such as wearable multi-axial accelerometers.

In an example, movement of a proximal imaging device can be tracked and predicted using mathematical models of physical object motion. In an example, movement of a proximal imaging device that is worn or held by a person can be tracked and predicted using models of human body movement. In an example, movement of a proximal imaging device that is worn or held by a person can be tracked and predicted using models of human skeletal movement and/or human kinesiology. In an example, movement of a proximal imaging device that is worn or held by a person can be tracked and predicted using gesture recognition. In an example, a Fourier transform can be used to control for the effects of repetitive movements (such as walking or running) by the person wearing a device as the device tracks changes in the relative positions of an ambient light source and/or a proximal imaging device.

In an example, the movement and/or use pattern of a proximal imaging device can be analyzed to infer whether the person using the imaging device is attempting to evade detection or photography disruption. In an example, if a person is moving a proximal imaging device in an unnatural and/or evasive manner, then a device for disrupting unwelcome photography can respond by changing one or more light beam parameters selected from the group consisting of: strength of the light beam; breadth of area covered by movement of the light beam; degree of light collimation; degree of light coherence; and light beam wavelength. In an example, if a person is moving a proximal imaging device in an unnatural and/or evasive manner, then a device for disrupting unwelcome photography can respond by changing the way that it tracks the proximal imaging device.

In an example, a wearable device for disrupting unwelcome photography can direct more than one light beam toward a proximal imaging device. In an example, a wearable device can direct two beams of light which intersect, converge, and/or interact at the location of a proximal imaging device. In an example, the intersection, convergence, and/or interaction of two light beams on a proximal imaging device can more effectively disrupt photography by that imaging device. In an example, two beams of light with different polarizations can intersect synergistically at the location of a proximal imaging device to more effectively disrupt photography. In an example, two beams of light with different wavelengths can intersect synergistically at the location of a proximal imaging device to more effectively disrupt photography. In an example, two beams of light with different degrees or orientations of collimation and/or coherence can intersect synergistically at the location of a proximal imaging device to more effectively disrupt photography.

3. Harvesting and Directing Light with Inbound and Outbound Light Guides

In an example, a wearable device for disrupting unwelcome photography can include an inbound light guide to direct, reflect, refract, channel, or harvest light from an ambient light source. In an example, this inbound light guide can move to track an ambient light source and to better harvest light energy from that ambient light source. In an example, a wearable device for disrupting unwelcome photography can include an outbound light guide to direct, reflect, refract, or channel light toward a proximal imaging device. In an example, this outbound light guide can move to track the proximal imaging device and to better direct light toward the imaging device to disrupt unwelcome photography.

In an example, light from an ambient light source can be directed, reflected, refracted, channeled, or focused by an inbound light guide to a specific location within a wearable device. In an example, light from this specific location can then be directed, reflected, refracted, channeled, or focused by an outbound light guide toward a proximal imaging device. In an example, light from an ambient light source can be directed into a central location, pathway, tube, channel, or fiber using one or more inbound light guides and then directed toward a proximal imaging device using one or more outbound light guides. In an example, light from an ambient light source can be combined with light from a wearable light source and a combined light beam can then be directed toward a proximal imaging device using one or more outbound light guides.

In various examples, one or more light guides can be selected from the group consisting of: acrylic mirror, aluminum vapor coated film, reflector array, carbon nanotube, compound lens, concentric lenses, concentric reflective surfaces, crystal, crystal array, cylindrical prism, dielectric mirror, Digital Light Processor (DLP), Digital Micromirror Device (DMD), diverging lens, asymmetric lens, wedge-shaped lens, Electromagnetically Induced Transparency (EIT) structure, fly's eye lens, Fresnel lens, microscale glass beads, light-guiding metamaterial structure, light-guiding tubes, light-transducing element, liquid crystal, liquid lens, MEMS-based mirror array, metamaterial light channel, microlens array, microsphere lenses, mirror ball, reflective surface array, nanorod, nanotube, optical fiber, parabolic reflective surface, parabolic lens, parabolic mirror or reflector, photonic crystal, plasmonic metamaterial structure, polarizing filter, polyethylene film, prism, rectangular prism, reflector, retroreflective structure, rhomboid prism, simple lens, Split Ring Resonator (SRR), and wedge prism.

In an example, an inbound light guide or outbound light guide can be comprised of one or more mirrors. In an example, an inbound light guide or outbound light guide can comprise a DMD (Digital Micromirror Device). In an example, coordinated movement of mirrors in a DMD can help an inbound light guide to better harvest light from an ambient light source. In an example, coordinated movement of mirrors in a DMD can help an outbound light guide to better direct light toward a proximal imaging device. In an example, an inbound light guide or outbound light guide can comprise a dielectric mirror structure. In an example, an inbound light guide or outbound light guide can comprise a spinning mirror ball, especially when it is not possible to detect and track a specific ambient light source or proximal imaging device. In an example, an inbound light guide or outbound light guide can have microscale components that are moved by Micro ElectroMechanical Systems (MEMS).

In an example, an inbound light guide or outbound light guide can have a concentric configuration, comprising multiple concentric reflecting or refracting members which guide, direct, or channel light along a particular path. In an example, an inbound light guide or outbound light guide can be comprised of carbon nanotubes. In an example, an inbound light guide or outbound light guide can comprise one or multiple optical fibers that direct light efficiently along a particular path. In an example, an inbound light guide or outbound light guide can comprise bendable optical fibers that are incorporated into an article of clothing.

In various examples, an inbound light guide or outbound light guide can reflect, refract, bend, guide, or transduce light rays from an ambient light source, a wearable light source, or both. In an example, an inbound light guide or outbound light guide can substantially collimate a beam of light which is then directed toward a proximal imaging device. In an example, collimation can be done using a micro-mirror array, parabolic reflector, Fresnel lens, compound lens, or fiber optic array.

In an example, a device can comprise multiple inbound light guides or multiple outbound light guides. In an example, multiple inbound light guides can harvest light energy from multiple directions and/or ambient light sources. In an example, multiple outbound light guides can disrupt imaging devices in multiple locations. In an example, a low-energy outbound light beam can be used to target the location of a proximal imaging device and a high-energy outbound light beam can be used to disrupt photography by a device at that location.

In an example, an inbound light guide or outbound light guide can change the direction, collimation, focal range, and/or wavelength range of inbound light from an ambient light source or outbound light directed toward a proximal imaging device. In an example, an inbound light guide can be moved to more effectively harvest light from a moving ambient light source. In an example, an outbound light guide can be moved to more effectively direct light toward a proximal imaging device.

In an example, an inbound light guide or outbound light guide can be part of a wearable device and moved directly by movement of the person wearing the device. In an example, an inbound light guide or outbound light guide can be automatically moved by a component that tracks movement of an ambient light source, movement of a proximal imaging device, and/or movement of the person wearing the photography-disrupting device. In an example, an inbound light guide or outbound light guide can be moved by a motor or actuator. In an example, an inbound light guide or outbound light guide can be moved by piezoelectric actuators or Micro Electro Mechanical Systems (MEMS).

In an example, a person can aim a beam of light from a wearable device for disrupting photography using one or more body motions selected from the group consisting of: turning and/or inclining their head, pointing their finger, extending their arm, gazing or focusing in a particular direction with their eyes, winking their eye, making a hand gesture, and adjusting a control on a handheld device. In an example, a person can aim a beam of light from a wearable device by moving an outbound light guide by one or more body motions selected from the group consisting of: turning and/or inclining their head, pointing their finger, extending their arm, gazing or focusing in a particular direction with their eyes, winking their eye, making a hand gesture, and adjusting a control on a handheld device.

In an example, an inbound light guide or outbound light guide that is part of a wearable device for disrupting unwelcome photography can move automatically in response to movement of an ambient light source, proximal imaging device, and/or the person wearing the photography-disrupting device. In an example, a wearable device for disrupting unwelcome photography can have an inbound light guide mover. This mover can move the inbound light guide automatically in response to tracked movements of an ambient light source. In an example, a wearable device for disrupting unwelcome photography can have an outbound light guide mover. This mover can move the outbound light guide automatically in response to tracked movements of a proximal imaging device.

In an example, physical laws with respect to movements of objects in the real world can be used to help track and predict the motion path of an ambient light source and/or a proximal imaging device. In an example, an accelerometer can be incorporated into a photography-disrupting wearable device to control for movement of the person wearing the device. In an example, anatomical or kinesthetic models can be used to help track and predict the motion path of a proximal imaging device which is held or worn by a person. In an example, a Fourier transform can be used to control for the effects of repetitive movements (such as walking or running) by the person wearing a device as the device tracks changes in the relative positions of an ambient light source and/or a proximal imaging device.

In an example, the direction of refraction or reflection of inbound light rays can be changed as an ambient light source moves in order to more efficiently harvest light from the light source. In an example, a wearable device for disrupting unwelcome photography can include a mechanism that allows the wearer to remotely adjust the angle of reflection or refraction of light rays from an ambient light source. In an example, an inbound light guide and an outbound light guide can share a common focal point, allowing independent adjustment of the inbound light guide and the outbound light guide.

In an example, an inbound light guide or outbound light guide can be moved directly by movement of a portion of a person's body. For example, if a device is worn on a person's wrist, then movement of their wrist can move the inbound light guide or outbound light guide directly. In an example, an inbound light guide or outbound light guide can be moved by means of a wireless remote control. For example, a device worn on a person's head or hat can be moved by touching a screen on a wireless hand-held remote control. In an example, an inbound light guide or outbound light guide can be moved by voice command. In an example, an inbound light guide or outbound light guide can be moved by recognition of a hand gesture.

In an example, some or all of the motion of an inbound light guide or an outbound light guide can be controlled manually, such as by movement of the person wearing a photography-disrupting device. In an example, some or all of the motion of an inbound light guide or an outbound light guide can be controlled automatically, such as by a tracking device that tracks the location of an ambient light source or proximal imaging device. In an example, an inbound light guide or outbound light guide can be controlled by a combination of manual and automatic means. In an example, initial identification of an ambient light source or proximal imaging device can be done manually by a person and ongoing tracking can be done by an automatic tracking mechanism. In an example, a person can manually track the path of a moving ambient light source or proximal imaging device until an automatic tracking mechanism acquires and "locks onto" the target.

In an example, an inbound light guide or outbound light guide can modify a beam of light in one or more of the following ways: changing its direction, changing its collimation, changing its wavelength, changing its temporal concentration (e.g. from continuous beam to non-continuous flashes), and changing its area-wise concentration (e.g. from diffuse illumination of a broad area to intense illumination of a narrow area). In an example, an outbound light guide can direct a beam of light toward a location where there is a detected proximal imaging device. In an example, an outbound light guide can direct a beam of light toward a region with a high probability of having a proximal imaging device. In an example, an outbound light guide can rotate one or more beams of light in a clockwise or counterclockwise manner, similar to light beam transmission by a lighthouse, around a person whose privacy is to be protected. In an example, an outbound light guide can direct one or more beams of light in relatively-random vectors that extend outwards from a person whose privacy is to be protected.

In an example, a wearable device for disrupting unwelcome photography which harvests ambient light energy can include a harvested light sensor. A harvested light sensor can measure the amount and/or type of light energy that is harvested from one or more ambient light sources for use by the device. In an example, a harvested light sensor can be downstream from an inbound light guide. In an example, a harvested light sensor can measure the amount of ambient light energy collected by one or more inbound light guides. In an example, a harvested light sensor can be located inside a wearable device housing so that it only measures light harvested by the inbound light guide and not the overall level of ambient light external to the housing.

In an example, the amount of harvested light energy can be compared to the total amount of ambient light energy to evaluate whether the harvested light energy will be sufficient to disrupt photography by a proximal imaging device. In an example, in an environment with relatively-diffuse ambient lighting and no relatively-high-intensity ambient light source, it can be difficult to disrupt photography with harvested light energy alone. In this case, light from a wearable light source will probably be required to supplement (or entirely replace) harvested ambient light for disruption of unwelcome photography. Such an environment can be identified by a low absolute amount of harvested ambient light or by a low level of harvested light relative to total ambient light.

In another example, in an environment with a relatively-high-intensity ambient light source, such as direct sunlight, it can be relatively easy to disrupt photography with harvested ambient light alone. Such an environment can be identified by a high absolute amount of harvested ambient light. In this latter case, light from a wearable light source would probably not be required (and would be inadequate by itself) to disrupt photography by a proximal imaging device.

4. Wearable Embodiments to Disrupt Unwelcome Photography

In an example, a wearable device for disrupting unwelcome photography can be worn directly on a person's body. In an example, a wearable device for disrupting unwelcome photography can be attached to a non-specialized article of clothing. In an example, a wearable device for disrupting unwelcome photography can be integrated into a specialized article of clothing.

In an example, a wearable device for disrupting unwelcome photography can be worn on (or over) a person's head, eyes, ears, wrist, neck, finger, hand, nose, torso, chest, waist, arm, and/or leg. In an example, a wearable device for disrupting unwelcome photography can be worn on, or attached to, a part of a person's body that is selected from the group consisting of: wrist (one or both), hand (one or both), or finger; neck or throat; eyes (directly such as via contact lens or indirectly such as via eyewear); mouth, jaw, lips, tongue, teeth, or upper palate; arm (one or both); waist, abdomen, or torso; nose; ear; head or hair; and ankle or leg.

In an example, a wearable device for disrupting unwelcome photography can be worn by a person in a manner similar to a piece of jewelry. In an example, a wearable device for disrupting unwelcome photography can be worn in a manner similar to a piece of jewelry selected from the group consisting of: amulet, ankle bracelet, arm bracelet, wrist bracelet, brooch, charm bracelet, cuff link, earring, finger ring, key chain or key ring, necklace, neck chain, neck band, nose ring, ornamental pin, pendant, medallion, or locket, pin, smart beads, smart ring, and tongue ring. In an example, a wearable device for disrupting unwelcome photography can be integrated into a piece of jewelry selected from the group consisting of: amulet, ankle bracelet, arm bracelet, wrist bracelet, brooch, charm bracelet, cuff link, earring, finger ring, key chain or key ring, necklace, neck chain, neck band, nose ring, ornamental pin, pendant, medallion, or locket, pin, smart beads, smart ring, and tongue ring.

In an example, a wearable device for disrupting unwelcome photography can be worn by a person in a manner similar to an article of clothing. In an example, a wearable device for disrupting unwelcome photography can be worn by a person in a manner similar to an article of clothing selected from the group consisting of: ankle band, armband, belt or belt buckle, blouse or shirt, clothing buckle, clothing button, coat or jacket, dress or skirt, glove, hat or cap, headband, hoodie or poncho, neck tie, pants, jeans, or short, shirt or blouse, shoes or boots, socks, sweat suit, and undergarment, underpants, undershirt, bra, or underwear. In an example, a wearable device for disrupting unwelcome photography can be integrated into an article of clothing selected from the group consisting of: ankle band, armband, belt or belt buckle, blouse or shirt, clothing buckle, clothing button, coat or jacket, dress or skirt, hat or cap, headband, hoodie or poncho, neck tie, pants, jeans, or short, scarf, shirt or blouse, shoes or boots, socks, sweat suit, and undergarment, underpants, undershirt, bra, or underwear. In an example, light beams hitting different areas of a garment can be directed through light tunnels in the garment toward a central location from which they are then directed toward a proximal imaging device.

In an example, a wearable device for disrupting unwelcome photography can be worn on a person's head as one or more of the following wearable items: electronically-functional glasses, goggles, contact lenses, visor, or other eyewear; camera in glasses, goggles, contact lenses, visor, or other eyewear; augmented reality (AR) glasses, goggles, contact lenses, visor, or other eyewear; virtual reality (VR) glasses, goggles, contact lenses, visor, or other eyewear; headphones, headset, ear buds, ear phones, hearing aid, or light loops; hair band, clip, or pin; hat, cap, or headband; ear ring, nose ring, tongue ring; and dental appliance, dental insert, or palatal vault attachment. In an example, a wearable device for disrupting unwelcome photography can be embodied in a wearable member selected from the group consisting of: electronically-functional glasses, goggles, contact lenses, visor, or other eyewear; camera in glasses, goggles, contact lenses, visor, or other eyewear; augmented reality (AR) glasses, goggles, contact lenses, visor, or other eyewear; virtual reality (VR) glasses, goggles, contact lenses, visor, or other eyewear; headphones, headset, ear buds, ear phones, hearing aid, or light loops; hair band, clip, or pin; hat, cap, or headband; ear ring, nose ring, tongue ring; and dental appliance, dental insert, or palatal vault attachment.

In an example, a wearable device for disrupting unwelcome photography can be worn on the wrist or hand as one or more of the following wearable items: smart bracelet, fitness bracelet, bracelet phone, or charm bracelet; smart watch, fitness watch, watch phone, or watch cam; and smart ring, ring phone, or ring cam. In an example, a wearable device for disrupting unwelcome photography can be embodied in a wearable member selected from the group consisting of: smart bracelet, fitness bracelet, bracelet phone, or charm bracelet; smart watch, fitness watch, watch phone, or watch cam; and smart ring, ring phone, or ring cam.

In various examples, a wearable device for disrupting unwelcome photography can be worn in a manner similar to a wearable or hand-held member selected from the group consisting of: necklace, neck chain, dog tags, pendant, or medallion; necklace cam or phone; smart phone, mobile phone, or cell phone; clip, button, brooch, pin, tie clip, or tie tack; electronically-functional adhesive patch or skin patch; and briefcase, suitcase, or purse. In various examples, a wearable device for disrupting unwelcome photography can be integrated into one or more wearable or hand-held members selected from the group consisting of: necklace, neck chain, dog tags, pendant, or medallion; necklace cam or phone; smart phone, mobile phone, or cell phone; clip, button, brooch, pin, tie clip, or tie tack; electronically-functional adhesive patch or skin patch; and briefcase, suitcase, or purse.

In an example, a wearable device for disrupting unwelcome photography can be embodied in an article of clothing, garment, or other body-covering member. In an example, an article of clothing, garment, or other body-covering member can act as an inbound light guide for a wearable device for disrupting unwelcome photography. In an example, an article of clothing with embedded optical elements can provide a relatively-large surface area for harvesting light from one or more ambient light sources which can then be directed toward a proximal imaging device.

In an example, multiple optical fibers can span an article of clothing and harvest light from ambient light sources. In an example, an article of clothing, garment, or other body-covering member can be made with light-guiding fibers, tubes, or conduits which collect and guide light into a central location for redirection toward a proximal imaging device. In an example, an article of clothing, garment, or other body-covering member can include multiple microscale lenses which collect light for redirection toward a proximal imaging device. In an example, an article of clothing, garment, or other body-covering member can comprise metamaterial light guides which harvest and guide light rays toward a proximal imaging device.

In an example, an article of clothing, garment, or other body-covering member can act as an outbound light guide for a wearable device for disrupting unwelcome photography. In an example, a wearable device for disrupting unwelcome photography can comprise a light-emitting article of clothing, garment, or other body-covering member. In an example, multiple optical fibers in an article of clothing can emit light and their combined light emissions can be directed toward a proximal imaging device. In an example, a portion of an article of clothing, garment, or other body-covering member with light-emitting members can be permanently or temporarily configured in a parabolic shape so as to direct a relatively-collimated beam of light toward a proximal imaging device. In an example, an article of clothing, garment, or other body-covering member can comprise metamaterial light guides which direct light from an ambient light source, a wearable light source, or both an ambient light source and a wearable light source toward a proximal imaging device. In an example, an article of clothing, garment, or other body-covering member can comprise multiple reflective elements which combine to reflect, refract, or guide a beam of light toward a proximal imaging device.

In an example, a wearable device for disrupting unwelcome photography can be attached to an article of clothing by an attachment mechanism selected from the group consisting of: adhesive, band, buckle, button, clip, elastic band, frictional clamping or clasping, hook and eye, magnet, pin, pocket, pouch, sewing, strap, tensile member, and zipper. In an example, a wearable device for disrupting unwelcome photography can be attached to a person's body by an attachment mechanism selected from the group consisting of: adhesive, band, bracelet, buckle, chain, clip, elastic band, frictional clamping or clasping, necklace, ring, strap, suture, tape, and tensile member. In an example, a wearable device for disrupting unwelcome photography can be attached to a wearable accessory item by an attachment mechanism selected from the group consisting of: adhesive, band, buckle, button, clip, elastic band, frictional clamping or clasping, hook and eye, magnet, pin, pocket, pouch, sewing, strap, tensile member, and zipper.

In an example, a wearable device for disrupting unwelcome photography can be worn on, hooked around, attached to, and/or inserted into a person's ears. In an example, a person can wear "light loops," which include an inbound light guide and an outbound light guide, on one or both ears in order to harvest ambient light and direct light toward a proximal imaging device. In an example, "light loops" can include an internal light source and an outbound light guide in order to direct light toward a proximal imaging device. In an example, "light loops" can include a light sensor and data processor which evaluate the level of ambient light and determine whether to direct light from an ambient light source, light from an internal light source, or both light sources toward a proximal imaging device to disrupt unwelcome photography by that device.

In an example, a pair of "light loops" can direct two different beams of light toward a proximal imaging device such that the two beams intersect at the location of a proximal imaging device. In an example, the intersection of these two beams of light can interact in a synergistic manner to disrupt photography. In an example, these two light beams can have different polarization orientations, collimation orientations, wavelengths, or pulsation patterns which interact in a synergistic manner to disrupt photography.

In an example, an outbound light guide incorporated into a "light loop" can be moved directly and manually by movement of the person's head. In an example, the person can aim the outbound light guide so as to direct a beam of light toward a proximal imaging device. In an example, an outbound light guide incorporated into a "light loop" can be moved remotely by wireless communication with a hand-held device which the wearer can adjust via touch screen. In an example, a "light loop" can be in wireless communication with a smart phone, mobile phone, or electronic tablet. In an example, an outbound light guide on a "light loop" can be moved by recognizing voice commands by the person wearing the "light loop." In an example, an outbound light guide incorporated into a "light loop" can be moved automatically in response to the changing location of a proximal imaging device which is tracked by the "light loop."

In an example, a wearable device for disrupting unwelcome photography can comprise, or be incorporated into, privacy-enhancing glasses, contact lenses, goggles, or other eyewear that is worn by a person whose privacy is to be protected from unwelcome photography. In an example, a wearable device can be selected from the group consisting of: smart glasses, visor, or other eyewear; electronically-functional glasses, visor, or other eyewear; augmented reality glasses, visor, or other eyewear; virtual reality glasses, visor, or other eyewear; electronically-functional contact lens, helmet, monocle, and face mask. In an example, one or more inbound light guides and/or outbound light guides can be incorporated into the frames of privacy-enhancing eyewear. In an example, having one or more outbound light guides located near the face of a person whose privacy is to be protected can be particularly effective for disrupting facial recognition and imaging in unwelcome photography.

In an example, privacy-enhancing eyewear can include an inbound light guide and an outbound light guide in order to harvest ambient light and direct light toward a proximal imaging device. In an example, privacy-enhancing eyewear can include an internal light source and an outbound light guide in order to direct light toward a proximal imaging device. In an example, privacy-enhancing eyewear can include a light sensor and a data processor which evaluate the level of ambient light and determine whether to direct light from an ambient light source, from an internal light source, or from both light sources toward a proximal imaging device to disrupt unwelcome photography.

In an example, privacy-enhancing eyewear can direct two different beams of light toward a proximal imaging device such that the two beams intersect at the location of a proximal imaging device. In an example, the intersection of these two beams of light can interact in a synergistic manner to disrupt photography. In an example, these two light beams can have different polarization orientations, collimation orientations, wavelengths, or pulsation patterns which interact in a synergistic manner to disrupt photography.

In an example, an outbound light guide incorporated into privacy-enhancing glasses, contact lenses, goggles, or other eyewear can be moved directly and manually by movement of a person's head. In an example, a person can directly aim an outbound light guide by moving their head so as to direct a beam of light toward a proximal imaging device.

In an example, an outbound light guide incorporated into privacy-enhancing eyewear can be moved remotely by wireless communication with a hand-held device which the wearer can adjust via touch screen. In an example, privacy-enhancing eyewear can be in wireless communication with a smart phone, mobile phone, or electronic tablet. In an example, an outbound light guide on privacy-enhancing eyewear can be moved by recognizing voice commands by the person wearing the privacy-enhancing eyewear. In an example, an outbound light guide incorporated into privacy-enhancing eyewear can be moved automatically in response to the changing location of a proximal imaging device which is tracked by the privacy-enhancing eyewear.

In an example, a wearable device for disrupting unwelcome photography can be incorporated into augmented reality eyewear and/or electronically-functional eyewear. In an example, the augmented reality functionality of such eyewear can be used to help identify and track an ambient light source from which light is harvested to disrupt unwelcome photography. In an example, such eyewear can identify the type of ambient light source. In an example, augmented reality eyewear can identify a potential ambient light source and input from the wearer can confirm use of this ambient light source for disrupting photography. In an example, input from the wearer can be selected from actions in the group consisting of: voice command, touching the device, touching a remote control for the device, direction of eye gaze, eye wink, head movement, and hand gesture.

In an example, a person who wears augmented reality eyewear and/or electronically-functional eyewear can use this eyewear to target the location or one or more proximal imaging devices. In an example, this targeting function can direct a focused beam of radiant energy toward a proximal imaging device to block or otherwise disrupt unwelcome photography by the proximal imaging device. In an example, an augmented reality system can "lock onto" retroreflection from a proximal imaging device when the imaging device moves. In an example, macroscale targeting of a proximal imaging device can be done by the person whose privacy is being protected by moving their head, changing the gaze of their eyes, or pointing with their hand. In an example, microscale targeting of a proximal imaging device can be done automatically by a tracking mechanism. This tracking mechanism can be based on a combination of one or more of the following: reflection pattern recognition, electromagnetic signal recognition, radio signal recognition, object pattern recognition, movement pattern recognition, human proximity and motion recognition, gesture recognition, and occlusion of a human eye by the device.

In an example, the inbound light guide and/or outbound light guide of a wearable device for disrupting unwelcome photography can have a human-computer interface that includes human identification of the relative location of a proximal imaging device expressed in clockface or polar coordinates. In an example, the wearer of a photography-disrupting device can see a proximal imaging device and give the voice command "Camera at 3 o'clock" or "Camera at 90 degrees." In response to this voice command, a wearable device for disrupting unwelcome photography can direct a beam of light toward this polar coordinate. In response, a wearable device for disrupting a proximal imaging device can search the area around this polar coordinate to detect a proximal imaging device and then direct a beam of light toward a proximal imaging device when one is detected.

In an example, a human-computer interface can be based on eye gaze, eye wink, head movement or orientation, hand gesture recognition, EMG patterns, EEG patterns, OMG patterns, or touch screen contact. In an example, the process of detecting, targeting, and disrupting a proximal imaging device can be an iterative and interactive process between a human and a computer.

In an example, a wearable device for disrupting unwelcome photography can comprise, or be incorporated into, a privacy-enhancing watch, wrist band, bracelet, or other wrist-worn device that is worn by a person whose privacy is to be protected from unwelcome photography. In an example, a privacy-enhancing wrist-worn device can include an inbound light guide and an outbound light guide in order to harvest ambient light and direct light toward a proximal imaging device. In an example, a privacy-enhancing wrist-worn device can include an internal light source and an outbound light guide in order to direct light toward a proximal imaging device. In an example, a privacy-enhancing wrist-worn device can include a light sensor and a data processor which evaluate the level of ambient light and determine whether to direct light from an ambient light source, light from an internal light source, or both light sources toward a proximal imaging device to disrupt unwelcome photography by that device.

In an example, a privacy-enhancing wrist-worn device, or two such devices worn on different wrists, can direct two different beams of light toward a proximal imaging device such that the two beams intersect at the location of a proximal imaging device. In an example, the intersection of these two beams of light can interact in a synergistic manner to disrupt photography. In an example, these two light beams can have different polarization orientations, collimation orientations, wavelengths, or pulsation patterns which interact in a synergistic manner to disrupt photography.

In an example, an outbound light guide incorporated into a privacy-enhancing watch, wrist band, bracelet, or other wrist-worn device can be moved directly and manually by movement of the person's arm or wrist. In an example, the person can directly aim the outbound light guide by moving their arm or wrist so as to direct a beam of light toward a proximal imaging device. In an example, an outbound light guide incorporated into a privacy-enhancing wrist-worn device can be moved remotely by wireless communication with a hand-held device which the wearer can adjust via touch screen.

In an example, a privacy-enhancing wrist-worn device can be in wireless communication with a smart phone, mobile phone, or electronic tablet. In an example, an outbound light guide on a privacy-enhancing wrist-worn device can be moved by recognizing voice commands by the person wearing the privacy-enhancing wrist-worn device. In an example, an outbound light guide incorporated into a privacy-enhancing wrist-worn device can be moved automatically in response to the changing location of a proximal imaging device which is tracked by the privacy-enhancing wrist-worn device.

In an example, a wearable device for disrupting unwelcome photography can be embodied in an article of clothing. In an example, such an article of clothing can have optically-functional fabric or ornamentation. In an example, an article of clothing can comprise optical elements in its threads, fibers, strands, weave, and/or ornamentation. In an example, optically-functional fabric can include one or more optical elements selected from the group consisting of: LEDs, LED array, or other wearable light sources. In an example, a wearable device for disrupting unwelcome photography can comprise a body-mounted lighting system. In an example, a person wearing such an article of clothing can direct light beams toward a proximal imaging device by pointing with their finger and/or arm, by the direction of their eye gaze, by head movement, and/or by verbal commands.

In an example, an article of clothing to disrupt unwelcome photography can comprise one or more optical elements selected from the group consisting of: acrylic mirrors, dielectric mirror, Digital Micromirror Device (DMD), MEMS-based mirror array, other mirror array, parabolic mirror, or other type of mirror; reflective surface, retroreflective structure, reflector array, parabolic reflector, concentric reflective surfaces, or aluminum vapor coated film; one or more simple lenses, asymmetric lens, wedge-shaped lens, compound lens, fly's eye lens, Fresnel lens, parabolic lens, concentric lenses, microlens array, microspheres, liquid lenses, and optoelectronic lenses; crystalline structures, crystal array, photonic crystals, cylindrical prisms, rectangular prisms, rhomboid prisms, and wedge prisms; fiber optics, optical fibers, light-guiding tubes, composite polymer fiber, electrically-conductive threads or yarns, and optoelectronic fabric; and birefringent materials, microscale glass beads, microspheres, nanotubes, nanorods, photonic metamaterials, metamaterial light channels, Split Ring Resonators (SRRs), and light-guiding metamaterial structures.

In an example, a wearable device for disrupting unwelcome photography can comprise, or be incorporated into, a privacy-enhancing hat, cap, or headband. In an example, a hat-like device can harvest, reflect, refract, direct, or transduce sunlight or artificial ambient light toward one or more proximal imaging devices to disrupt unwelcome photography. In an example, a hat to disrupt unwelcome photography can also have an internal wearable light source to supplement harvested ambient light if harvested ambient light is insufficient to disrupt unwelcome photography.

In an example, a privacy-enhancing hat can include both an inbound light guide to harvest ambient light and an outbound light guide to direct light toward a proximal imaging device. In an example, a privacy-enhancing hat can include an internal light source and an outbound light guide in order to direct light toward a proximal imaging device. In an example, a privacy-enhancing hat can include a light sensor and a data processor which evaluate the level of ambient light and determine whether to direct light from an ambient light source, light from an internal light source, or light from both light sources toward a proximal imaging device to disrupt unwelcome photography by that device. In an example, a privacy-enhancing hat can be made out of aluminum foil and provide the added benefit of blocking mind-reading by aliens. (Joke: just wanting to see if anyone reads this far!)

In an example, an outbound light guide incorporated into a privacy-enhancing hat, cap, or headband can be moved directly and manually by movement of the wearer's head. In an example, the person wearing the hat can directly aim the outbound light guide by moving their head so as to direct a beam of light toward a proximal imaging device. In an example, an outbound light guide incorporated into a privacy-enhancing hat can be moved remotely by wireless communication with a hand-held device which the wearer can adjust via touch screen. In an example, a privacy-enhancing hat can be in wireless communication with a smart phone, mobile phone, or electronic tablet. In an example, an outbound light guide on a privacy-enhancing hat can be moved by recognizing voice commands by the person wearing the hat. In an example, an outbound light guide incorporated into a privacy-enhancing hat can be moved automatically in response to the changing location of a proximal imaging device which is tracked by the privacy-enhancing hat.

In an example, an array of inbound light guides can encircle the upper portion of a hat to harvest ambient light from multiple directions. In an example, a hat to disrupt unwelcome photography can have multiple optical fibers or other light conduits to harvest ambient light energy from multiple directions and merge this light energy into a single beam that is directed toward a proximal imaging device. In an example, a hat can have a single outbound light guide which directs a beam of light in one direction toward a proximal imaging device. In an example, a hat can have an array of outbound light guides which direct beams of light along different vectors to disrupt photography from any proximal imaging devices which may be located along those vectors. In an example, a hat can emit a rotating beam of light (in a manner like a light house) to disrupt possible imaging devices from multiple angles.

In an example, a hat to disrupt unwelcome photography can harvest ambient light energy using one or more inbound light guides on its upper surface and can direct harvested light energy toward one or more proximal imaging devices using one or more outbound light guides on its brim and/or lower surface. In an example, a hat to disrupt unwelcome photography can harvest ambient light rays along vectors that are between vertical and horizontal in orientation and can direct these light rays outwards along vectors that are generally horizontal. In an example, this rotating beam of light can be focused in a plane which is most likely to include proximal imaging devices. In an example, this plane can be generally between 3-6 feet from the ground to disrupt head-worn or hand-held proximal imaging devices.

In an example, a beam of light can be directed toward a single location when a proximal imaging device is detected at that location or a beam of light can be rotated in a light-house manner if a proximal imaging device has not yet been detected. In an example, a beam of light can be emitted in a radially-rotating manner (like a light-house beam) until its reflection indicates the presence of a proximal imaging device at a given vector and then its rotation can be stopped so that it continually aims along this vector.

In an example, a hat to disrupt unwelcome photography can include an array of light guides. In an example, a hat to disrupt unwelcome photography can include a radial or hemispherical array of light guides around its circumference or upper portion. In an example, an array of light guides on a hat can include optical fibers, optical tunnels, prisms, lenses, mirrors, light tubes, and/or metamaterial structures.

In an example, a radial or hemispherical array of light guides can function as inbound light guides to harvest ambient light from ambient light sources located at multiple orientations. In an example, a radial or hemispherical array of inbound light guides can harvest ambient light from a variety of angles so that light from a moving ambient light source can be harvested without the need for inbound light guides to move in response to movement of the ambient light source, movement of the person wearing the hat, or both such movements. In an example, a radial or hemispherical array of light guides can function as outbound light guides to direct beams of light at proximal imaging devices located at multiple orientations.

In an example, an array of light guides can function as either inbound or outbound lights guides at different times, such as in an alternating sequence of harvesting inbound light and directing outbound light. In an example, a hat to disrupt unwelcome photography can combine light energy harvested from one or more ambient light sources with light energy from one or more wearable light sources in order to create a light beam that is sufficient to disrupt photography by a proximal imaging device.

In an example, a hat to disrupt unwelcome photography can harvest and redirect light from one or more ambient light sources if this light is sufficient to disrupt unwelcome photography, but this hat can also have one or more internal wearable light sources which can be used in environments with low or diffuse ambient light. In an example, a hat to disrupt unwelcome photography can have a ring of wearable lights, such as LEDs, around its circumference. In an example, a hat can send out a beam of light along a changing vector, wherein the polar coordinate of this vector with respect to the center of the hat changes over time. In an example, a hat can send out a beam of light along a changing vector, wherein the longitudinal and/or latitudinal coordinates of this vector with respect to the center of the hat change over time. In an example, sending out a beam of light with a changing vector can result in flashes or pulses of light which disrupt imaging by one or more proximal imaging devices. In an example, the rotational speed of a changing light-ray vector can be sufficiently rapid and the flash duration can be sufficiently short that the flashes disrupt imaging by a proximal imaging device without substantive detection by a human eye.

In an example, a hat to disrupt unwelcome photography can emit visible light. In an example, a hat can emit infrared or near-infrared light. In an example, a hat can emit non-collimated light. In an example, a hat can emit collimated light. In an example, a hat can emit a low-power laser beam that can disrupt photography without being harmful if it contacts a human eye. In an example, a hat can emit brief flashes of light that disrupt photography but are not detected by a human eye.

In an example, a hat can have multiple stationary outbound light guides whose ends are distributed around the circumference of the hat and flash in a radially-rotating manner. In an example, a hat can have a single moving outbound light guide which rotates and thus flashes light beams around the hat in a radially-rotating manner. In an example, a hat can have a spinning Fresnel lens which directs a beam of light outwards from the hat in a radially-rotating manner. In an example, a hat can have a spinning parabolic mirror which directs a beam of light outwards from the hat in a radially-rotating manner.

5. Detecting and Tracking Ambient Light Sources and Proximal Imaging Devices

In an example, a wearable device for disrupting unwelcome photography can include: a tracking mechanism to track an ambient light source to better harvest light energy from that light source; and a tracking mechanism to track a proximal imaging device to better direct light energy toward that imaging device. In an example, one or both of these tracking mechanisms can be completely automated, not requiring any voluntary actions on the part of the person wearing the device for disrupting unwelcome photography. In an example, a Kalman filter can be used to track movement of an ambient light source and/or proximal imaging device. In an example, one or both of these tracking mechanisms can be completely manual, requiring voluntary actions on the part of the person wearing the device for disrupting unwelcome photography. In an example, one or both of these tracking mechanisms can include human-computer interaction comprising a combination of voluntary actions and automatic mechanisms.

In an example, actions by a person wearing a photography-disrupting device that are required for tracking an ambient light source and/or proximal imaging device can be selected from the group consisting of: detecting an ambient light source, manually orienting an inbound light guide so as to harvest light energy from this ambient light source, manually moving an inbound light guide so as to track a moving ambient light source, manually moving an inbound light guide so as to track a stationary ambient light source as the person moves, evaluating whether light energy harvested from an ambient light source is sufficient to disrupt photography by a proximal imaging device, turning on a wearable light source if light from an ambient light source is insufficient to disrupt photography by a proximal imaging device, detecting a proximal imaging device, manually orienting an outbound light guide so as to direct a beam of light toward the proximal imaging device, manually moving an outbound light guide so as to track a moving proximal imaging device, and manually moving an outbound light guide so as to track a stationary proximal imaging device as the person moves.

In an example, actions by a person wearing a photography-disrupting device that are required for tracking an ambient light source and/or proximal imaging device can be selected from the group consisting of: entering information on a keypad and/or pressing buttons; eye movement and/or eye gaze direction; hand motions and/or entering information via a gesture recognition interface; body motion and/or entering information via a holographic interface; head movement and/or head orientation; motion sensor interface; speaking a voice command and/or entering information via a speech recognition interface; touching a touch screen and/or entering information via a touch-based electronic interface; EMG interface, EEG interface, neural monitoring interface and/or entering information via electromagnetic signals from the person's body.

In an example, a person can manually aim a head-worn inbound light guide at an ambient light source by moving their head. In an example, a visual display or audio signal can let the person know how much ambient light is being harvested by a wearable device based on a given head orientation. In an example, the person can be guided by changes in such a visual display or audio signal in order to adjust the orientation of their head to increase harvested ambient light. In an example, the person can "lock in" inbound light guide orientation when a sufficient amount of ambient light energy is harvested and can stop further movement of the light guide with movement of their head.

In an example, a person can manually aim a head-worn outbound light guide at a proximal imaging device by moving their head. In an example, a visual display or audio signal can let the person know how accurately light is being directed toward the proximal imaging device based on a given head orientation. In an example, the person can be guided by changes in such a visual display or audio signal in order to adjust the orientation of their head to more accurately direct a beam of light toward a proximal imaging device. In an example, the person can "lock in" outbound light guide orientation when retroreflection indicates precise targeting of a proximal imaging device by a beam of light and stop movement of the light guide with movement of their head.

In an example, a person can manually aim an eyewear-based inbound light guide at an ambient light source by moving their eyes and/or changing their gaze. In an example, a visual display or audio signal can let the person know how much ambient light is being harvested by a wearable device based on a given eye orientation and/or gaze. In an example, the person can be guided by changes in such a visual display or audio signal in order to adjust the orientation of their eyes and/or gaze to increase harvested ambient light. In an example, the person can "lock in" inbound light guide orientation when a sufficient amount of ambient light energy is harvested and can stop further movement of the light guide with movement of their eyes and/or gaze.

In an example, a person can manually aim an eyewear-based outbound light guide at a proximal imaging device by moving their eyes and/or changing their gaze. In an example, a visual display or audio signal can let the person know how accurately light is being directed toward the proximal imaging device based on a given eye movement and/or gaze orientation. In an example, the person can be guided by changes in such a visual display or audio signal in order to adjust the orientation of their eyes and/or gaze to more accurately direct a beam of light toward a proximal imaging device. In an example, the person can "lock in" outbound light guide orientation when retroreflection indicates precise targeting of a proximal imaging device by a beam of light and stop movement of the light guide with movement of their eyes and/or gaze.

In an example, a person can manually aim a wrist-worn inbound light guide at an ambient light source by moving their wrist. In an example, a visual display or audio signal can let the person know how much ambient light is being harvested by a wearable device based on a given wrist orientation. In an example, the person can be guided by changes in such a visual display or audio signal in order to adjust the orientation of their wrist to increase harvested ambient light. In an example, the person can "lock in" inbound light guide orientation when a sufficient amount of ambient light energy is harvested and can stop further movement of the light guide with movement of their wrist.

In an example, a person can manually aim a wrist-worn outbound light guide at a proximal imaging device by moving their wrist. In an example, a visual display or audio signal can let the person know how accurately a beam of light is being directed toward a proximal imaging device based on a given wrist orientation. In an example, the person can be guided by changes in such a visual display or audio signal in order to adjust the orientation of their wrist to more accurately aim light toward the imaging device. In an example, the person can "lock in" outbound light guide orientation when retroreflection indicates precise targeting of a proximal imaging device by a beam of light and stop movement of the light guide with movement of their wrist.

In an example, a person can manually aim an inbound light guide at an ambient light source by a hand gesture that is detected by a gesture recognition interface. In an example, a visual display or audio signal can let the person know how much ambient light is being harvested by a wearable device based on a given hand gesture. In an example, the person can be guided by changes in such a visual display or audio signal in order to adjust the orientation of their hand gesture when a sufficient amount of ambient light energy is harvested and can stop further movement of the light guide with movement of their hand.

In an example, a person can manually aim an outbound light guide at a proximal imaging device by a hand gesture that is detected by a gesture recognition interface. In an example, a visual display or audio signal can let the person know how accurately a beam of light is being directed toward a proximal imaging device based on a given hand gesture. In an example, the person can be guided by changes in such a visual display or audio signal in order to adjust the orientation of their hand gesture to more accurately aim light toward the imaging device. In an example, the person can "lock in" outbound light guide orientation when retroreflection indicates precise targeting of a proximal imaging device by a beam of light and stop movement of the light guide with movement of their hand.

In an example, a wearable device for disrupting unwelcome photography can automatically scan for any proximal imaging devices in the local environment of the person wearing the photography-disrupting device. In a broad example, a wearable device for disrupting unwelcome photography can notify the person when a proximal imaging device is detected in the local environment. In a narrower example, a wearable device for disrupting unwelcome photography can only notify the person when a proximal imaging device is actually in operation and taking pictures in the local environment. In an even narrower example, a wearable device for disrupting unwelcome photography can only notify the person when a proximal imaging device is actively taking pictures and focused directly towards the person wearing the photography-disrupting device.

In an example, a wearable device for disrupting unwelcome photography can automatically detect the general presence of a proximal imaging device in the environment, but can rely on the person wearing it to manually track the exact location of the imaging device. In an example, general detection of a proximal imaging device somewhere in the local environment can be automated, but the precise locating and tracking of the imaging device can require manual action. This combination of automated and manual mechanisms can take advantage of human skill in tracking a moving object.

In a counter example, general detection of a proximal imaging device can be done manually by a person wearing a photography-disrupting device and specific tracking of the imaging device can be done automatically. In an example, a person can orient their head, eyes, or hand gesture toward a proximal device until the automated tracking system "locks on" to the device and then automated tracking can take over. In an example, automated tracking can be informed by movement of the person based on the results of a wearable motion sensor (such as a 3-axis accelerometer). This can make automated tracking easier in the case of a relatively-stationary proximal imaging device. This combination of manual and automated mechanisms can take advantage of human skill in pattern recognition and can conserve energy by not requiring extensive continuous scanning of the local environment.

In an example, a wearable device for disrupting unwelcome photography can continually track one or more ambient light sources so that the device can quickly harvest light from one or more of the sources if a proximal imaging device is detected. In an example, a wearable device can track multiple ambient light sources when there is variation or movement in ambient light sources over time to identify the best ambient light source at any given time and to be prepared to switch ambient light sources if a source moves unexpectedly or drops in intensity.

In a more energy-conserving approach, a wearable device for disrupting unwelcome photography may not continually track ambient light sources, but may only identify and evaluate an ambient light source for harvesting light when a proximal imaging device is actually detected in the local environment. In an even more energy-conserving approach, a wearable device for disrupting unwelcome photography may not continually track ambient light sources, but may only identify and evaluate an ambient light source for harvesting light when a proximal imaging device is being actively used use to take pictures in the local environment.

In an example, an automated mechanism to track the movement of an ambient light source or proximal imaging device relative to a person wearing a photography-disrupting device can be informed by physical laws concerning the movements of real objects. In an example, an automated mechanism to track the movement of the sun relative to a person wearing a photography-disrupting device can be informed by movement of the person based on the assumption that the sun is relatively stationary in the short-run. In an example, a Fourier transform can be used to control for the effects of repetitive movements (such as walking or running) by the person wearing a device as the device tracks changes in the relative positions of an ambient light source and/or a proximal imaging device.

In an example, an automated mechanism to track the movement of a hand-held or wearable imaging device relative to a person wearing a photography-disrupting device can be informed by kinesthetic and/or anatomic laws concerning movement of the person holding or wearing the imaging device, movement of the person wearing the photography-disrupting device, or both such movements. In an example, an automated mechanism to track the movement of a hand-held or wearable imaging device relative to a person wearing a photography-disrupting device can be informed by data from a wearable accelerometer, gyroscope, inclinometer, and/or GPS device. In an example, a Fourier transform can be used to control for the effects of repetitive movements (such as walking or running) by the person wearing a device as the device tracks changes in the relative positions of an ambient light source and/or a proximal imaging device.

In an example, the orientation, configuration, size, shape, or surface area of an inbound light guide can be adjusted to more efficiently harvest light from one or more ambient light sources. In an example, an inbound light guide can comprise an optical member or array with an adjustable focus distance. In an example, an inbound light guide can comprise an optical member or array with an adjustable parabolic shape. In an example, an inbound light guide can comprise an optical member or array with a spinning or rotating reflective surface. In an example, the relative positions of a plurality of reflecting or refracting members of an inbound light guide can be adjusted to more efficiently collect radiant energy from a moving ambient light source. In an example, one or more light guides can be moved by a mechanism selected from the group consisting of: electric motor, piezoelectric actuator, Micro Electro Mechanical Systems (MEMS), and micro motor.

In an example, automatic identification of a proximal imaging device can be a multivariate function of a plurality of factors selected from the group consisting of: emission of a flash or continuous light for photography enhancement in dim light conditions; emission of radiant energy from a proximal imaging device for auto-focusing or optical detection purposes; face recognition and attendant device obscuring one or both eyes; pattern recognition of the shape, color, texture, text, and/or logo of particular type of imaging device; recognition of hand gestures indicating picture taking with a proximal imaging device; recognition of voice commands indicating picture taking with a proximal imaging device; reflection of radiant energy bouncing off an interior or exterior surface of the proximal imaging device; shutter or clicking sound indicating active photography; and signature electromagnetic or radio frequency emissions.

6. Disruption of Photography by Other Forms of Radiant Energy

In an example, a wearable device for disrupting unwelcome photography can use radiant energy other than light to disrupt the operation of a proximal imaging device. However, in many places there are legal constraints on transmitting alternative forms of radiant energy. Human safety must also be ensured. In an example, to the extent allowed by law, a wearable device can transmit patterns of electromagnetic (EM) energy to disrupt photography by a proximal imaging device. In an example, emission of electromagnetic (EM) energy can cause a proximal imaging device to stop taking pictures and/or can block wireless transmission of pictures.

In an example, an electromagnetic (EM) energy source for disrupting unwelcome photography can be selected from the group consisting of: a radio frequency (RF) energy source and/or radio transmitter, an Ultra High Frequency (UHF) EM energy source or transmitter, a Very High Frequency (VHF) EM energy source or transmitter, a low-frequency EM energy source or transmitter or transmitter, a medium frequency EM energy source or transmitter, and a high-frequency EM energy source or transmitter. In an example, if feasible to implement in a safe manner, a source of radiant energy for disrupting unwelcome photography can be selected from the group consisting of: a sonic energy and/or acoustic energy source, an ultrasonic energy source, and a thermal energy source.

7. Components of a Wearable Device for Disrupting Unwelcome Photography

In various examples, a wearable device for disrupting unwelcome photography can comprise multiple components selected from the group consisting of: ambient light source tracker, Digital Micromirror Device (DMD), energy-harvesting mechanism, inbound light guide, inbound light guide controller, inbound light guide mover, lens or lens array, metamaterial structure, mirror or mirror array, one-way mirror, outbound light guide, outbound light guide controller, outbound light guide mover, proximal imaging device tracker; accelerometer, ambient light sensor, ambient light source detector, camera, compass, GPS unit, harvested light sensor, infrared light sensor, light sensor, microphone, motion sensor, photovoltaic cell, proximal imaging device detector, retroreflected light sensor, wavelength sensor; infrared light emitter, laser light emitter, Light Emitting Diode (LED), Liquid Crystal Display (LCD), photography-disrupting beam emitter, wearable light source; gesture recognition interface, keypad, pattern recognition mechanism, shutter button, speaker, speech recognition interface, touch screen, voice recognition interface; battery, solar cell, wearable power source; Central Processing Unit (CPU), data communication unit, data processor or data processing unit, integrated circuit, memory, Random Access Memory (RAM), Read Only Memory (ROM); radio frequency (RF) or other electromagnetic (EM) signal receiver, radio frequency (RF) or other electromagnetic (EM) signal transmitter, wireless communication unit, wireless communicator, wireless data receiver, wireless data transmitter; clothing accessory, cooling mechanism, eyewear, garment, wearable housing, and wrist-worn device.

In an example, a wearable device for disrupting unwelcome photography can include an autonomous human-computer interface selected from the group consisting of: voice command or voice recognition interface; gesture command or gesture recognition interface; touch screen; keypad or buttons; EMG sensor; EEG sensor; neural interface; and holographic interface. In an example, a wearable device for disrupting unwelcome photography can be in wireless communication with a separate and/or remote device, wherein this separate and/or remote device includes a human-computer interface selected from the group consisting of: voice command or voice recognition interface; gesture command or gesture recognition interface; touch screen; keypad or buttons; EMG sensor; EEG sensor; neural interface; and holographic interface.

In an example, a wearable device for disrupting unwelcome photography can include a wearable data processor that performs most or all of the data processing functions required to detect and track an ambient light source, track a proximal imaging device, and direct radiant energy toward the imaging device to disrupt photography. In an example, a wearable device for disrupting unwelcome photography can include a wireless communication unit that is in wireless communication with a remote data processor which performs these data processing functions. In an example, a wearable device for disrupting unwelcome photography can include a communication unit that is in communication with a remote data processor via the internet. In an example, a wearable device for disrupting unwelcome photography can be part of a system that comprises an application for a mobile communication device or electronic tablet device.

In an example, a data processor can control the operation of one or more components of a wearable device to disrupt unwelcome photography, wherein these components are selected from the group consisting of: a wearable light source; a mechanism to track one or more ambient light sources; an inbound light guide that harvests light energy from one or more ambient light sources; a mechanism that moves this inbound light guide to more efficiently collect light energy from these light sources; a mechanism to track one or more proximal imaging devices near the person; an outbound light guide that directs light from the ambient light source, the wearable light source, or both toward one or more imaging devices in order to unwelcome disrupt photography; a mechanism that moves this outbound light guide to more accurately target the one or more proximal imaging devices; and an ambient light sensor and/or harvested light sensor whose results are used to adjust the use and/or mix of light from the ambient light source and the wearable light source to disrupt photography by one or more proximal imaging devices.

In various examples, a wearable device for disrupting unwelcome photography can be made from one or more types of materials selected from the group consisting of: birefringent material, concentric rings, gold, copper, dielectric mirror or other dielectric material, diffraction grating, glass beads or other glass structures, material with negative permittivity and/or a negative refractive index, metamaterial, nanotubes, nanofibers, optical fiber, photonic crystals or other crystals, polymer, prisms, silicon, and split-ring resonators.

8. Detailed Description of FIGS. 1 Through 24

FIGS. 1 through 24 show examples of how this invention can be embodied in a wearable device for disrupting unwelcome photography. However, these examples do not limit the full generalizability of the claims.

Figure 2:
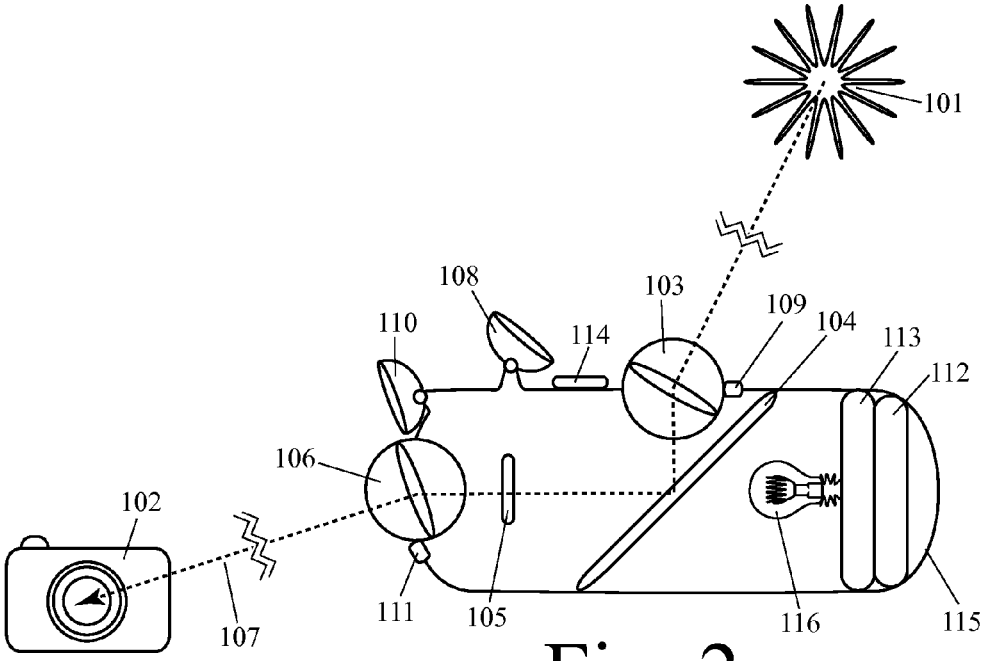

FIGS. 1 and 2 show two sequential, cross-sectional views of one example of how this invention can be embodied in a wearable device for disrupting unwelcome photography. In this example, a wearable device is shown harvesting light energy from an ambient light source 101 and redirecting this light energy toward a proximal imaging device 102 in order to disrupt unwelcome photography by the proximal imaging device. In this example, ambient light source 101 is the sun and proximal imaging device 102 is a camera. As shown in later figures, such a wearable device can be incorporated into a wearable article such as eyewear, earwear, a necklace, or a hat. Such a device can be worn by a person whose privacy is to be protected from unwelcome photography.

In the example shown in FIGS. 1 and 2, the ambient light source 101 from which light energy is harvested is the sun. In another example, the ambient light source can be a different natural light source or an artificial light source. In an example, a wearable device for disrupting unwelcome photography can monitor one or more ambient light sources to determine whether they can provide sufficient light energy to disrupt unwelcome photography when light from them is directed toward a proximal imaging device.

In an example, a qualified ambient light source is an ambient light source that can provide sufficient harvested light energy to disrupt unwelcome photography by a proximal imaging device. In an example, a qualified ambient light source can be an ambient light source that exceeds a selected absolute level of local luminosity. In an example, a qualified ambient light source can be an ambient light source with local luminosity that exceeds overall ambient luminosity by a selected amount or percent. If a qualified ambient light source is not detected, or if insufficient ambient light is harvested (as measured by a harvested light sensor), then a wearable light source can be used instead of an ambient light source or to supplement an ambient light source.

In the example shown in FIGS. 1 and 2, proximal imaging device 101 is a camera. In an example, a proximal imaging device can be defined with respect to a selected person as a device which: is capable of recording images and/or taking pictures; has a direct line-of-sight to the selected person; and is within a sufficiently short distance from the selected person to record identifiable images and/or take identifiable pictures of that person.

In an example, a proximal imaging device can be a camera or other device whose primary or sole function is to record images and/or take pictures. In an example, a proximal imaging device can be a mobile communication or data processing device whose ancillary functions include the ability to record images and/or take pictures. In an example, a proximal imaging device can be a wearable device whose functions include the ability to record images and/or take pictures.

FIGS. 1 and 2 show two sequential cross-sectional views of the same device. Two sequential views are given in this example in order to show: (a) how inbound light guide 103 can move to track ambient light source 101 and better harvest light energy from ambient light source 101; and (b) how outbound light guide 106 can move to track proximal imaging device 102 and to better direct a beam of light energy toward proximal imaging device 102. This is particularly useful when there is movement of one or both of these objects relative to the person. Such relative movement can be due to movement of one or both of the objects, movement of the person wearing the device, or both. In this example, inbound light guide 103 and outbound light guide 106 are both moveable relative to the device housing 115. In another example, one or both of these light guides can be stationary relative to device housing 115.

As shown in the example in FIG. 1, light rays from ambient light source 101 are represented by a kinked dotted-line arrow 107 that goes from ambient light source 101 to proximal imaging device 102. In this example, light rays from ambient light source 101 are harvested, refracted, guided, and/or focused by inbound light guide 103 toward one-way mirror 104. In an example, a wearable device for disrupting unwelcome photography can include an inbound light guide to direct, reflect, refract, channel, or harvest light from an ambient light source. In an example, this inbound light guide can move to track an ambient light source and to better harvest light energy from that ambient light source.

In the example in FIG. 1, inbound light guide 103 is an asymmetric and/or wedge-shaped optical lens. In various examples, an inbound light guide can be selected from the group consisting of: acrylic mirror, aluminum vapor coated film, reflector array, carbon nanotube, compound lens, concentric lenses, concentric reflective surfaces, crystal, crystal array, cylindrical prism, dielectric mirror, Digital Light Processor (DLP), Digital Micromirror Device (DMD), diverging lens, asymmetric lens, wedge-shaped lens, Electromagnetically Induced Transparency (EIT) structure, fly's eye lens, Fresnel lens, microscale glass beads, light-guiding metamaterial structure, light-guiding tubes, light-transducing element, liquid crystal, liquid lens, MEMS-based mirror array, metamaterial light channel, microlens array, microsphere lenses, mirror ball, reflective surface array, nanorod, nanotube, optical fiber, parabolic reflective surface, parabolic lens, parabolic mirror or reflector, photonic crystal, plasmonic metamaterial structure, polarizing filter, polyethylene film, prism, rectangular prism, reflector, retroreflective structure, rhomboid prism, simple lens, Split Ring Resonator (SRR), and wedge prism.

After reflecting off one-way mirror 104, light rays 107 harvested from ambient light source 101 interact with harvested light sensor 105 which measures the amount of light energy harvested from ambient light source 101. In this example, there is sufficient light energy harvested from the ambient light source to disrupt photography by proximal imaging device 102, so there is no need to activate wearable light source 116 to supplement or replace ambient light.

After interacting with harvested light sensor 105, light rays from ambient light source 101 are refracted, directed, focused, and/or guided by outbound light guide 106 as a beam of light 107 that is directed toward proximal imaging device 102. In this example, outbound light guide 106 is an asymmetric and/or wedge-shaped optical lens. In other examples, outbound light guide 106 can be selected from the group consisting of: acrylic mirror, aluminum vapor coated film, reflector array, carbon nanotube, compound lens, concentric lenses, concentric reflective surfaces, crystal, crystal array, cylindrical prism, dielectric mirror, Digital Light Processor (DLP), Digital Micromirror Device (DMD), diverging lens, asymmetric lens, wedge-shaped lens, Electromagnetically Induced Transparency (EIT) structure, fly's eye lens, Fresnel lens, microscale glass beads, light-guiding metamaterial structure, light-guiding tubes, light-transducing element, liquid crystal, liquid lens, MEMS-based mirror array, metamaterial light channel, microlens array, microsphere lenses, mirror ball, reflective surface array, nanorod, nanotube, optical fiber, parabolic reflective surface, parabolic lens, parabolic mirror or reflector, photonic crystal, plasmonic metamaterial structure, polarizing filter, polyethylene film, prism, rectangular prism, reflector, retroreflective structure, rhomboid prism, simple lens, Split Ring Resonator (SRR), and wedge prism.

When beam of light 107 reaches proximal imaging device 102, it disrupts photography by this imaging device. In an example, beam of light 107 can disrupt photography by proximal imaging device 102 by one or more means selected from the group consisting of: flooding the imaging device with bright light; causing images to be over-exposed; causing blooming or lens flares in images; optically interfering with the operation of a Charged Couple Device (CCD) or Complementary Metal-Oxide Semiconductor (CMOS) component; and interfering with an auto-focus mechanism.

The example of this invention that is shown in FIG. 1 also includes an ambient light source tracker 108. In this example, ambient light source tracker 108 detects and tracks ambient light source 101 from which light energy is harvested to disrupt unwelcome photography. In this example, information from ambient light source tracker 108 is used to control inbound light guide mover 109 which, in turn, moves inbound light guide 103 so that it better harvests light energy from ambient light source 101. In an example, movement of ambient light source 101 relative to the person can be tracked by ambient light source tracker 108 using mathematical models of physical object motion.

In an example, ambient light source tracker 108 can monitor the local environment to detect, identify, analyze, and/or track one or more qualified ambient light sources. In an example, a qualified light source is a light source which can provide sufficient light energy for use by the wearable device to disrupt unwelcome photography by a proximal imaging device. In an example, one or more factors affecting qualification of an ambient light source can be selected from the group consisting of: amount of light energy from the ambient light source; variation over time in energy from the ambient light source; type and spectrum of ambient light source; size of the ambient light source; distance, location, and/or direction of the light source; relative movement between the person wearing the photography-disrupting device and the ambient light source; and number and characteristics of potential alternative ambient light sources. In an example, a wearable device for disrupting unwelcome photography can have one more sensors to analyze ambient light wherein these sensors are selected from the group consisting of: photocell, photodiode, phototransistor, photovoltaic cell, light wavelength or color sensor, and spectrometer.

The example of this invention that is shown in FIG. 1 also includes a proximal imaging device tracker 110. In this example, proximal imaging device tracker 110 detects and tracks a proximal imaging device toward which a beam of light is directed to disrupt unwelcome photography by the proximal imaging device. In this example, information from proximal imaging device tracker 110 is used to control outbound light guide mover 111 which, in turn, moves outbound light guide 106 so that it better directs light energy toward this imaging device.

In this example, proximal imaging device tracker 110 detects and tracks proximal imaging device 102 based on the detection and/or tracking of a distinctive pattern of electromagnetic (EM) energy that is emitted from proximal imaging device 102. In various examples, a proximal imaging device tracker can detect and track a proximal imaging device based on one or more methods selected from the group consisting of: detecting and/or tracking infrared energy that is emitted or reflected from the proximal imaging device; detecting and/or tracking retroreflected light from a proximal imaging device's CCD, CMOS, or SLR component; detecting and/or tracking retroreflected light that is distinctively focused, narrow, collimated, and/or coherent; detecting and/or tracking a photographic flash for still photography or continuous artificial light for video photography; detecting and/or tracking the visual shape, size, color, texture, text, and/or logo of a specific type of proximal imaging device; detecting and/or tracking the position and/or movement of a proximal imaging device relative to a person's face and/or eyes; detecting and/or tracking a command gesture that is associated with taking a picture; detecting and/or tracking a verbal command associated with taking a picture; detecting and/or tracking eye movements associated with taking a picture; detecting and/or tracking hand or arm movements associated with taking a picture; detecting and/or tracking a sound associated with taking a picture; and detecting and/or tracking indicator light activation associated with taking a picture.

In an example, movement of proximal imaging device 102 can be tracked by proximal imaging device tracker 110 using mathematical models of physical object motion. In an example, movement of a proximal imaging device that is worn or held by a person be tracked and predicted using models of human body movement. In an example, movement of a proximal imaging device that is worn or held by a person can be tracked and predicted using models of human skeletal movement and/or human kinesiology. In an example, movement of a proximal imaging device that is worn or held by a person can be tracked and predicted using gesture recognition. In an example, a Fourier transform can be used to control for the effects of repetitive movements (such as walking or running) by the person wearing a device as the device tracks changes in the relative positions of an ambient light source and/or a proximal imaging device.

The example of this invention that is shown in FIG. 1 also includes a combined data processing and wireless communication unit 112. In another example, there can be separate data processing and wireless communication units. In an example, a wearable device for disrupting unwelcome photography can include a wearable data processor that performs most or all of the data processing required to detect and track an ambient light source and a proximal imaging device and also to direct light energy toward the imaging device to disrupt photography. In an example, a wearable device for disrupting unwelcome photography can include a wireless communication unit that is in wireless communication with a remote data processor which performs these data processing functions. In an example, a wearable device for disrupting unwelcome photography can include a communication unit that is in communication with a remote data processor via the internet. In an example, a wearable device for disrupting unwelcome photography can be part of a system that includes an application for a mobile communication device or electronic tablet device.

In various examples, data processing and wireless communication unit 112 can control the operation of one or more components of a wearable device to disrupt unwelcome photography, wherein these components are selected from the group consisting of: a wearable light source; a mechanism to track one or more ambient light sources; an inbound light guide that harvests light energy from one or more ambient light sources; a mechanism that moves this inbound light guide to more efficiently collect light energy from these light sources; a mechanism to track one or more proximal imaging devices near the person; an outbound light guide that directs light from the ambient light source, the wearable light source, or both toward one or more imaging devices in order to unwelcome disrupt photography; a mechanism that moves this outbound light guide to more accurately target the one or more proximal imaging devices; and an ambient light sensor and/or harvested light sensor whose results are used to adjust the use and/or mix of light from the ambient light source and the wearable light source to disrupt photography by one or more proximal imaging devices.

The example of this invention that is shown in FIG. 1 also includes a power source 113. In an example, power source 113 can provide power for components of this device selected from the group consisting of: data processing unit, wireless communication unit, light sensor, inbound light guide mover, inbound light guide tracker, outbound light guide mover, outbound light guide tracker, and wearable light source. In an example, power source 113 can be a battery. In an example, power source 113 can be recharged from an external power source. In an example, power source 113 can store electrical energy that is generated or otherwise transduced from light energy from ambient light source 101 when light energy from ambient light source 101 is not required to disrupt unwelcome photography by a proximal imaging device. In an example, power source 113 can store electrical energy that is generated or otherwise transduced from movement of the wearable device.

The example of this invention that is shown in FIG. 1 also includes an internal wearable light source 116. In an example, light energy from wearable light source 116 can be used to supplement or replace light energy harvested from ambient light source 101 when light energy harvested from ambient light source 101 is insufficient to disrupt photography by proximal imaging device 102.

In this example, wearable light source 116 is a Light Emitting Diode (LED). In an example, a Light Emitting Diode (LED) or an array of LEDs for disrupting unwelcome photography can be selected from the group consisting of: white LED, color LED, infrared (IR) LED, Organic Light-Emitting Diode (OLED), and ultraviolet LED. In various examples, wearable light source 116 can be selected from the group consisting of: Light Emitting Diode (LED), infrared (IR) light source, low-power laser, ultraviolet (UV) light source, fluorescent light source, halogen lamp, Liquid Crystal Display (LCD), photoluminescent light source, quartz lamp, Electro Luminescent (EL) light source, and incandescent light source.

In the example shown in FIG. 1, the sole source of light energy used to disrupt unwelcome photography by one or more proximal imaging devices is ambient light source 101. In an example, light energy from an ambient light source can be reflected, refracted, focused, collimated, directed, guided, channeled, harvested, and/or transduced in order to direct light energy toward a proximal imaging device to disrupt unwelcome photography.

In another example, the sole source of light energy used to disrupt unwelcome photography by one or more proximal imaging devices can be wearable light source 116. In an example, light energy from wearable light source 116 can be reflected, refracted, focused, collimated, directed, guided, and/or channeled in order to direct light energy toward a proximal imaging device to disrupt unwelcome photography.

In another example, light energy to disrupt unwelcome photography by one or more proximal imaging devices can be a combination of light energy from ambient light source 101 and light energy from wearable light source 116. In an example, a combination of light energy from an ambient light source and light energy from a wearable light source can be reflected, refracted, focused, collimated, directed, guided, and/or channeled in order to direct light energy toward a proximal imaging device to disrupt unwelcome photography.

In an example, the use of light energy from an ambient light source, the use of light energy from a wearable light source, or the use of a combination of light energy from both ambient and wearable light sources can depend on one or more factors selected from the group consisting of: the absolute amount of ambient light energy from an ambient light source; the amount of ambient light energy that can be harvested from an ambient light source; the variation in light energy from an ambient light source over time; the area variability (or homogeneity) of ambient light; the area concentration (or diffusion) of ambient light; the total amount of ambient light energy (from all ambient light sources); the movement of a person wearing a photography-disrupting device relative to an ambient light source; the movement of an ambient light source relative to the person wearing a photography-disrupting device; the type (natural or artificial) of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy available to power a wearable light source; the type of proximal imaging device detected; the location of a person wearing a photography-disrupting device (such as determined by a GPS system); the movement of a person wearing a photography-disrupting device relative to the pull of gravity, the earth, or a GPS system; and current or predicted weather conditions.

The example in FIG. 1 also shows an overall ambient light sensor 114. In an example, if the overall ambient light level is very low, then a low-power wearable light source is likely to be sufficient to disrupt photography. In an example, if the overall ambient light level is very high, then even a high-power wearable light source is likely to be insufficient to disrupt photography.

In an example, the amount of harvested light energy (as measured by harvested light sensor 105) can be compared to the overall level of ambient light (as measured by overall ambient light sensor 114) as part of the evaluation of whether harvested ambient light is sufficient to disrupt photography. In an example, if the amount of harvested light energy is low relative to overall ambient light, then harvested ambient light is less likely to be sufficient to disrupt photography. In an example, if the amount of harvested light energy is high relatively to overall ambient light, then harvested ambient light is more likely to be sufficient to disrupt photography.

In an example, information from overall ambient light sensor 114 and harvested ambient light sensor 105 can be used to determine the most efficient use of battery power to disrupt unwelcome photography at a given time and setting. This can be an advantage over a device or method that relies entirely on a wearable light source or entirely on an ambient light source to disrupt unwelcome photography. Also, there are few, if any, non-coherent wearable light sources than can disrupt unwelcome photography in bright sunlight. The invention disclosed herein solves this problem.

In the first sequential view of this example, as shown in FIG. 1, ambient light source 101 is located above and forward of inbound light guide 103. This location of ambient light source 101 has been tracked by ambient light source tracker 108 and this information has been used by inbound light guide mover 109 to orient inbound light guide 103 so that it optimally directs light rays from ambient light source 101 toward one-way mirror 104.

In the second sequential view of this example, as shown in FIG. 2, ambient light source 101 is now located above and behind inbound light guide 103. In this short time-frame example, this change in location is due to movement of the person wearing the photography-disrupting device, not movement of the sun. In an example, the person might be walking or jogging, causing movement of the wearable device to disrupt unwelcome photography. In various examples, a change in the relative location of an ambient light source can be caused by movement of the ambient light source, movement of the person wearing the photography-disrupting device, or both. In any event, FIG. 2 shows that this new location of ambient light source 101 continues to be tracked by ambient light source tracker 108. Information from this tracker has been used by inbound light guide mover 109 to reorient inbound light guide 103 so that inbound light guide 103 still optimally directs light rays from ambient light source 101 toward one-way mirror 104.

In the first sequential view of this example, as shown in FIG. 1, proximal imaging device 102 is located above and forward of outbound light guide 106. This location of proximal imaging device 102 has been tracked by proximal imaging device tracker 110 and this information has been used by outbound light guide mover 111 to orient outbound light guide 106 so that it optimally directs light rays from one-way mirror 104 toward proximal imaging device 102.

In the second sequential view of this example, as shown in FIG. 2, proximal imaging device 102 is now located below and in front of outbound light guide 106. In various examples, a change in the relative location of a proximal imaging device can be caused by movement of the proximal imaging device, movement of the person wearing the photography-disrupting device, or both. In any event, FIG. 2 shows that this new location of proximal imaging device 102 continues to be tracked by proximal imaging device tracker 110. Information from this tracker has been used by outbound light guide mover 111 to reorient outbound light guide 106 so that outbound light guide 106 still optimally directs light rays from one-way mirror 104 toward proximal imaging device 102.

In the example shown in FIGS. 1 and 2, detection and tracking of an ambient light source and a proximal imaging device occurs automatically. In an example, detection and tracking of an ambient light source and/or proximal imaging device can be done manually by the person wearing a photography-disrupting device. In an example, detection and tracking of an ambient light source and/or proximal imaging device can be done in a manner that includes both manual and automatic processes. In an example, detection and tracking of an ambient light source and/or proximal imaging can be done in an iterative manner with some steps done by a human and some steps done by a computer.

In an example, detection and tracking of an ambient light source and/or proximal imaging device can be done in an partly-manual and partly-automated manner using a human-to-computer interface selected from the group consisting of: speaking a voice command and/or entering information via a speech recognition interface; eye movement, wink, and/or direction of eye gaze; directly touching a wearable device; motion sensor interface, body motion recognition, and/or entering information via a holographic interface; touching a touch screen and/or entering information via a touch-based electronic interface; head movement, orientation, and/or inclination; entering information on a keypad and/or pressing buttons; adjusting a control on a handheld device; finger pointing and/or arm extension; hand gesture, hand motion, and/or entering information via a gesture recognition interface; and EMG interface, EEG interface, neural monitoring interface and/or entering information via electromagnetic signals from a person's body.

In an example, there can be wires or other electricity-conducting connections between the various components of the device that is shown in FIGS. 1 and 2, as well as the devices in the figures which follow. In an example, there can be wireless communication between various components of the devices shown in these figures. Connecting wires are well known in the prior art and the precise configuration of wires is not central to this invention. Accordingly, in the interest of diagrammatic simplicity and to not distract from the most important elements of this invention, these figures do not show wires or other electricity-conducting connections between various components of this device. However, there can easily be wires, other electricity-conducting connections, or wireless communication between the components of this device.

Figure 3:
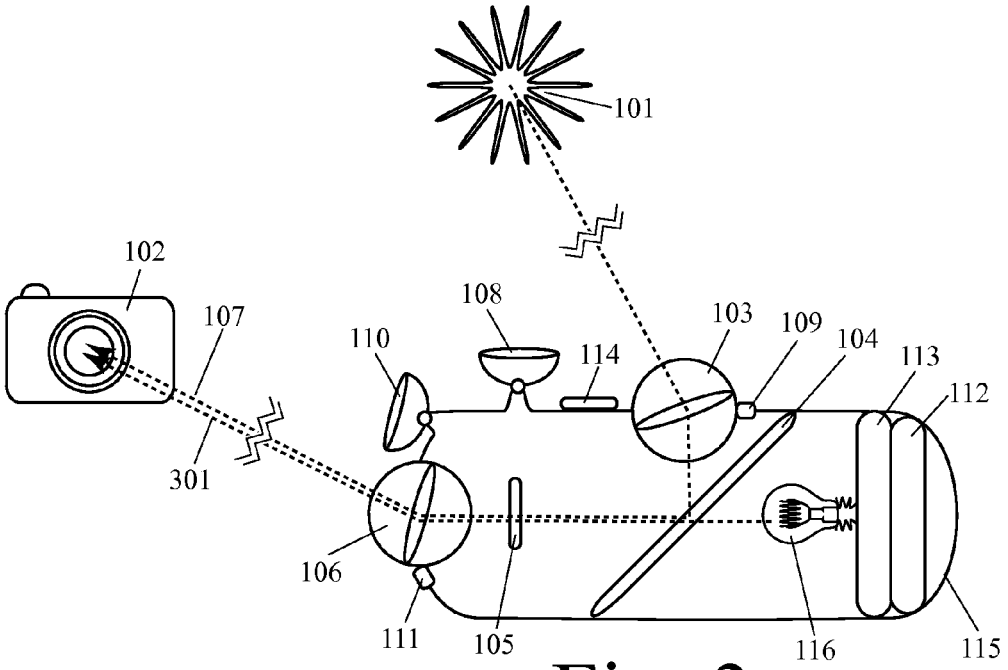
Figure 4:
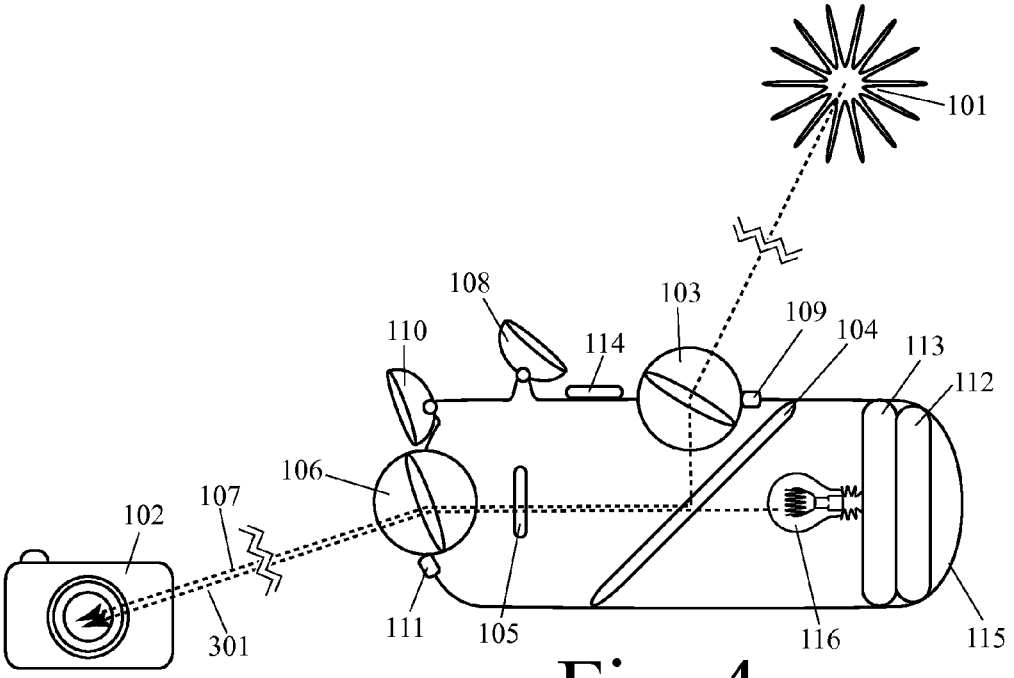

FIGS. 3 and 4 show the same embodiment of the invention that was shown in FIGS. 1 and 2, except that the amount of light energy that is harvested from ambient light source 101 is insufficient to disrupt unwelcome photography by proximal imaging device 102. Accordingly, the device has activated wearable light source 116 to supplement harvested ambient light.

In the example shown in FIGS. 3 and 4, comparison of harvested ambient light energy (as measured by harvested light sensor 105) to overall ambient light level (as measured by overall ambient light sensor 114) has shown that harvested ambient light energy is insufficient to disrupt unwelcome photography by proximal imaging device 102. In an example, this comparison and determination can be done within data processing and wireless communication unit 112 based on data from light sensors 105 and 114.

In the example shown in FIGS. 3 and 4, light rays from wearable light source 116 are represented by a kinked dotted-line arrow 301 from wearable light source 116 to proximal imaging device 102. In this example, light rays 301 from wearable light source 116 pass through one-way mirror 104 and then combine with light rays 107 harvested from ambient light source 101. Combined light rays 107 and 301 are then directed by outbound light guide 106 toward proximal imaging device 102. As was the case with FIGS. 1 vs. 2, FIGS. 3 vs. 4 show that when there is relative movement between one or both objects and the photography-disrupting device, inbound light guide 103 moves to better harvest light energy from ambient light source 101 and outbound light guide 106 moves to better direct light energy toward proximal imaging device 102.

Figure 5:
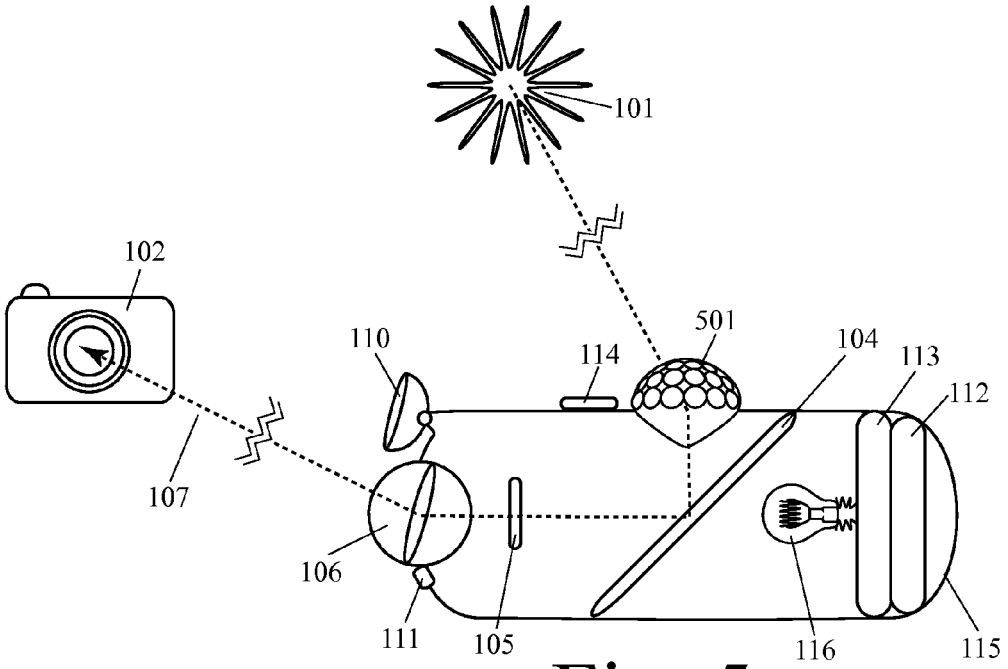
Figure 6:
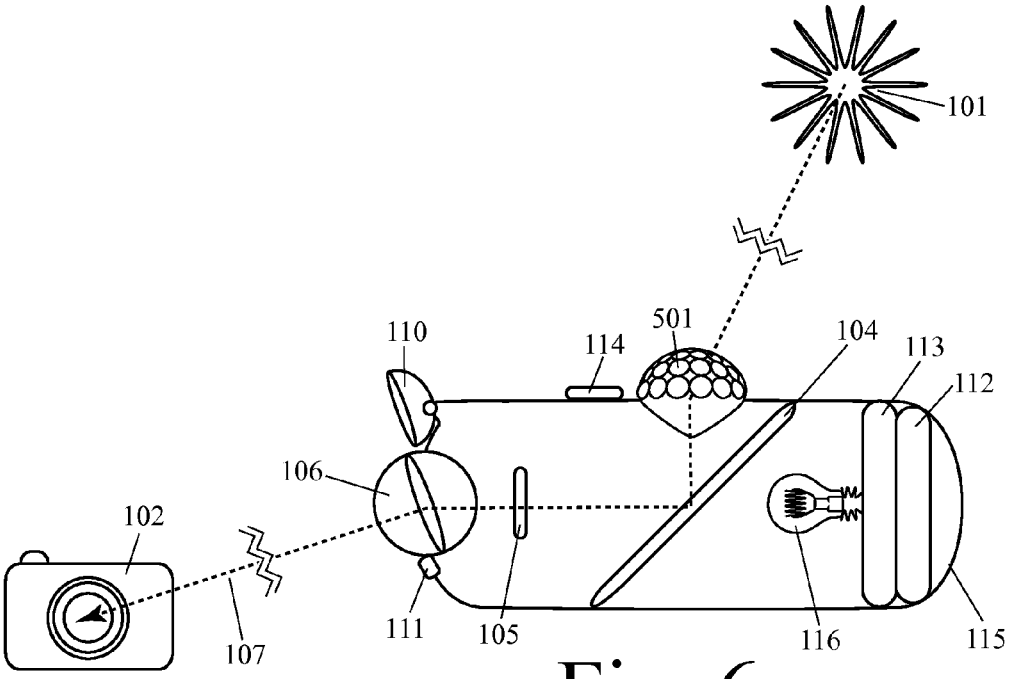

FIGS. 5 and 6 show an example of this invention that is similar to the one shown in FIGS. 1 and 2, except that now the inbound light guide 501 does not move relative to device housing 115. Instead, inbound light guide is able to harvest ambient light energy from multiple angles without moving because inbound light guide 501 is a multi-angle inbound light guide. In an example, inbound light guide 501 can be a compound lens or fly's eye lens. In an example, inbound light guide 501 can be a converging optical fiber array or metamaterial light guide array. Since inbound light guide 501 does not move relative to device housing 115 in this example, there is no ambient light source tracker in this example. In this example, outbound light guide 106 still moves with changes in the relative location of the proximal imaging device.

A potential disadvantage of the device shown in FIGS. 5 and 6 is that this device can be less efficient at harvesting ambient light than a device with a perfectly-functioning ambient light source tracker. However, a potential advantage of this device is greater simplicity, less reliance on moving parts, and avoiding the power requirements of tracking ambient light sources. Also, it can be more efficient at harvesting ambient light than a device with an imperfectly-functioning ambient light source tracker. In an example, if a person wearing the device is moving a lot and/or an ambient light source is moving a lot, then accurately tracking an ambient light source can be very challenging and it may be preferable to simply harvest light simultaneously from multiple angles using a compound or fly's eye lens, optical fiber array, or metamaterial light guide array.

Figure 7:
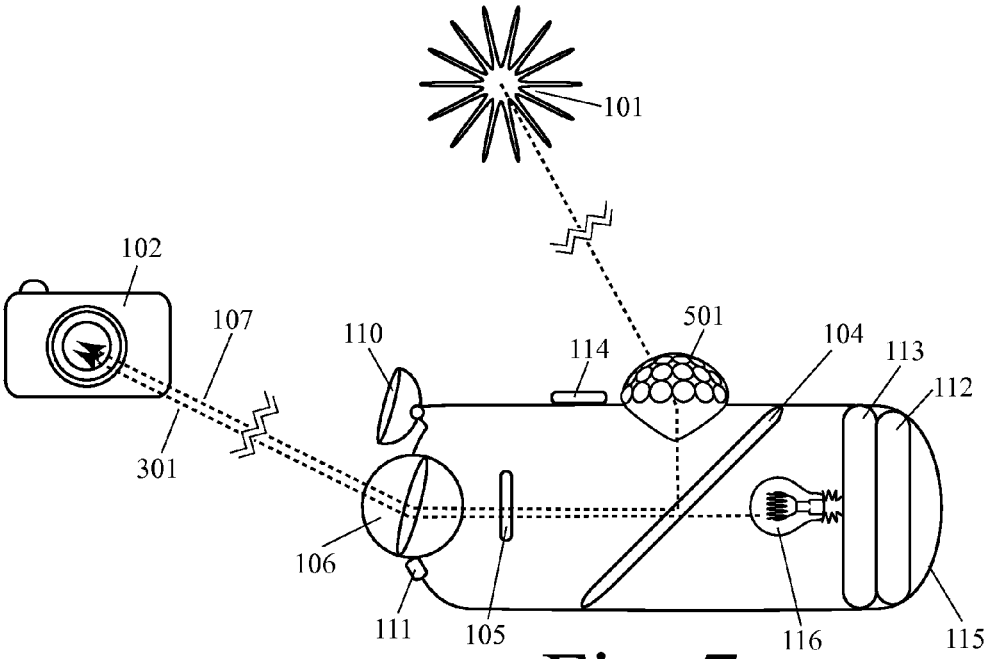
Figure 8:
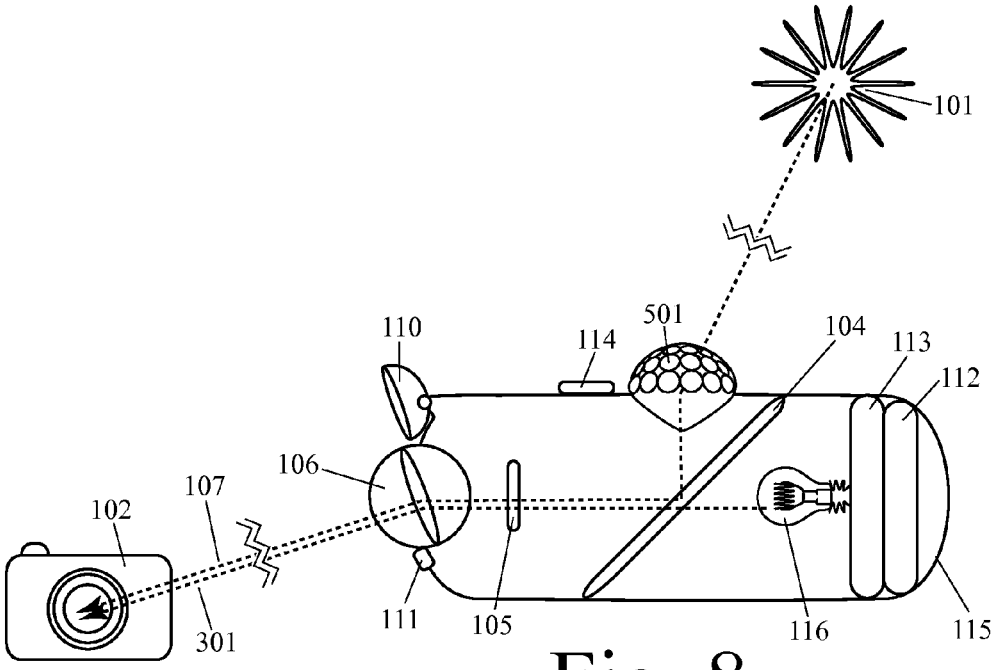

FIGS. 7 and 8 show the same embodiment of the invention that was shown in FIGS. 5 and 6, except that the amount of light energy that is harvested from ambient light source 101 is insufficient to disrupt unwelcome photography by proximal imaging device 102. Accordingly, the device has activated wearable light source 116 to supplement harvested ambient light.

Figure 9:
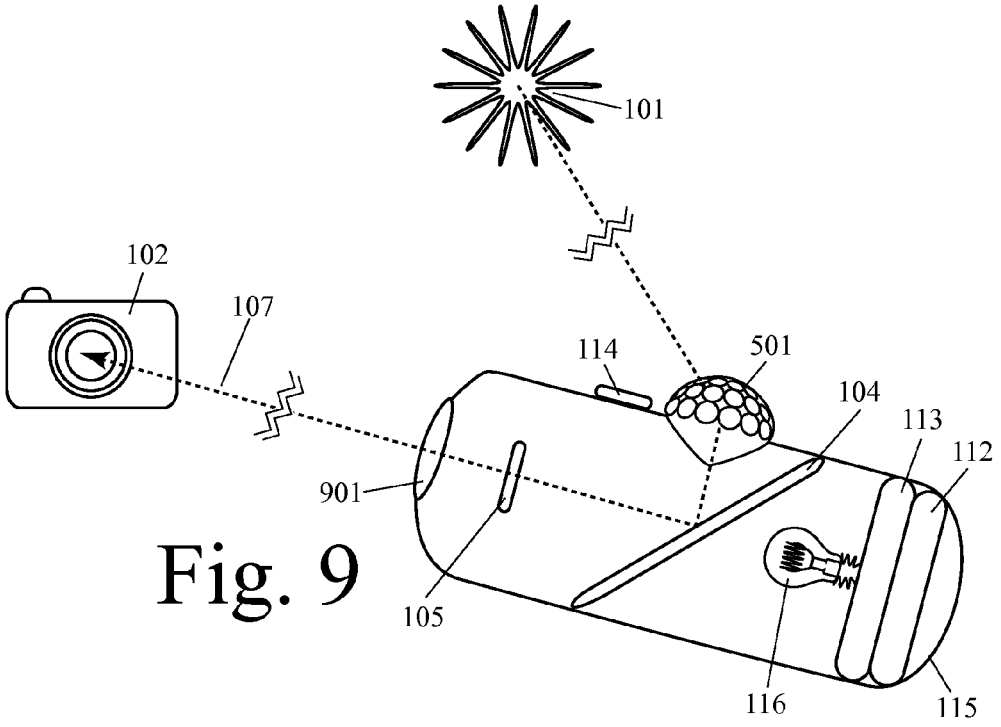
Figure 10:
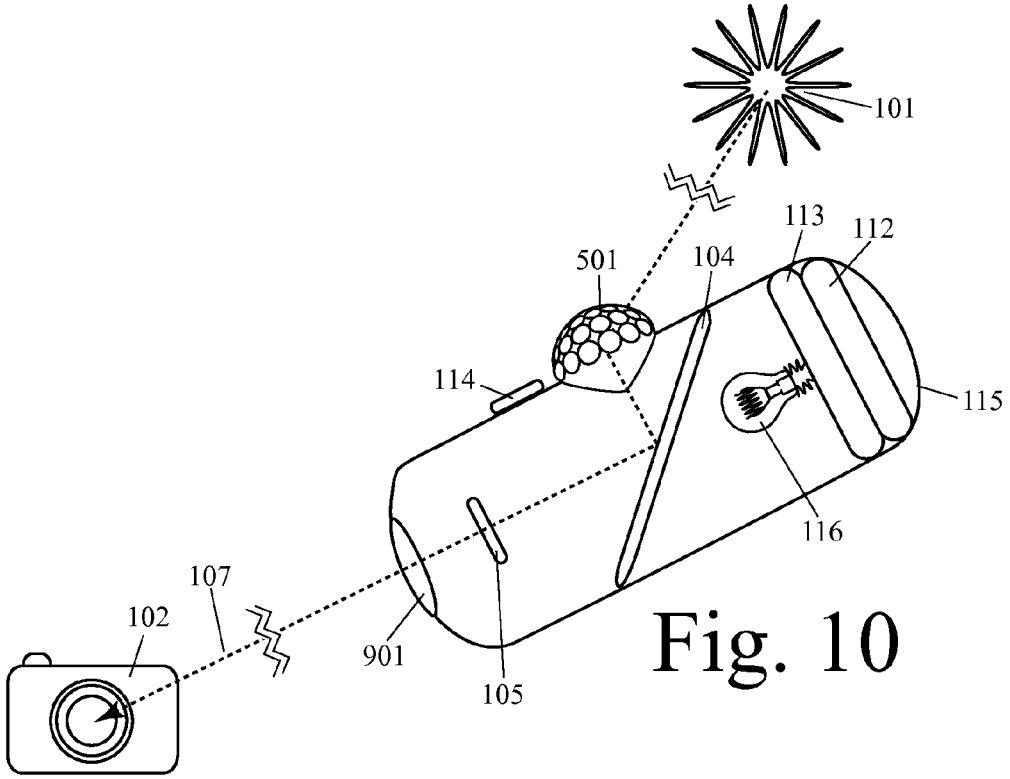

FIGS. 9 and 10 show an example of this invention that is similar to the one shown in FIGS. 5 and 6 in that it also has a multi-angle inbound light guide 501, but its outbound light guide 901 does not move relative to device housing 115. Instead, the entire device housing must be moved to change the direction of light rays exiting outbound light guide 901 in order to target proximal imaging device 102. Since outbound light guide 901 does not move relative to device housing 115 in this example, there is no proximal imaging device tracker in this example.

In an example, a person wearing the photography-disrupting device shown in FIGS. 9 and 10 can manually direct a beam of light 107 toward proximal imaging device 101 by moving the portion of their body on which the photography-disrupting device is worn. In an example, if this device is attached to eyewear or earwear, then the person wearing the device can direct the beam of light exiting outbound light guide 901 by tilting or turning their head. In an example, if this device is attached to their wrist, then the person wearing the device can direct the beam of light exiting outbound light guide 901 by moving their arm and/or wrist.

In an example, having an outbound light guide 901 which does not move relative to device housing 115 can be a disadvantage because the person must manually detect and track a proximal imaging device. Proximal imaging device detection and tracking is not automatic in this example. In addition to the cognitive demands of manual detection and tracking of a proximal imaging device, there are also limits to the range, flexibility, and speed of movement of different portions of a person's body. For example, aside from certain horror flicks, a person can only turn their head so far and so fast. Also, depending on the body motions that are required to target a proximal imaging device in a particular location, certain body motions may look weird and/or be socially awkward.

However, there can be advantages to the simplicity of design and reliance on human actions in the device shown in FIGS. 9 and 10. For example, there are no parts which move relative to the device housing. This can reduce the cost and complexity of such a device. Further, having no such moving parts can reduce the power requirements of such a device. Also, this device provides the person wearing the device with total control over where (and when) the beam of light is directed. This can potentially reduce false alarms in which a wearable device to disrupt unwelcome photography directs a beam of light at something that is not taking pictures.

Figure 11:
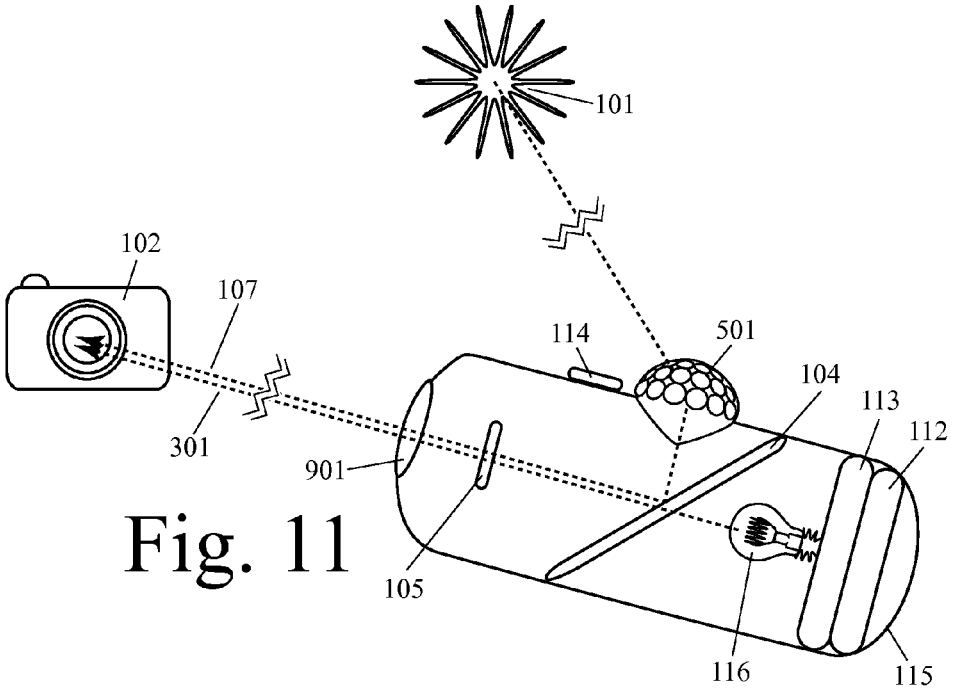
Figure 12:
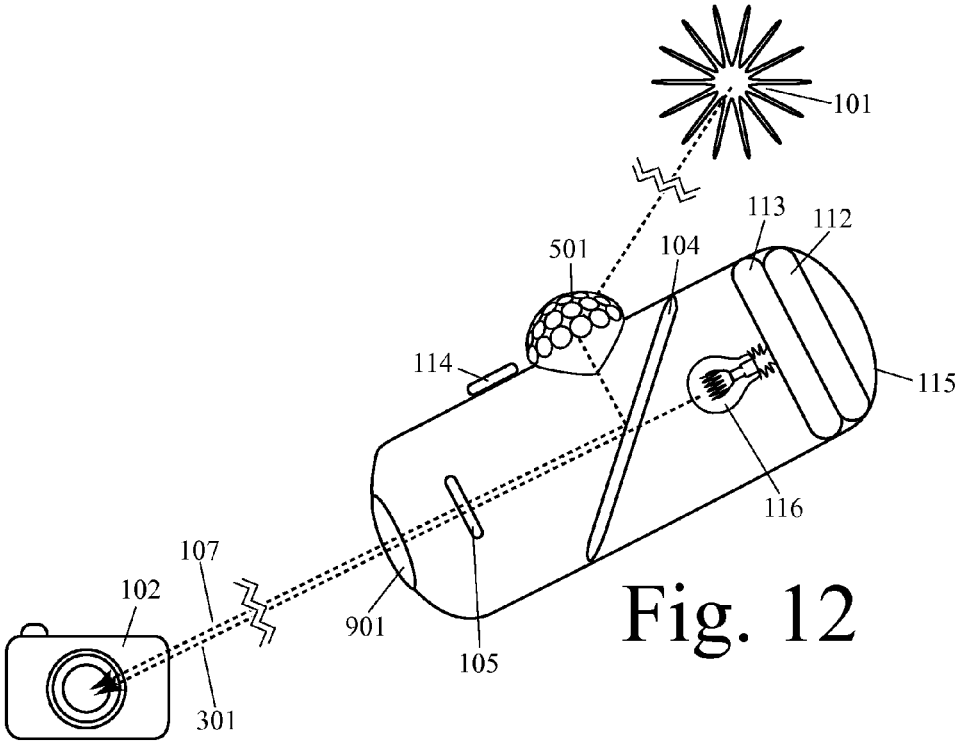

FIGS. 11 and 12 show the same embodiment of the invention that was shown in FIGS. 9 and 10, except that the amount of light energy that is harvested from ambient light source 101 is insufficient to disrupt unwelcome photography by proximal imaging device 102. Accordingly, the device has activated wearable light source 116 to supplement harvested ambient light.

As shown in FIGS. 9 through 12, this invention can be embodied in a wearable device for disrupting unwelcome photography in order to protect a person's privacy comprising: (a) a wearable light source that is worn by a person whose privacy is to be protected from unwelcome photography; (b) an inbound light guide that harvests, refracts, reflects, focuses, directs, and/or guides light energy from an ambient light source; (c) a light sensor; (d) a data processing unit that uses results from the light sensor in order to select and/or adjust the use of light energy from the wearable light source, the use of light energy from the ambient light source, or the use of light energy from both the wearable light source and the ambient light source in order to disrupt unwelcome photography by the proximal imaging device; and (e) an outbound light guide that refracts, reflects, focuses, directs, and/or guides light energy from the wearable light source, light energy from the ambient light source, or light energy from both the wearable light source and the ambient light source toward the proximal imaging device in order to disrupt unwelcome photography by the proximal imaging device.

In this embodiment, a proximal imaging device can be defined with respect to the person whose privacy is to be protected from unwelcome photography as a device which is capable of recording images and/or taking pictures, which has a direct line-of-sight to the person, and which is within a sufficiently short distance from the person to record identifiable images and/or take identifiable pictures of that person.

This embodiment can further comprise an outbound light guide mover that moves the outbound light guide in order to better refract, reflect, focus, direct, and/or guide light energy toward a proximal imaging device. This embodiment can further comprise a proximal imaging device tracker that detects and/or tracks a proximal imaging device. This embodiment can further comprise an inbound light guide mover that moves an inbound light guide in order to better harvest, refract, reflect, focus, direct, and/or guide light energy from an ambient light source. This embodiment can further comprise an ambient light source tracker that detects and/or tracks an ambient light source. This embodiment can further comprise a wearable power source.

In this embodiment, a data processing unit can select and/or adjust the use of light energy from an ambient light source, the use of light energy from a wearable light source, or the use of a combination of light energy from both ambient and wearable light sources depending based on factors selected from the group consisting of: the absolute amount of ambient light energy from an ambient light source; the amount of ambient light energy that can be harvested from an ambient light source; the variation in light energy from an ambient light source over time; the area variability or homogeneity of ambient light; the area concentration or diffusion of ambient light; the total amount of ambient light energy from all ambient light sources; the movement of a person wearing a photography-disrupting device relative to an ambient light source; the movement of an ambient light source relative to the person wearing a photography-disrupting device; the type of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device as determined by a GPS system; the movement of a person wearing a photography-disrupting device relative to the pull of gravity, the earth, or a GPS system; and current or predicted weather conditions.

Figure 13:
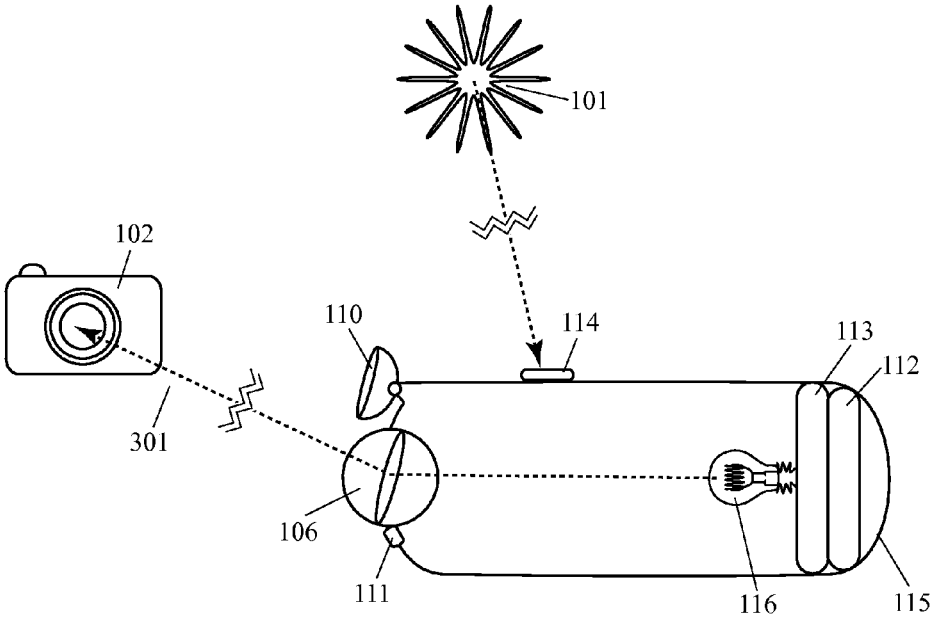
Figure 14:
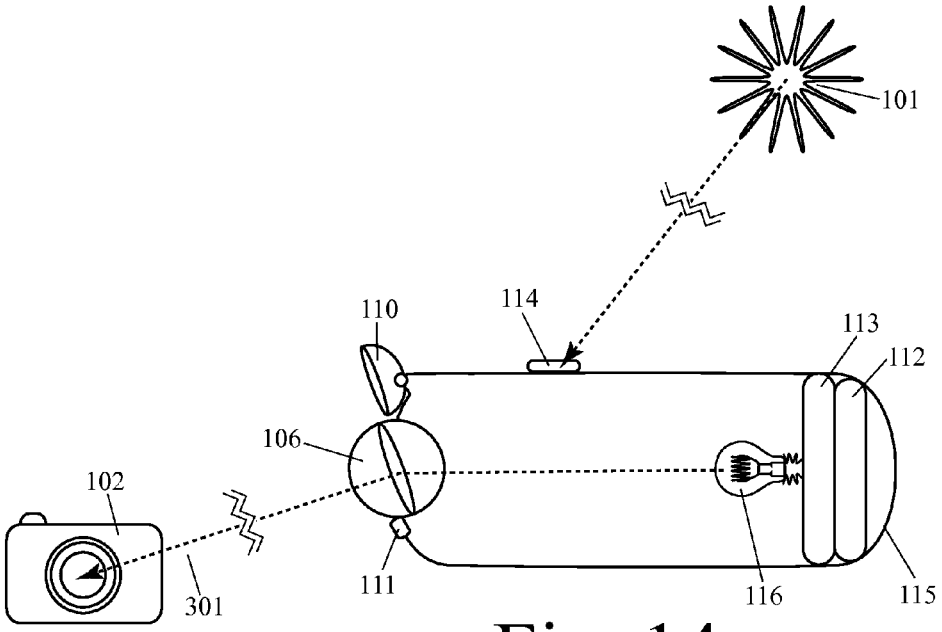

FIGS. 13 and 14 show an example of how this invention can be embodied that is similar to the one shown in FIGS. 1 and 2 except that it does not include a mechanism for harvesting light energy from an ambient light source. This embodiment relies entirely on light from wearable light source 116 to disrupt unwelcome photography. As was the case in the example shown in FIGS. 1 and 2, the example shown in FIGS. 13 and 14 also includes a proximal imaging device tracker 110, outbound light guide mover 111, and outbound light guide 106 which provide automated detection, tracking, and disruption of proximal imaging device 102 when it moves.

The example in FIGS. 13 and 14 still includes an overall ambient light sensor 114 to determine how much power must be sent to wearable light source 116 in order to create a sufficiently-powerful light beam 301 to disrupt proximal imaging device 102 given the overall level of ambient light. During conditions of dim overall ambient light, less light and less power will be required to disrupt unwelcome photography. During conditions of bright overall ambient light, more light and more power will be required to disrupt unwelcome photography. Sending just enough power to wearable light source 116 to create sufficient light to disrupt photography, given the overall level of ambient light, can help to conserve use of power from power source 113.

The example of this invention that is shown in FIGS. 13 and 14 has an advantage of simplicity compared to prior examples. Since light energy from ambient light sources is not harvested, the complexity of detecting, tracking, and redirecting ambient light is avoided. However, this example has the disadvantage of relying completely on power from power source 113 and light from wearable light source 116 to disrupt unwelcome photography. This can be very power intensive and require frequent recharging. Also, under bright sunlight conditions, it may not be possible (with non-coherent light) to create a sufficiently bright light from a wearable light source alone to adequately disrupt unwelcome photography. A wearable coherent light source can disrupt photography in bright sunlight conditions, but there are safety limitations on the power of coherent light used in order to ensure safety if coherent light inadvertently contacts a human eye.

As shown in FIGS. 13 and 14, this invention can be embodied in a wearable device for disrupting unwelcome photography in order to protect a person's privacy comprising: (a) a wearable light source that is worn by a person whose privacy is to be protected from unwelcome photography; (b) a data processing unit; (c) an outbound light guide that refracts, reflects, focuses, directs, and/or guides light energy from the wearable light source toward a proximal imaging device in order to disrupt unwelcome photography by the proximal imaging device; and (d) an outbound light guide mover that moves the outbound light guide in order to better refract, reflect, focus, direct, and/or guide light energy toward the proximal imaging device.

In this embodiment, a proximal imaging device can be defined with respect to the person whose privacy is to be protected from unwelcome photography as a device which is capable of recording images and/or taking pictures, which has a direct line-of-sight to the person, and which is within a sufficiently short distance from the person to record identifiable images and/or take identifiable pictures of that person.

This embodiment can further comprise an inbound light guide that harvests, refracts, reflects, focuses, directs, and/or guides light energy from an ambient light source. This embodiment can further comprise an inbound light guide mover that moves the inbound light guide in order to better harvest, refract, reflect, focus, direct, and/or guide light energy from an ambient light source. In this embodiment, an outbound light guide can refract, reflect, focus, direct, and/or guide light energy from a wearable light source, light energy from an ambient light source, or light energy from both a wearable light source and an ambient light source toward a proximal imaging device in order to disrupt unwelcome photography by the proximal imaging device.

This embodiment can further comprise an ambient light source tracker that detects and/or tracks an ambient light source. This embodiment can further comprise a light sensor. In this embodiment, a data processing unit can use the results from this light sensor in order to select and/or adjust the use of light energy from a wearable light source, the use of light energy from an ambient light source, or the use of light energy from both a wearable light source and an ambient light source in order to disrupt unwelcome photography by the proximal imaging device. This embodiment can further comprise a proximal imaging device tracker that detects and/or tracks a proximal imaging device. This embodiment can further comprise a wearable power source.

In this embodiment, a data processing unit can select and/or adjust the use of light energy from an ambient light source, the use of light energy from a wearable light source, or the use of a combination of light energy from both ambient and wearable light sources based on one or more factors selected from the group consisting of: the absolute amount of ambient light energy from an ambient light source; the amount of ambient light energy that can be harvested from an ambient light source; the variation in light energy from an ambient light source over time; the area variability or homogeneity of ambient light; the area concentration or diffusion of ambient light; the total amount of ambient light energy from all ambient light sources; the movement of a person wearing a photography-disrupting device relative to an ambient light source; the movement of an ambient light source relative to the person wearing a photography-disrupting device; the type of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device as determined by a GPS system; the movement of a person wearing a photography-disrupting device relative to the pull of gravity, the earth, or a GPS system; and current or predicted weather conditions.

FIGS. 15 through 24 show how the examples of this invention that were introduced in FIGS. 1 through 14 can look and function when they are integrated into eyewear that is worn by a person whose privacy is to be protected from unwelcome photography. These figures help to show the anatomical context for wearable technology that actually enhances privacy. Giving people options for privacy-enhancing wearable technology can help to counter-balance the proliferation of potentially privacy-eroding wearable technology. Before discussing the individual components of the examples in FIGS. 15 through 24, it is useful to first provide an overview of some of the key issues with respect to incorporating a wearable device for disrupting unwelcome photography into eyewear.

FIGS. 15 through 24 show examples of how a wearable device for disrupting wearable technology can be incorporated and/or integrated into eyewear. In various examples, a wearable device for disrupting unwelcome photography can comprise, be incorporated into, and/or be attached to one or more examples of wearable technology selected from the group consisting of: generic prescription glasses or sunglasses; smart glasses and/or electronically-functional glasses; specialized privacy-enhancing glasses; augmented reality (AR) glasses, goggle, visor, helmet or other AR eyewear; virtual reality (VR) glasses, goggle, visor, helmet or other VR eyewear; wearable heads-up display; camera-enable glasses (with imaging-safeguards to avoid irony and/or hypocrisy); monocle and/or eyepiece for "assimilating biological distinctives"; conventional or electronically-functional contact lenses; conventional or electronically-functional goggles; conventional or electronically-functional helmet; and face mask.

In the examples shown in FIGS. 15 through 24, one or more inbound light guides and/or outbound light guides are incorporated into, or attached to, privacy-enhancing eyewear. In an example, having one or more outbound light guides located near the face of a person whose privacy is to be protected can be particularly effective for disrupting facial recognition in unwelcome photography. In an example, privacy-enhancing eyewear can include a light sensor and a data processor which evaluate the level of ambient light and determine whether to direct light from an ambient light source, light from a wearable light source, or both light sources toward a proximal imaging device to disrupt unwelcome photography by that device.

In the examples shown in FIGS. 15 through 24, a beam of light is directed from one location on eyewear toward a proximal imaging device. In an example, multiple beams of light can be directed from different locations on eyewear so as to converge on a proximal imaging device. In an example, privacy-enhancing eyewear can direct two different beams of light toward a proximal imaging device such that these two beams intersect at the location of a proximal imaging device. In an example, the intersection of these two beams of light can interact in a synergistic manner to disrupt photography. In an example, these two light beams can have different polarization orientations, collimation orientations, wavelengths, or pulsation patterns which interact in a synergistic manner to disrupt photography.

In an example, an inbound light guide and/or outbound light guide that are incorporated into privacy-enhancing eyewear can be moved manually and directly when a person moves their head. In an example, an inbound light guide and/or outbound light guide that are incorporated into privacy-enhancing eyewear can be moved automatically and/or indirectly by an inbound light guide mover and/or outbound light guide mover that are part of the eyewear. In an example, an inbound light guide and/or outbound light guide can be moved by a combination of manual control by movement of a person's head and automatic control by automated light guide moving mechanisms.

In an example, an inbound light guide and/or outbound light guide that are incorporated into privacy-enhancing eyewear can be moved remotely by wireless communication with a hand-held device which the person wearing the eyewear can adjust via touch screen. In an example, privacy-enhancing eyewear can be in wireless communication with a smart phone, mobile phone, or electronic tablet. In an example, an outbound light guide on privacy-enhancing eyewear can be moved by recognizing voice commands by the person wearing the eyewear. In an example, a light guide incorporated into privacy-enhancing eyewear can be moved automatically in response to the changing location of an ambient light source and/or proximal imaging device which are tracked by privacy-enhancing eyewear.

In an example, a wearable device for disrupting unwelcome photography can be incorporated into Augmented Reality (AR) eyewear and/or other electronically-functional eyewear. In an example, input from a person wearing photography-disrupting eyewear can be selected from actions in the group consisting of: voice command, touching the device, touching a remote control for the device, direction of eye gaze, eye wink, head movement, and hand gesture.

In an example, the augmented reality functionality of such eyewear can be used to help identify and track an ambient light source from which light is harvested to disrupt unwelcome photography. In an example, such eyewear can identify the type of ambient light source. In an example, augmented reality eyewear can identify a potential ambient light source and input from the wearer can confirm use of this ambient light source for disrupting photography. In an example, the augmented reality functionality of eyewear can be used to help identify and track a proximal imaging device whose operation is hindered to disrupt unwelcome photography. In an example, such eyewear can identify the type of proximal imaging device. In an example, augmented reality eyewear can identify a potential proximal imaging device and input from the wearer can confirm direction of beam of light toward this imaging device.

Figure 15:
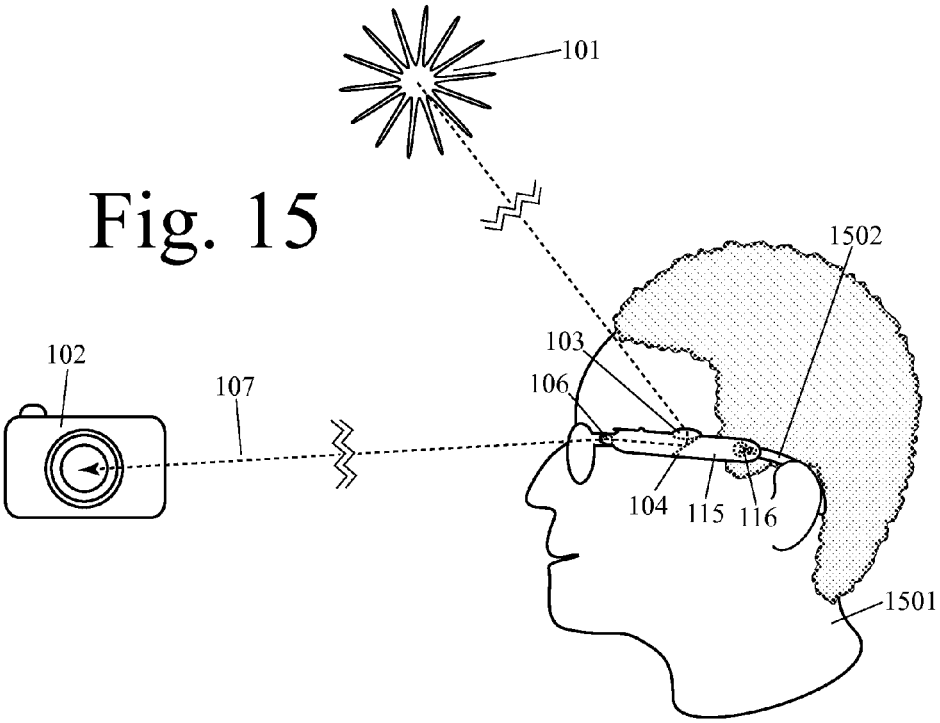
Figure 16:
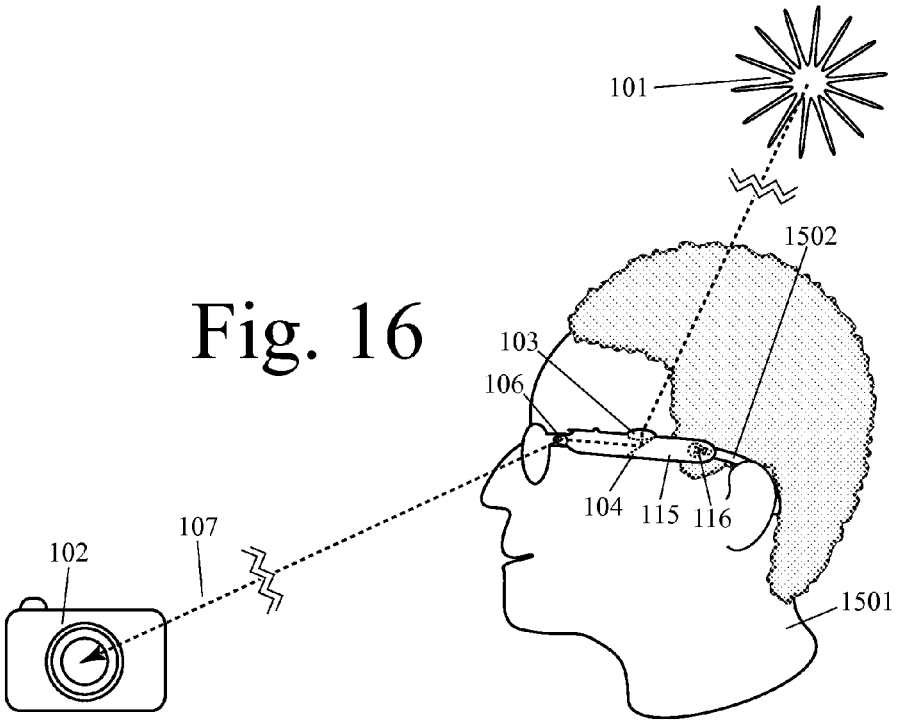

We now transition from this overview of eyewear devices to discussion of the specific components in FIGS. 15 and 16. The core device of the example that is shown in FIGS. 15 and 16 is the same as the device shown in FIGS. 1 and 2. The difference in FIGS. 15 and 16 is that these figures show how this core device can look and function in anatomical context as wearable technology eyewear. Specifically, FIGS. 15 and 16 show the core device shown in FIGS. 1 and 2 having been incorporated into, or attached to, eyewear 1502 which is worn by person 1501.

In FIGS. 15 and 16, person 1501 wears eyewear frames 1502 to which device housing 115 is attached. In an example, eyewear frames 1502 can be part of a conventional pair of eyeglasses to which a specialized device for disrupting unwelcome photography (in housing 115) is attached by clip, adhesive, fastener, or other means. In an example, eyewear frames 1502 can be part of specialized eyewear into which a device for disrupting unwelcome photography (in housing 115) has been integrated. In this example, there is one light-emitting device on one side of the eyewear. In another example, there can be two light-emitting devices, one on each side of the eyewear. In an example, a plurality of light beams can be directed from eyewear to intersect at the location of a proximal imaging device in a synergistic manner to disrupt unwelcome photography.

Apart from the diagrammatic addition of the person 1501 wearing the device and eyewear frames 1502 to which the device is attached, the parts in FIGS. 15 and 16 (including all the components of the wearable device to disrupt unwelcome photography) were all introduced in FIGS. 1 and 2. These parts include: ambient light source 101 (the sun in this example); proximal imaging device 102 (a camera in this example); inbound light guide 103; one-way mirror 104; outbound light guide 106; light rays 107; and wearable light source 116. In the interest of avoiding diagrammatic clutter, some of the smaller components of FIGS. 1 and 2 are not explicitly shown again here in this smaller-scale diagram, but are assumed to still be in the device. These components include: harvested light sensor 105; ambient light source tracker 108; inbound light guide mover 109; proximal imaging device tracker 110; outbound light guide mover 111; data processing and communication unit 112; power source 113; and overall ambient light sensor 114.

In the example shown in FIGS. 15 and 16, detection and tracking of ambient light source 101 and proximal imaging device 102 are both automated. Accordingly, the person 1501 wearing this eyewear does not have to move their head to better harvest light from ambient light source 101 (if it moves). Also, the person 1501 wearing this eyewear does not have to move their head to better target a beam of light toward proximal imaging device 102 (if it moves). In the example shown in FIGS. 15 and 16, light energy harvested from ambient light source 101 is sufficient to disrupt unwelcome photography by proximal imaging device 102 so the device does not have to activate wearable light source 116. This can conserve power required by the wearable device. Also, redirected sunlight can be more powerful and effective for disrupting photography under bright sunlight conditions than would light from wearable light source 116.

Figure 17:
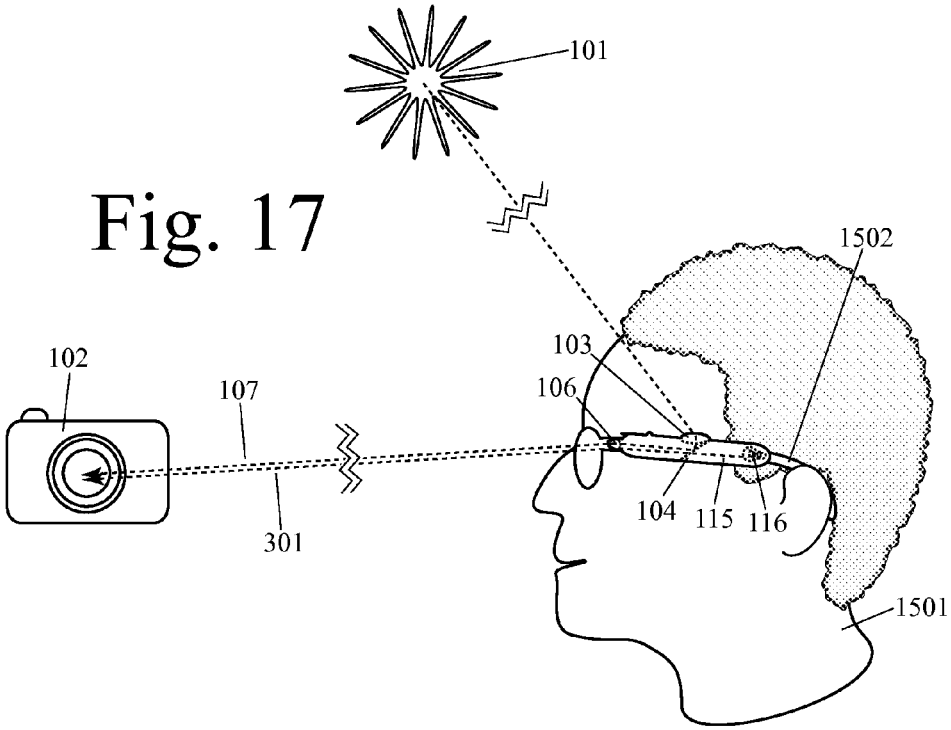
Figure 18:
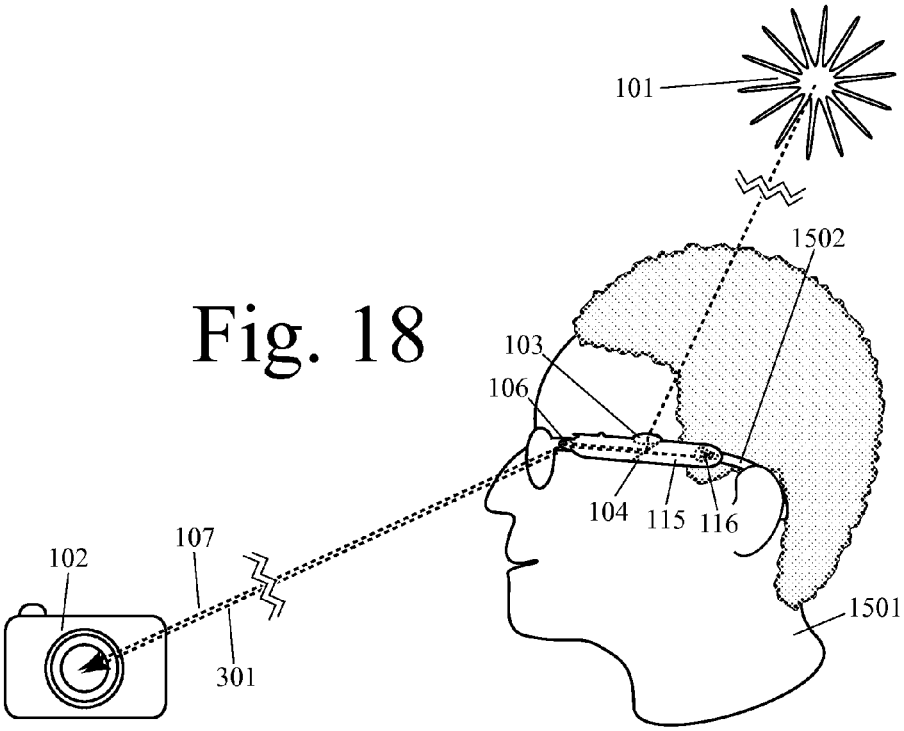

FIGS. 17 and 18 show the same example of this invention that was just shown in FIGS. 15 and 16, except that now the amount of light energy that is harvested from ambient light source 101 is insufficient to disrupt unwelcome photography by proximal imaging device 102. Accordingly, the device has activated wearable light source 116 to supplement harvested ambient light. The example that is shown in FIGS. 17 and 18 can also be understood as the device and lighting circumstances that were introduced in FIGS. 3 and 4, except that now this device is shown in anatomical context as part of eyewear 1502 that is worn by person 1501.

Figure 19:
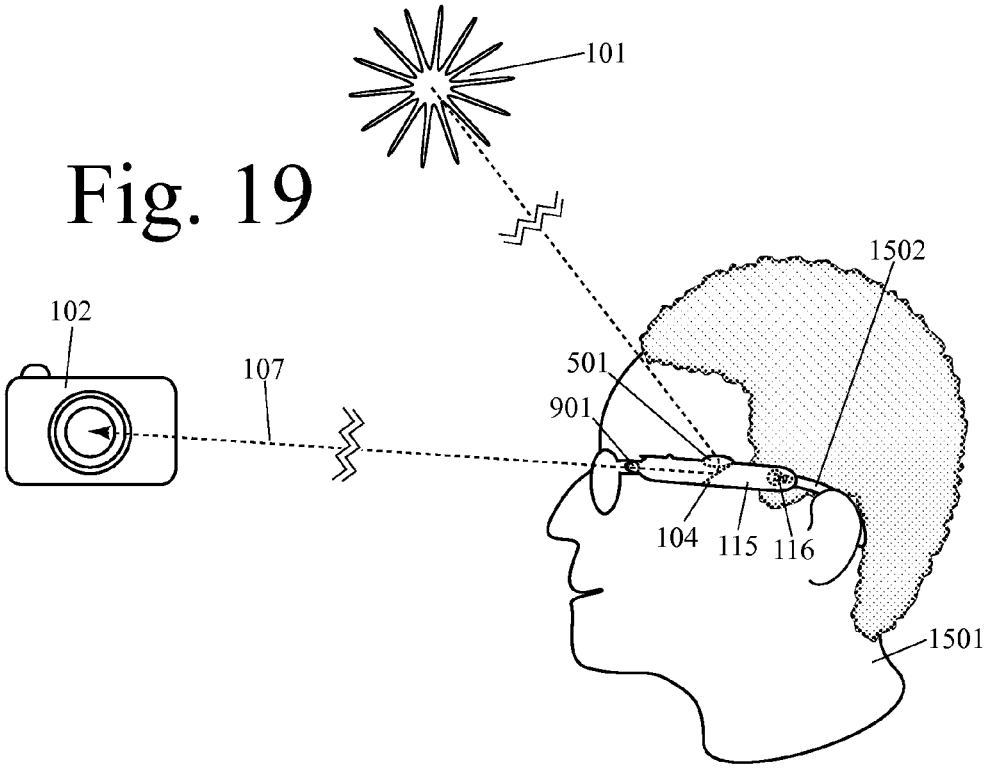
Figure 20:
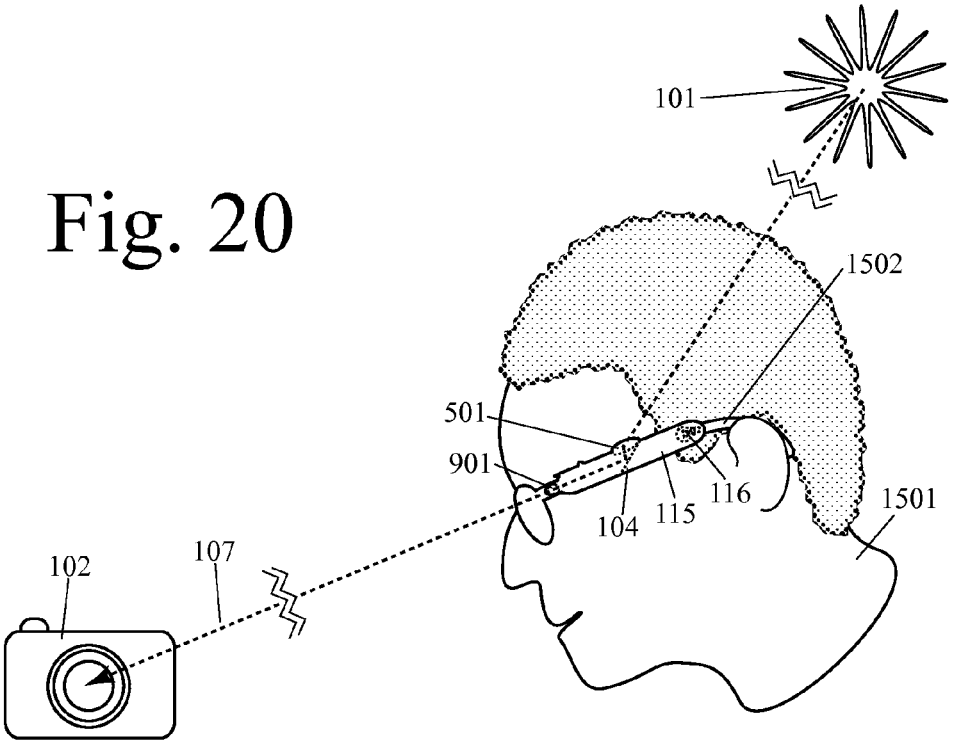

The example of this invention that is shown in FIGS. 19 and 20 is the same as the example introduced in FIGS. 9 and 10, except that now this device is shown in anatomical context as part of eyewear 1502 that is worn by person 1501. In the example shown in FIGS. 19 and 20, inbound light guide 501 is a multi-angle inbound light guide that can harvest ambient light from multiple angles without moving relative to housing 115. In an example, inbound light guide 501 can be a compound lens or fly's eye lens, converging optical fiber array, or metamaterial light guide array.

In the example shown in FIGS. 19 and 20, outbound light guide 901 does not move relative to housing 115. In this example, the person 1501 wearing the eyewear has to move their head into order to direct beam of light 107 toward proximal imaging device 102. We have already discussed the pros and cons of such manual control of the outbound light beam direction. However, to recap briefly, advantages of manual beam direction include its simplicity and decreased power requirements. Disadvantages of manual beam direction include the human attention required and limitations on the range and speed of head movement.

Figure 21:
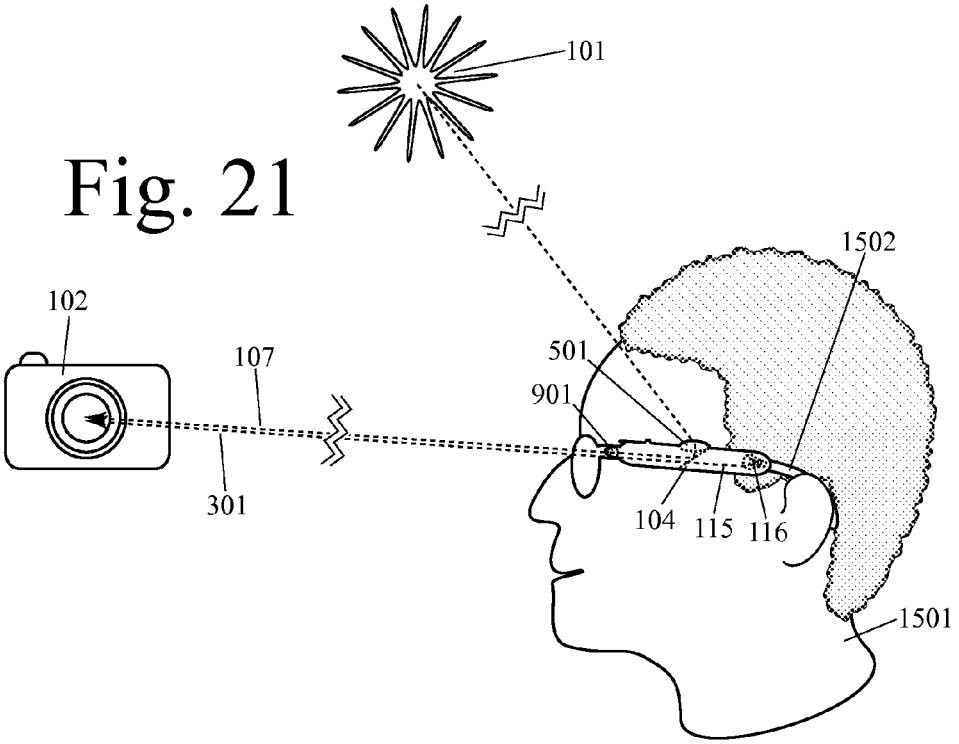
Figure 22:
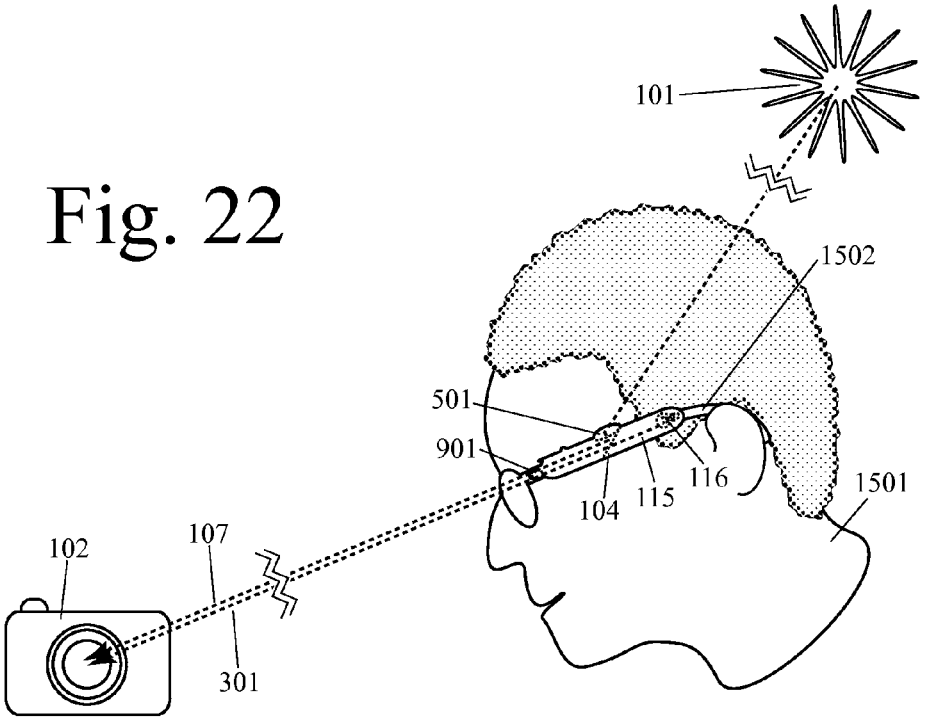

The example shown in FIGS. 21 and 22 is the same as the example shown in FIGS. 19 and 20, except that in this case light energy harvested from ambient light source 101 alone is insufficient to disrupt photography. Accordingly, the device also activates wearable light source 116 to provide additional light energy. In this example, light energy harvested from ambient light source 101 and light energy from wearable light source 116 are combined into a (composite) beam of light that is directed toward proximal imaging device 102.

Figure 23:
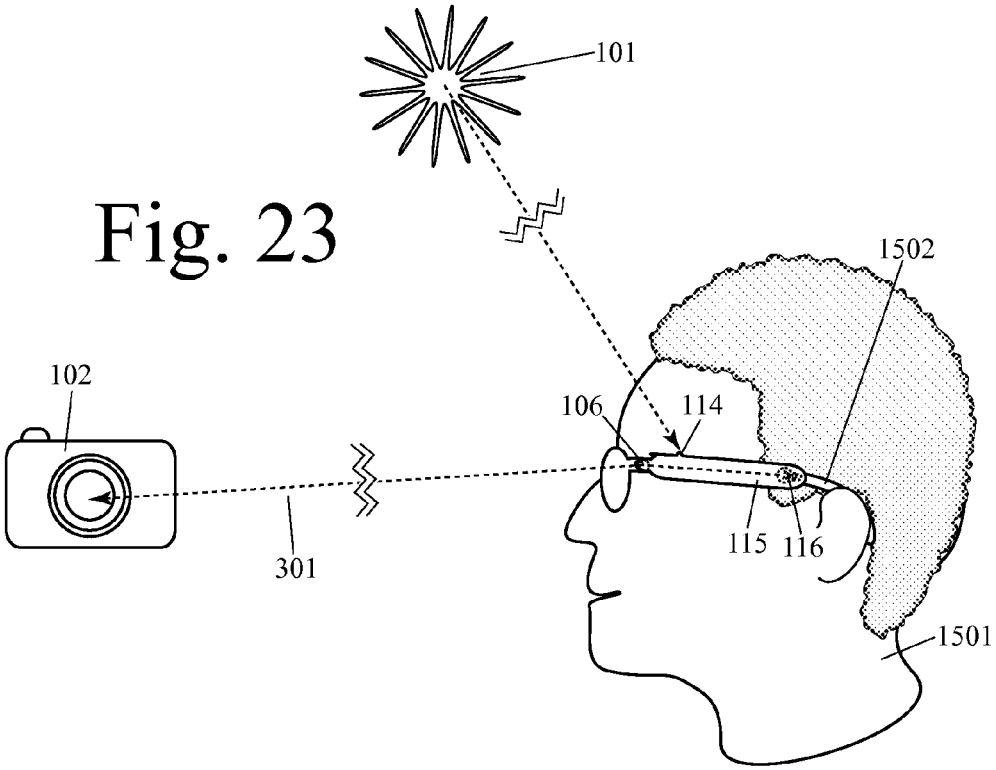
Figure 24:
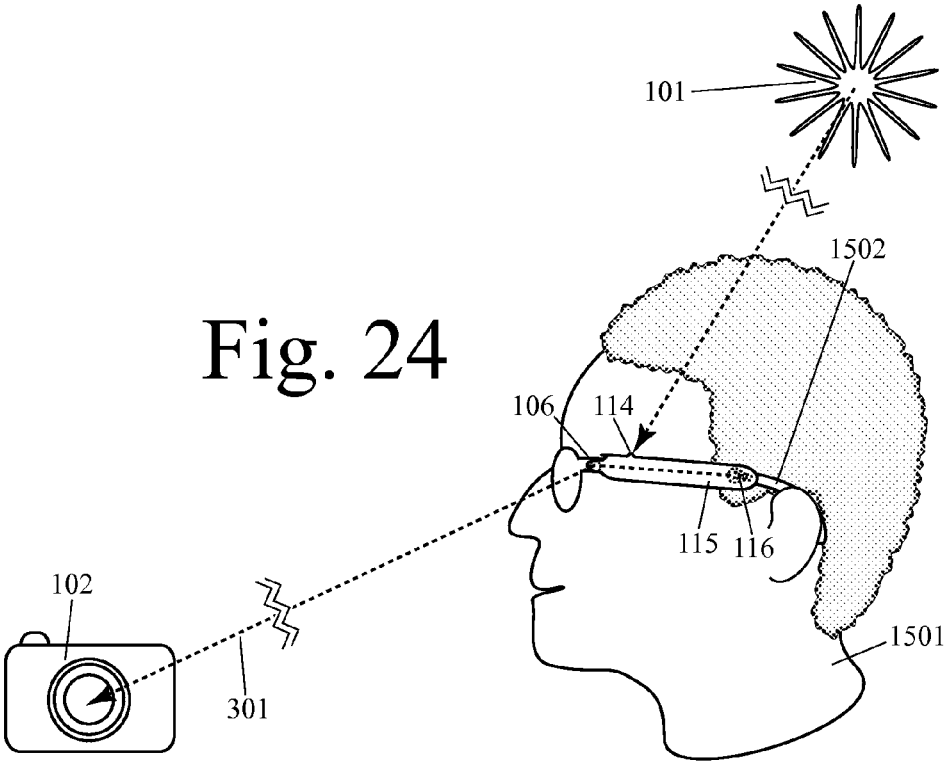

The core device of the example of this invention that is shown in FIGS. 23 and 24 is the same as the device shown in FIGS. 13 and 14. The difference in FIGS. 23 and 24 is that these figures now show an example of how this core device can look and function in anatomical context, as wearable technology eyewear. Specifically, FIGS. 23 and 24 show the core device shown in FIGS. 13 and 14 having been incorporated into, or attached to, eyewear 1502 which is worn by person 1501.

The example of the device shown in FIGS. 23 and 24 does not harvest ambient light. This example relies only on light energy from wearable light source 116 to disrupt unwelcome photography. This example still includes an overall ambient light sensor 114 so that the amount of power sent to wearable light source 116 is no more than the amount of power required to produce sufficient light to disrupt unwelcome photography by proximal imaging device 102. In an example, a relatively low level of power can be sent to wearable light source 116 in dim ambient light conditions and a relatively high level of power can be sent to wearable light source 116 in bright ambient light conditions. Tailoring power and light strength to ambient light conditions can help to conserve power used by the device so that it does not have to be recharged as often.

9. Detailed Description of FIGS. 25 Through 33

FIGS. 25 through 33 show more examples of how this invention can be embodied in a wearable device for disrupting unwelcome photography, but these examples do not limit the full generalizability of the claims. In particular, FIGS. 25 through 33 show examples of how this invention can be embodied in a wearable device for disrupting unwelcome photography that can be worn in a manner similar to a hat, a necklace, or a hearing aid.

Figure 25:
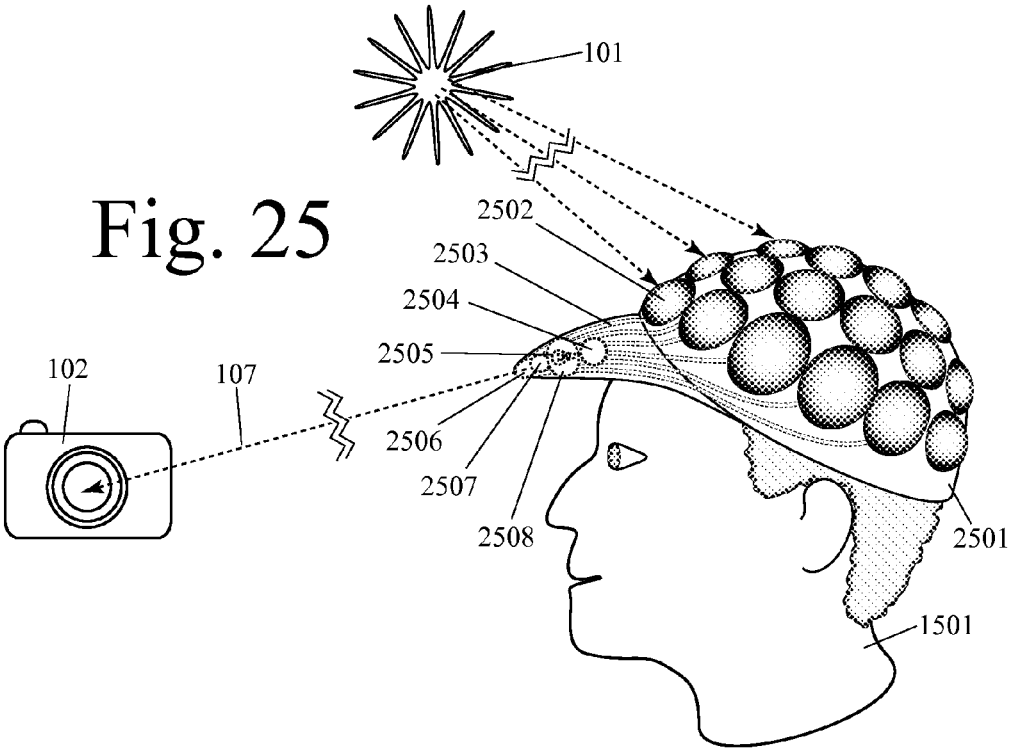
Figure 26:
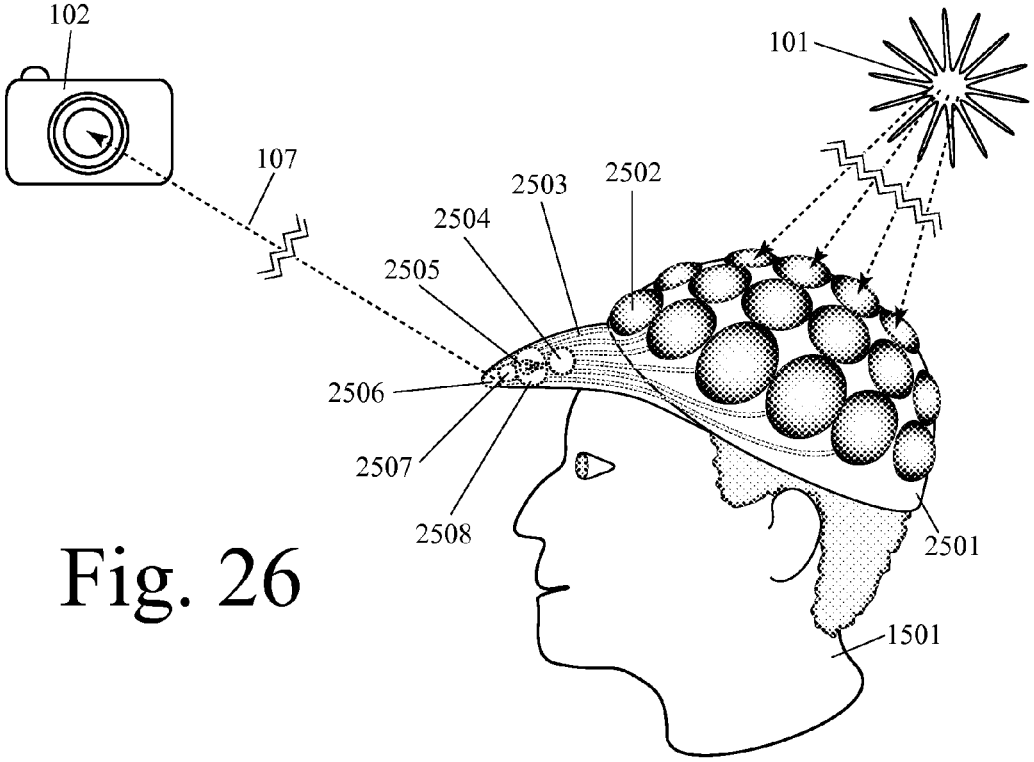

FIGS. 25 and 26 show an example of a wearable device for disrupting unwelcome photography that can be worn by person 1501 like a hat. In this example, the type of hat is like a baseball cap 2501. In this example, the upper dome of cap 2501 harvests light energy 2506 from ambient light source 101 and the brim of the baseball cap directs light energy 107 toward proximal imaging device 102. In this example, ambient light source 101 is the sun and proximal imaging device 102 is a camera.

In this example, the upper dome of baseball cap 2501 includes a multi-angle inbound light guide. This multi-angle inbound light guide is comprised of an array of lenses (including lens 2502) which harvest ambient light from different angles without moving relative to cap 2501. In an example, each of these multiple lenses (including lens 2502) can have a spherical shape. In an example, each of these lenses can have a hemispherical or parabolic shape. In other examples, the upper dome of baseball cap 2501 can have a plurality of other optical members selected from the group consisting of: optical fibers, mirrors, prisms, and metamaterial light guides. These optical members can harvest ambient light from different angles without moving relative to the cap.

To be blunt, the array of lenses in the cap-like example shown in FIGS. 25 and 26 are large and peculiar looking. In an example, a multi-angle inbound light guide on the upper dome of a cap can have a larger number of smaller light-guiding components which do not look so strange. In an example, optical members can be better integrated into the fabric and/or structure of the cap so that they are less-conspicuous and more fashionable. On the other hand, the odd-looking cap-like example shown in FIGS. 25 and 26 might fit right in at many sports events, especially if it is made in team colors.

In the cap-like example that is shown in FIGS. 25 and 26, light that is harvested by the lens array (including lens 2502) is channeled toward the brim of the cap via an array of flexible light channels (including channel 2503). In an example, these flexible light channels are fiber optic cables. In other examples, these light channels can be nanotube or metamaterial channels. In this example, the harvested light rays which are channeled through the array of flexible light channels converge at outbound light guide 2506. In an example, flexible light channels can be attached to the inside of baseball cap 2501. In an example, flexible light channels (including 2503) can be woven or otherwise integrated into the fabric used to make cap 2501.

In the example shown in FIGS. 25 and 26, outbound light guide 2506 is moved by outbound light guide mover 2507 so that the merged light rays 107 are directed toward proximal imaging device 102. In a simpler example, an outbound light guide may not move with respect to the rest of the cap. In such a simpler example, person 1501 would have to move their head in order to aim beam of light 107 toward proximal imaging device 102.

If there is insufficient harvested light from ambient light sources to disrupt unwelcome photography by proximal imaging device 102, then this cap-like device can activate wearable light source 2505 to supplement or replace light energy from ambient light sources. The cap-like example that shown in FIGS. 25 and 26 also includes data processing unit 2507, wireless communication unit 2508, and power source unit 2504.

One advantage of a cap-like embodiment of this device, such as the example shown in FIGS. 25 and 26, is that the upper dome of the cap provides a surface area with an upward orientation that can easily harvest ambient light from ambient light sources located above (such as the sun or overhead artificial lights). Another advantage is that a head-level outbound light guide is well-positioned to disrupt a proximal image device that another person is wearing on their head (such as electronic-imaging eyewear). A cap may also appeal to someone who does not want to wear special glasses. However, one disadvantage of a cap-like embodiment is that there are many people who do not like to wear hats. Also, there are many occasions when wearing a hat can be unconventional or disrespectful.

Figure 27:
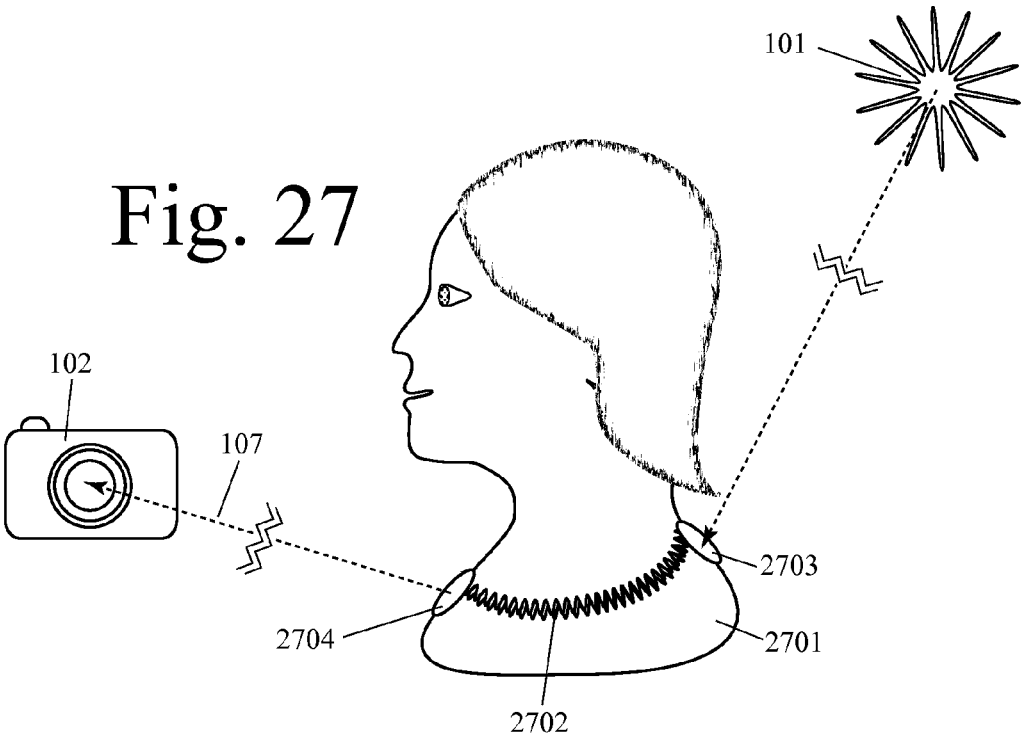
Figure 28:
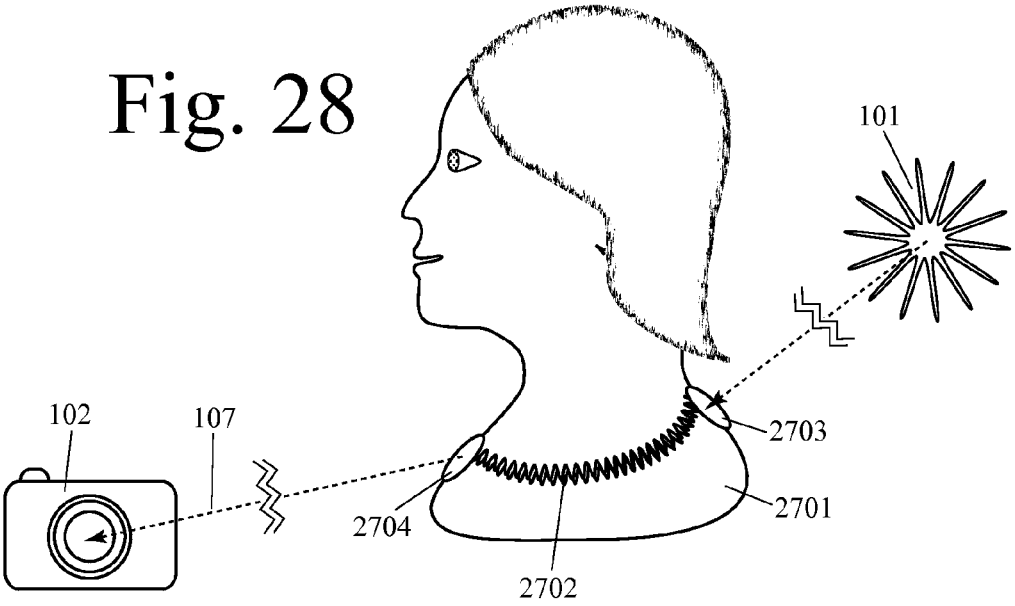

FIGS. 27 and 28 show a very simple example of a wearable device for disrupting unwelcome photography that is worn by person 2701 like a necklace. In this necklace example, an inbound light guide 2703 hangs like a pendant on the back portion of the necklace. Inbound light guide 2703 harvests light energy from ambient light source 101 and this light energy is channeled to the front portion of the necklace via optical fibers 2702 which are part of the necklace chain. This harvested light energy is then released toward proximal imaging device 102 by outbound light guide 2704 which hangs like a pendant on the front portion of the necklace.

The necklace example shown in FIGS. 27 and 28 can include other components such as those shown in previous figures. In an example, these other components can include a wearable light source if there is insufficient light harvested from ambient light sources to disrupt photography. In an example, the necklace example shown in FIGS. 27 and 28 can also include light guide movers. In an example, necklace example in FIGS. 27 and 28 can also include an ambient light source tracker and a proximal imaging device tracker. In an example, this necklace example can also include a data processing unit, wireless communication unit, and power source. In an example, the necklace example shown in FIGS. 27 and 28 can be activated by having person 2701 tap outbound light guide 2704.

FIGS. 29 through 32 show another example of a wearable device for disrupting unwelcome photography that is worn like a hat. In this example, the hat-like device worn by person 2901 has a circular brim 2903 around the entire lower circumference of the hat. In this hat-like example, the device has a plurality of inbound light guides 2904 which comprise a wide band around the lower portion of the upper dome 2902 of the hat. In this example, these inbound light guides are arranged in four rings around the lower portion of the upper dome 2902 of the hat. In this example, these inbound light guides 2904 are lenses. In other examples, these inbound light guides can be selected from the group consisting of: optical fibers, mirrors, prisms, and metamaterial channels. In this example, these inbound light guides 2904 can harvest light energy from one or more ambient light sources (such as ambient light source 101) from multiple angles without moving relative to the hat.

In this hat-like example, the device has a plurality of outbound light guides 2905 around the circumference of brim 2903 of the hat. These outbound light guides 2905 direct one or more beams of light 2907 outwards from the hat circumference in a radial or spoke manner. In an example, a rotating beam of light 2907 can be created by sequential activation of outbound light guides around the circumference of brim 2903. In some respects, sequential activation of outbound light guides around the circumference of brim 2903 creates an effect that is analogous to theater marquee lights. In some respects, sequential activation of outbound light guides around the circumference of brim 2903 creates a rotating beam of light similar that created by a lighthouse. In some respects, sequential activation of outbound light guides around the circumference of brim 2903 creates a rotating beam of light 2907 similar to the sweeping beam of radiant energy emitted by a radar system or sonar system.

Figure 29:
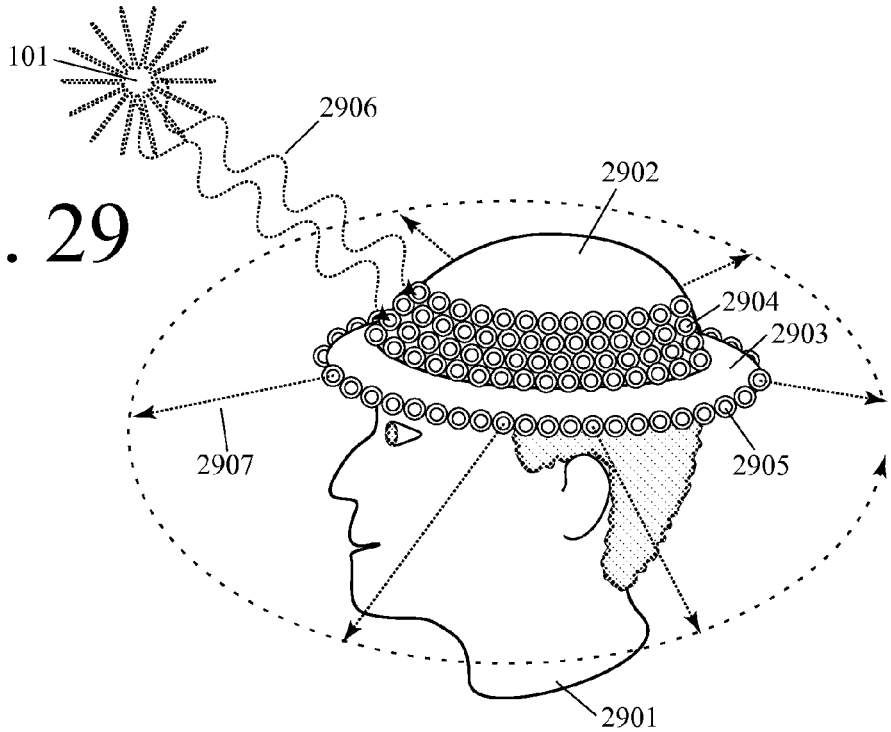

As shown in FIG. 29, a rotating beam of light 2907 can be moved around a hat in a clockwise (or counterclockwise) direction when no proximal imaging device is detected. In an example, when a proximal imaging device is detected, this rotation stops and a single beam of light is directed continuously towards the proximal imaging device. In an example, a proximal imaging device can be detected by reflection of a rotating beam of light off an interior or exterior surface of the proximal imaging device. In some respects, this is analogous to the operation of a radar system or a sonar system in which a rotating beam of energy is used to radially sweep an area and detection of an object of interest occurs when the rotating beam of energy is reflected back to its source.

FIG. 29 shows a hat-like example of this invention in operation when no proximal imaging device has been detected. In this example in this situation, radially sweeping beam of light 2907 rotates clockwise around the hat as it is emitted by a circumferential sequence of outbound light guides 2905. In some respects, this is analogous to the sweeping beam of energy in the operation of a lighthouse, radar system, or sonar system. In this example, light energy 2906 is harvested from ambient light source 101 by a plurality of inbound light guides 2904. Harvested light energy is channeled to outbound light guides 2905 from which it is emitted radially outwards as beam of light 2907.

In the example shown in FIG. 29, a plurality of inbound light guides 2904 are configured in rings around the lower portion of upper dome 2902 of the hat. In an example, a plurality of inbound light guides can cover the entire upper dome of a hat. In this example, the outbound light guides 2905 are located around the brim 2903 of a hat. In an example, outbound light guides can be located on the upper dome 2902 of a hat. In this example, both the inbound light guides and outbound light guides are stationary with respect to the hat. In other examples, inbound light guides and/or outbound light guides can move with respect to the hat to better track an ambient light source and/or proximal imaging device.

Figure 30:
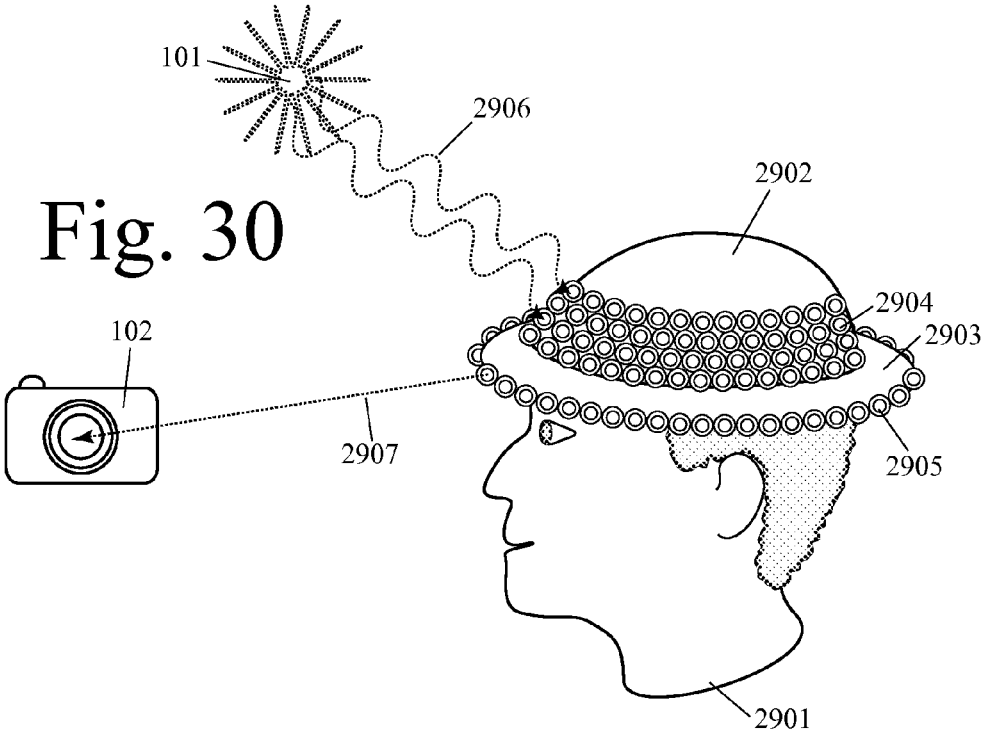

FIG. 30 shows how the clockwise rotation of light beam 2907 stops and this light beam is directed continuously at proximal imaging 102 when this imaging device has been detected. In an example, proximal imaging device 102 can be detected by retroreflection of light beam 2907 off an interior or exterior surface of proximal imaging device 102. Light beam 2907 can rotate around the hat until it is reflected off a proximal imaging device, at which time rotation stops and light beam 2907 remains directed at the location from which reflection has been detected. In some respects, this is analogous to how objects are detected with a rotating sweeping beam of radiant energy in radar or sonar systems.

Detecting a proximal imaging device by beam reflection can be challenging. However, one advantage of a hat-based embodiment of this invention is that it is worn at head level. Accordingly, is likely to be in a similar horizontal plane as a proximal imaging device (such as eyewear with an embedded camera) which someone else wears at head level. In an example, a hat-like wearable device for disrupting unwelcome photography is well-positioned to detect and disrupt a wearable or hand-held proximal imaging device that is in a horizontal plane between 4-6 feet above ground level.

A second advantage of a hat-like wearable device for disrupting unwelcome photography is that it offers a relatively large upward-facing surface from which to harvest ambient light with an array of inbound light guides. One can harvest ambient light using other wearable embodiments (such as eyewear, a necklace, or earwear) but there is generally less upward-facing surface area from which to harvest ambient light. A third advantage of a hat-like wearable device is that it is relatively easy to direct a beam of light in any radial or spoke direction, including a completely rotating beam of light analogous to a lighthouse, radar system, or sonar system. This can be more difficult with an eyewear, necklace, or earwear embodiment.

Figure 31:
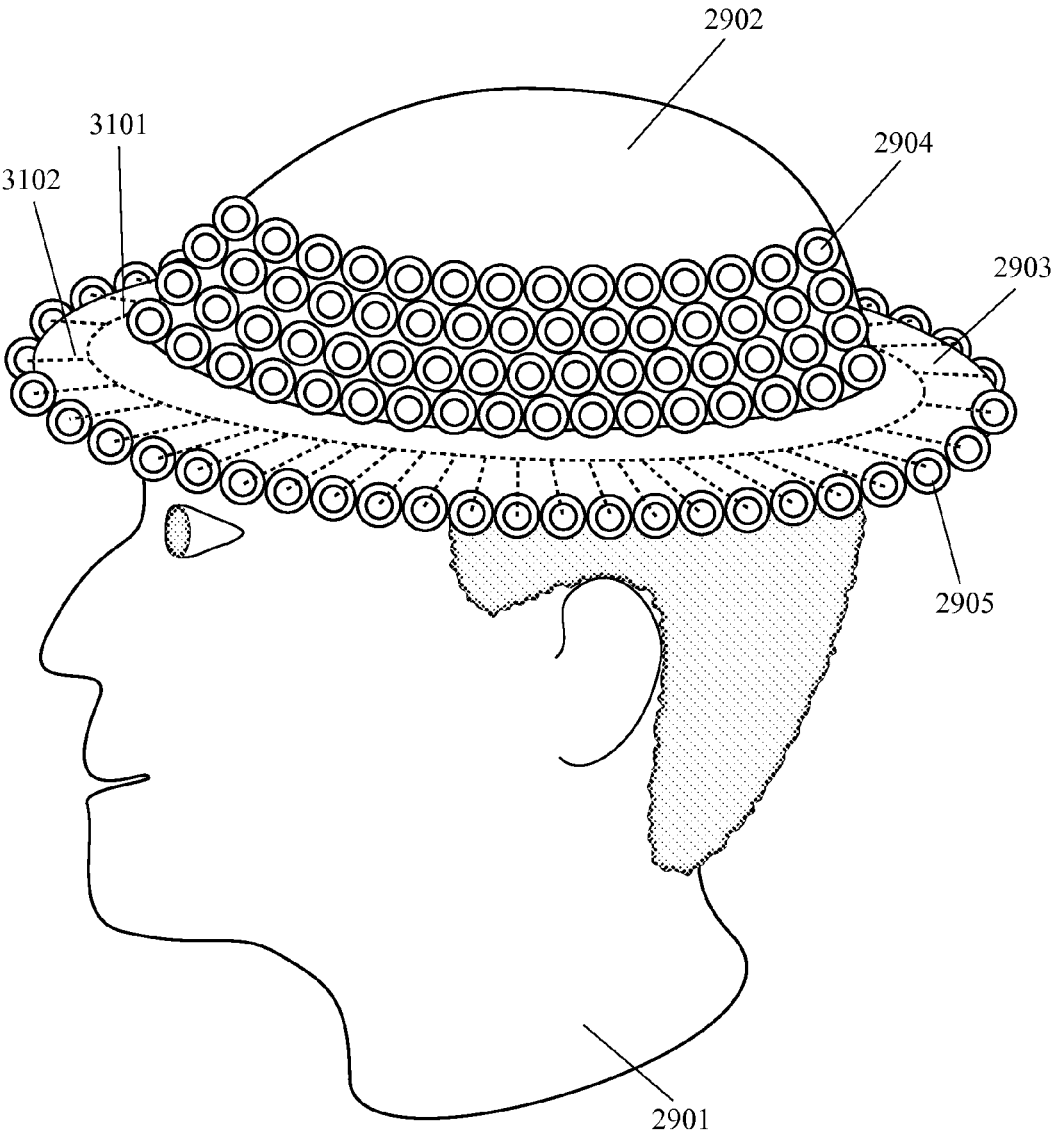
Figure 32:
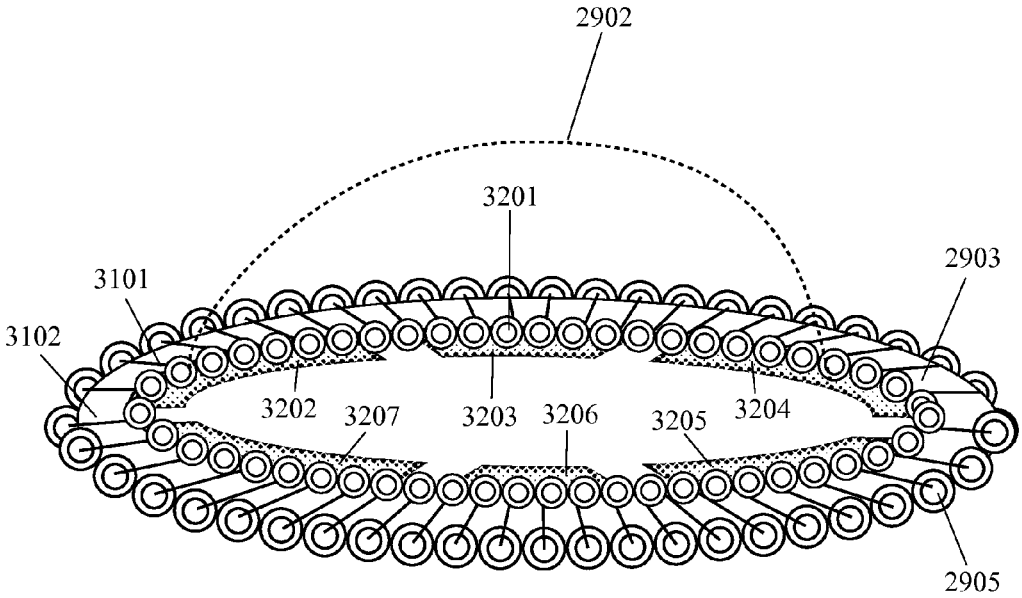

FIGS. 31 and 32 show examples of interior component details for the full-brim hat-like device that was introduced in FIGS. 29 and 30. These interior components were not visible in the opaque view of the device shown in FIGS. 29 and 30. FIG. 31 shows a plurality of internal light channels 3102 that are arrayed like radial spokes around the brim 2903 of the hat. In an example, these internal light channels 3102 channel harvested ambient light from the inbound light guides 2904 around the upper dome 2902 of the hat to the outbound light guides 2905 around the brim 2903 of the hat.

FIG. 32 may look like a UFO, but it really shows a plurality of wearable light sources 3201 around the inner ring of hat brim 2903. In an example, wearable light sources 3201 can be LEDs. In an example, wearable light sources 3201 can be used to create light energy for emission from the outbound light guides 2905 when harvested ambient light is insufficient to disrupt unwelcome photography by a proximal imaging device. FIG. 32 also shows locations for other possible interior components of this hat-like embodiment of this invention. These interior components include: data processing unit 3202, wireless communication unit 3203, power source 3204, light sensor 3205, motion sensor 3206, and GPS unit 3207.

In various examples, a wearable device for disrupting unwelcome photography can comprise a privacy-enhancing cap, hat, or headband. Such a hat-like device can harvest ambient sunlight or artificial light and redirect this light toward one or more proximal imaging devices. In an example, a radial or hemispherical array of inbound light guides can encircle the upper portion of a hat to harvest ambient light from multiple directions. Such a device can also have one or more internal wearable light sources to supplement harvested ambient light if harvested ambient light is insufficient to disrupt unwelcome photography. In an example, such a device can combine harvested ambient light energy with light energy wearable light sources to disrupt photography by a proximal imaging device.

In an example, a hat-like device can also have an array of outbound light guides which direct beams of light along different radial vectors to disrupt photography. In an example, a hat can emit a rotating beam of light (in a manner like a light house, radar system, or sonar system) to disrupt imaging devices from multiple angles. In an example, a hat-like device can have a single stationary outbound light guide which directs a beam of light in one direction. In an example, a hat-like device can have a single moving outbound light guide which can direct a beam of light in different directions.

In an example, a hat can send out a beam of light along a changing vector, wherein the polar coordinate of this vector with respect to the center of the hat changes over time. In an example, a hat can send out a beam of light along a changing vector, wherein the longitudinal and/or latitudinal coordinates of this vector with respect to the center of the hat change over time. In an example, sending out a beam of light with a changing vector can result in flashes or pulses of light which disrupt imaging by one or more proximal imaging devices. In an example, the rotational speed of a changing light-ray vector can be sufficiently rapid and the flash duration can be sufficiently short that the flashes disrupt imaging by a proximal imaging device without substantive detection by a human eye.

In an example, a hat can have multiple stationary outbound light guides whose ends are distributed around the circumference of the hat and which flash in a radially-rotating manner. In an example, a hat can have a single moving outbound light guide which rotates and thus flashes around the hat in a radially-rotating manner. In an example, a hat can have a spinning Fresnel lens which directs a beam of light outwards from the hat in a radially-rotating manner. In an example, a hat can have a spinning parabolic mirror which directs a beam of light outwards from the hat in a radially-rotating manner.

In an example, an outbound light guide incorporated into a hat-like device can be moved directly and manually by movement of the wearer's head. In an example, a person wearing a hat-like device can directly aim an outbound light guide by moving their head. In an example, a person wearing a hat-like device can aim an outbound light guide using a hand-held device which is in wireless communication with the hat-like device. In an example, a person wearing a hat-like device can aim an outbound light guide by giving voice commands such as "Camera at 3 O'clock." or "Camera straight ahead."

Figure 33:
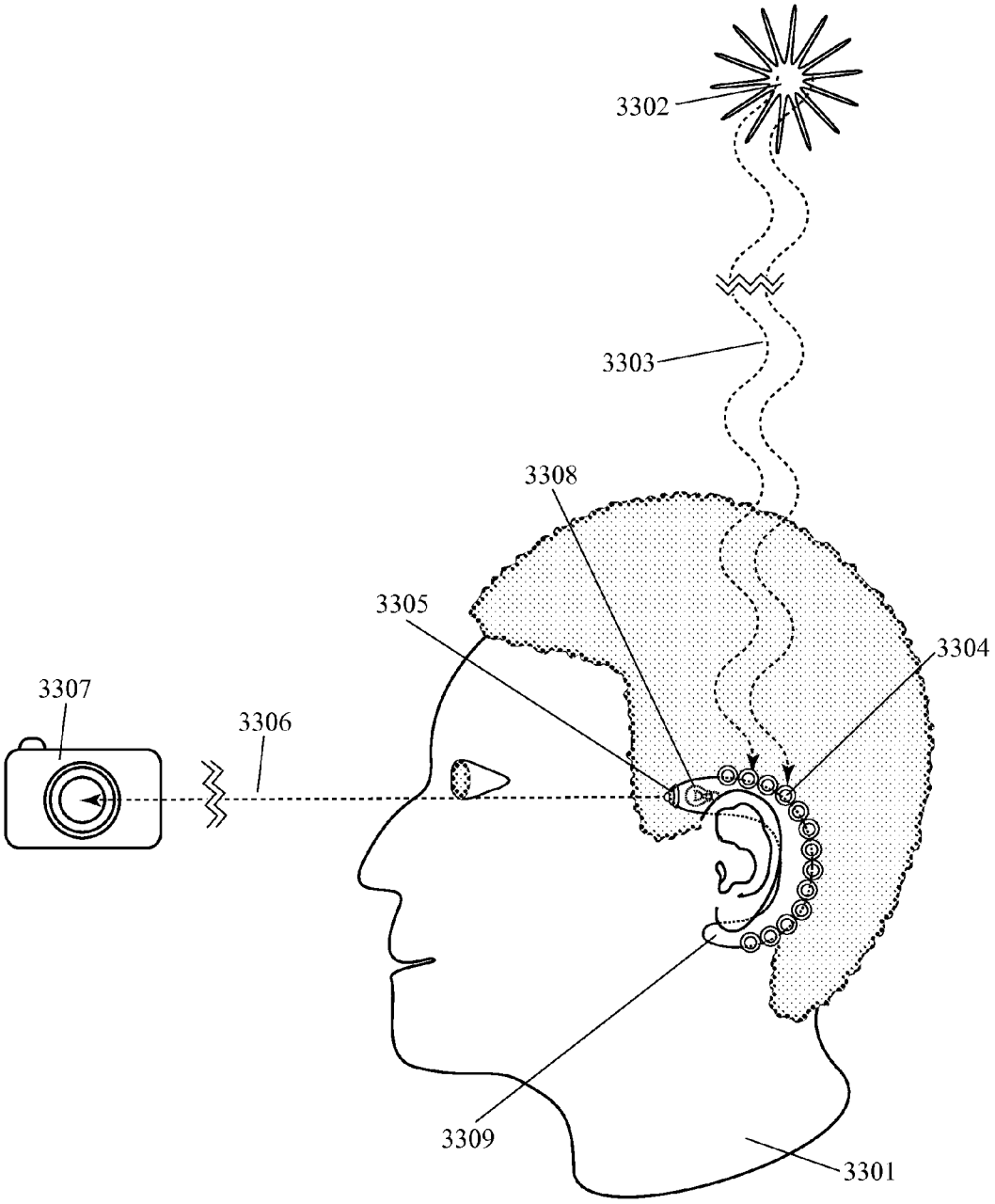

FIG. 33 shows an example of how this invention can be embodied in a wearable device for disrupting unwelcome photography that is worn like earwear. In an example, earwear is worn around, worn over, or inserted into one or both ears. In an example, devices that emit beams of light and are worn around an ear can be called "light loops." FIG. 33 shows an example of how a wearable device for disrupting unwelcome photography can be embodied in a light loop that is worn by person 3301.

In the example shown in FIG. 33, a light loop includes a "C"-shaped device housing 3309 (reflected around its vertical axis in this view) which is worn around the person's ear. In this example, light rays 3303 from ambient light source 3302 are harvested by an array of inbound light guides 3304. In this example, the array of inbound light guides 3304 are located around the outer rim of "C"-shaped device housing 3309. In this example, inbound light guides 3304 are lenses. In other examples, inbound light guides 3304 can be optical fibers, mirrors, prisms, nanotube light channels, or metamaterial light channels.

In the example shown in FIG. 33, ambient light energy 3303 harvested by inbound light guides 3304 is directed, refracted, reflected, and/or channeled into outbound light guide 3305. In this example, outbound light guide 3305 has been oriented by movement of the person's head so that it directs this light energy, in the form of a beam of light 3306, toward proximal imaging device 3307. When this beam of light hits proximal imaging device 3307, it disrupts unwelcome photography by that device. The example shown in FIG. 33 also includes an internal wearable light source 3308 in case there is insufficient harvested ambient light to disrupt unwelcome photography. In an example, wearable light source 3308 can be an LED.

In this example, inbound light guides 3304 and outbound light guide 3305 do not move with respect to housing 3309. In this example, inbound light guides 3304 comprise a multi-angle inbound light guide array that is capable of harvesting ambient light from multiple angles. However, in this example, outbound light guide 3305 must be directed toward a proximal imaging device by the person moving their head. This design has the advantages of simplicity (no moving parts) and giving the person 3301 complete control over the direction of the photography-disrupting beam of light.

However, if more automation is desired, then mechanisms can be added to a light loop in order to automatically detect and track an ambient light source, a proximal imaging device, or both. In an example, a light loop such as the one shown in FIG. 33 can also include one or more components selected from the group consisting of: ambient light source tracker, inbound light guide mover, proximal imaging device tracker, and outbound light guide mover. In various examples, other components can be includes in a light loop such as the one shown in FIG. 33. These other components can be selected from the group consisting of: speaker, microphone, data processing unit, wireless communication unit, rechargeable power source, light sensor, motion sensor, and GPS unit. In an example, such a device can be integrated into headphones, ear buds, or hearing aids.

In an example, a pair of light loops worn on both ears can direct two different beams of light toward a proximal imaging device such that the two beams intersect at the location of a proximal imaging device. In an example, the intersection of these two beams of light can interact in a synergistic manner to disrupt photography. In an example, an outbound light guide incorporated into a light loop can be moved remotely by wireless communication with a hand-held device. In an example, an outbound light guide on light loop can be moved by recognizing voice commands by the person wearing the light loop.

10. Detailed Description of FIGS. 34 Through 40

FIGS. 34 through 40 show examples of how this invention can be embodied in a method for disrupting unwelcome photography, but these examples do not limit the full generalizability of the claims.

Figure 34:
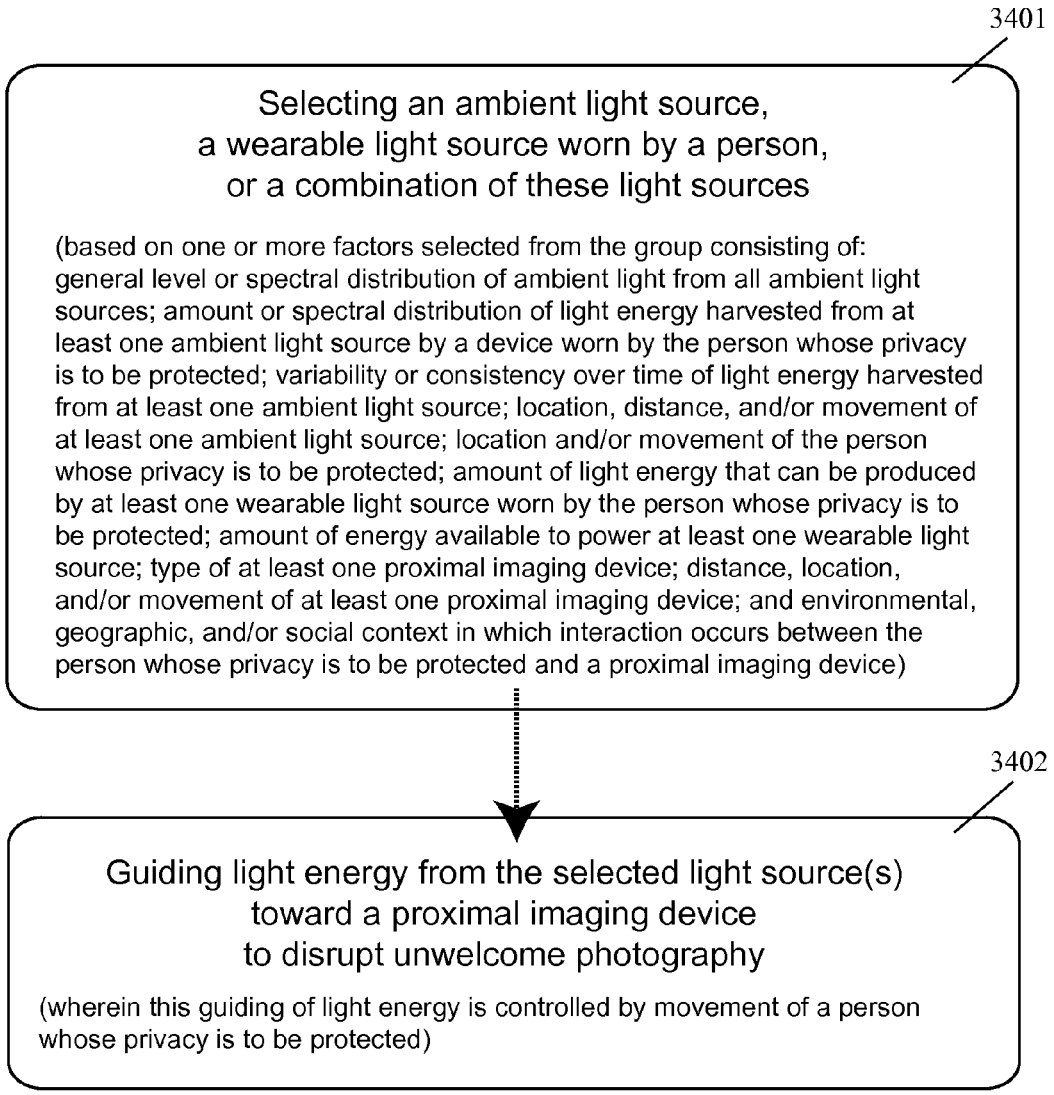

FIG. 34 shows an example of a method for disrupting unwelcome photography comprising: (3401) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (3402) guiding light energy from the selected light source(s) toward a proximal imaging device to disrupt unwelcome photography (wherein this guiding of light energy is controlled by movement of a person whose privacy is to be protected).

Figure 35:
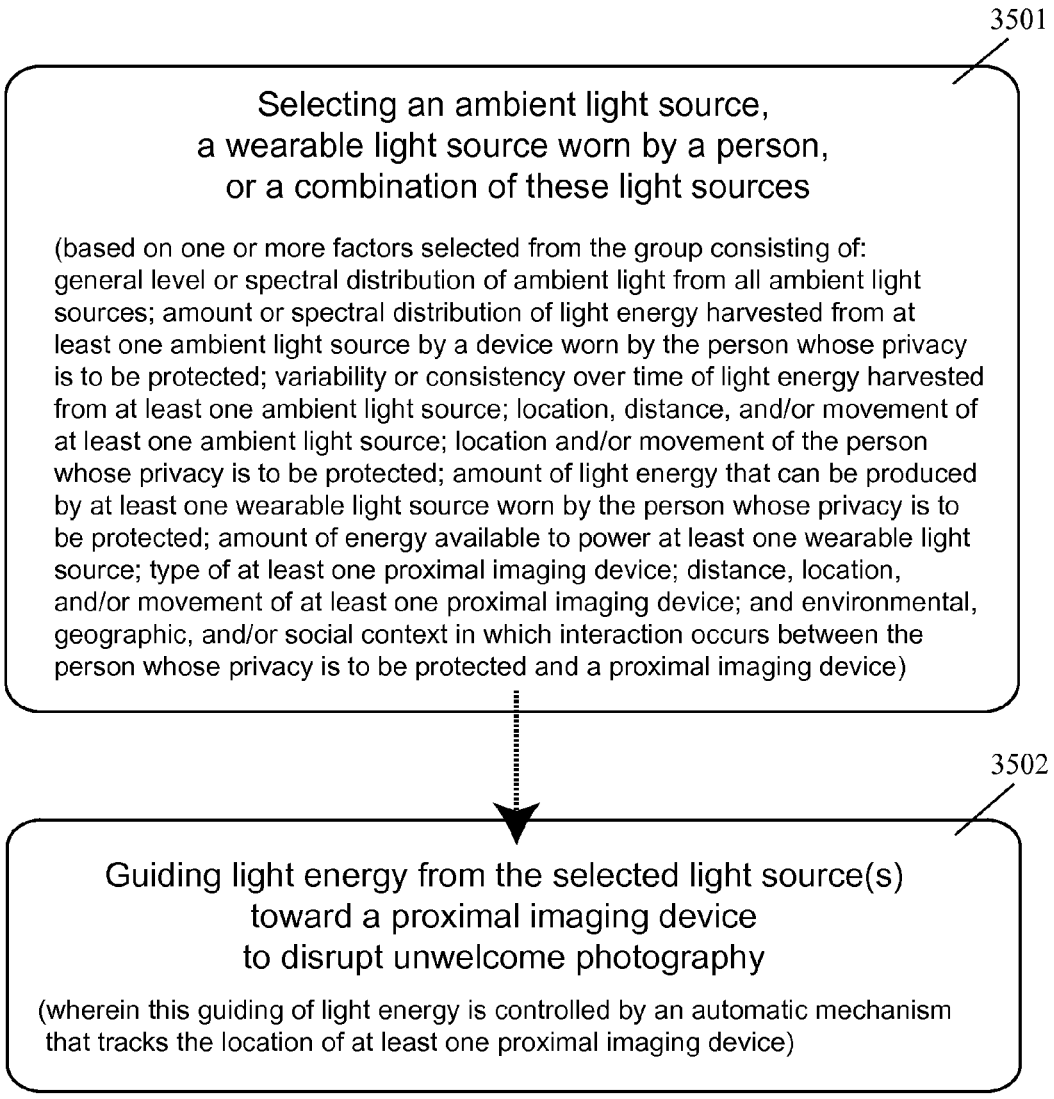

FIG. 35 shows an example of a method for disrupting unwelcome photography comprising: (3501) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (3502) guiding light energy from the selected light source(s) toward a proximal imaging device to disrupt unwelcome photography (wherein this guiding of light energy is controlled by an automatic mechanism that tracks the location of at least one proximal imaging device).

Figure 36:
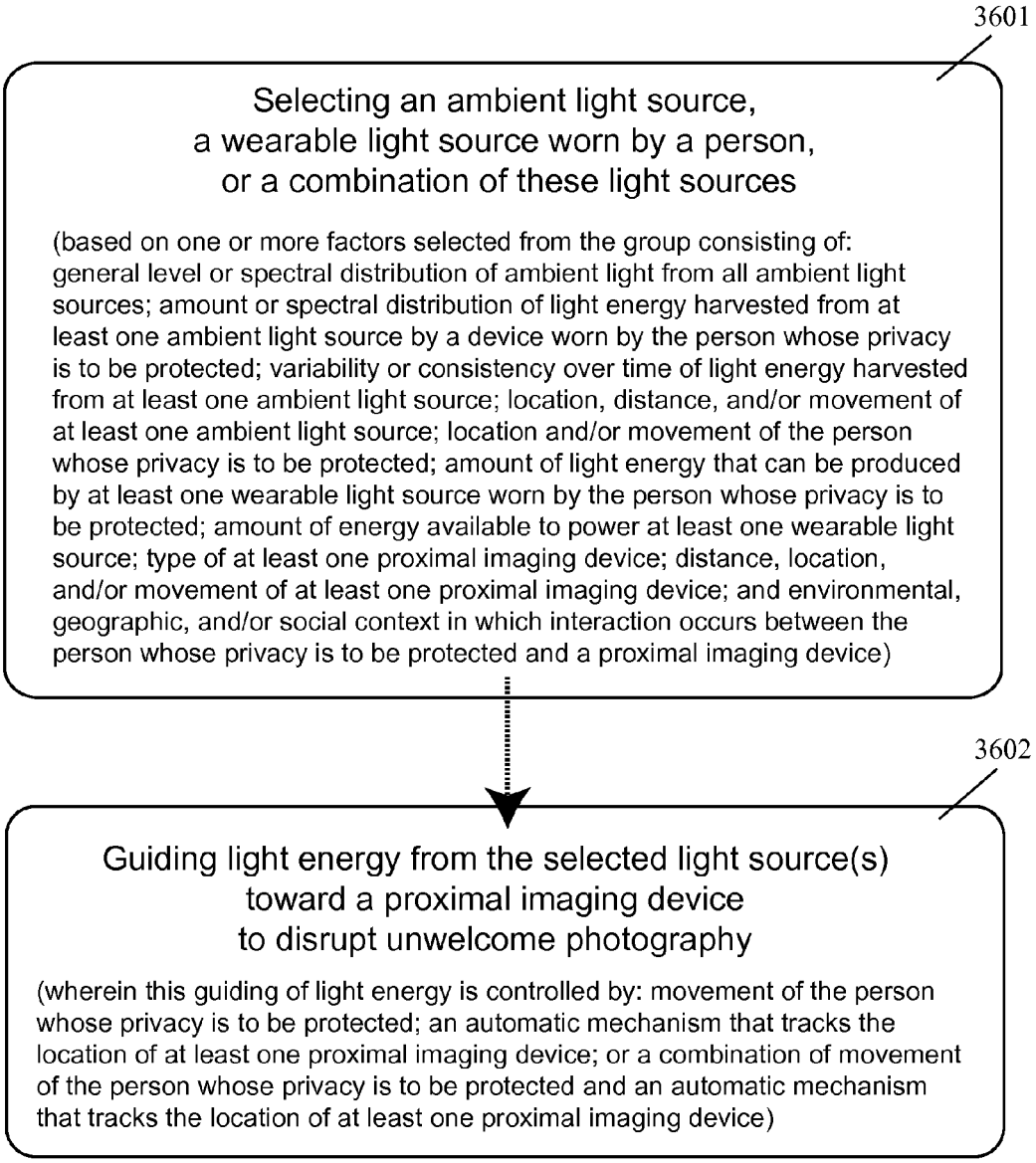

FIG. 36 shows an example of a method for disrupting unwelcome photography comprising: (3601) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (3602) guiding light energy from the selected light source(s) toward a proximal imaging device to disrupt unwelcome photography (wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device).

Figure 37:
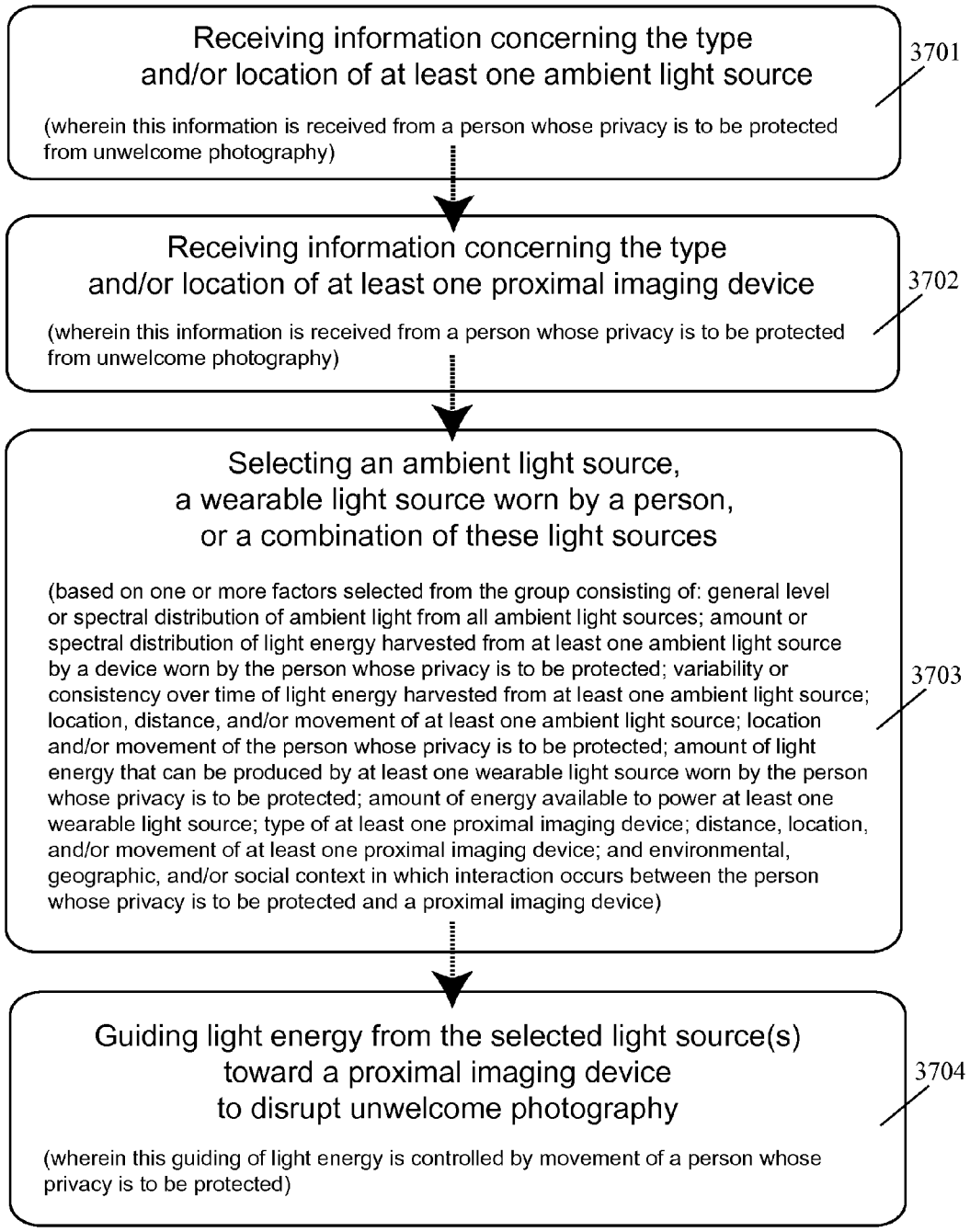

FIG. 37 shows an example of a method for disrupting unwelcome photography comprising: (3701) receiving information concerning the type and/or location of at least one ambient light source (wherein this information is received from a person whose privacy is to be protected from unwelcome photography); (3702) receiving information concerning the type and/or location of at least one proximal imaging device (wherein this information is received from a person whose privacy is to be protected from unwelcome photography); (3703) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (3704) guiding light energy from the selected light source(s) toward a proximal imaging device to disrupt unwelcome photography (wherein this guiding of light energy is controlled by movement of a person whose privacy is to be protected).

Figure 38:
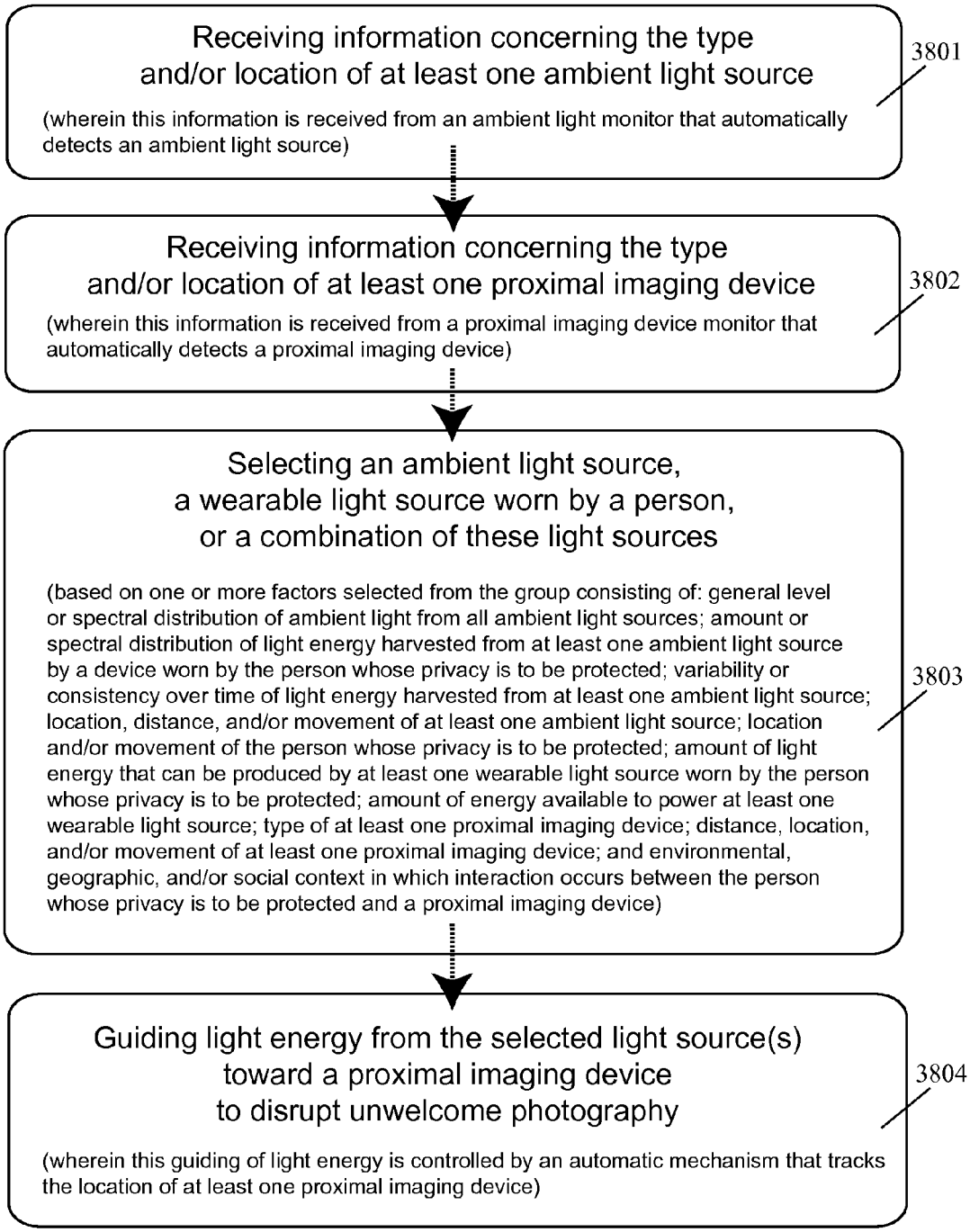

FIG. 38 shows an example of a method for disrupting unwelcome photography comprising: (3801) receiving information concerning the type and/or location of at least one ambient light source (wherein this information is received from an ambient light monitor that automatically detects an ambient light source); (3802) receiving information concerning the type and/or location of at least one proximal imaging device (wherein this information is received from a proximal imaging device monitor that automatically detects a proximal imaging device); (3803) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (3804) guiding light energy from the selected light source(s) toward a proximal imaging device to disrupt unwelcome photography (wherein this guiding of light energy is controlled by an automatic mechanism that tracks the location of at least one proximal imaging device).

Figure 39:
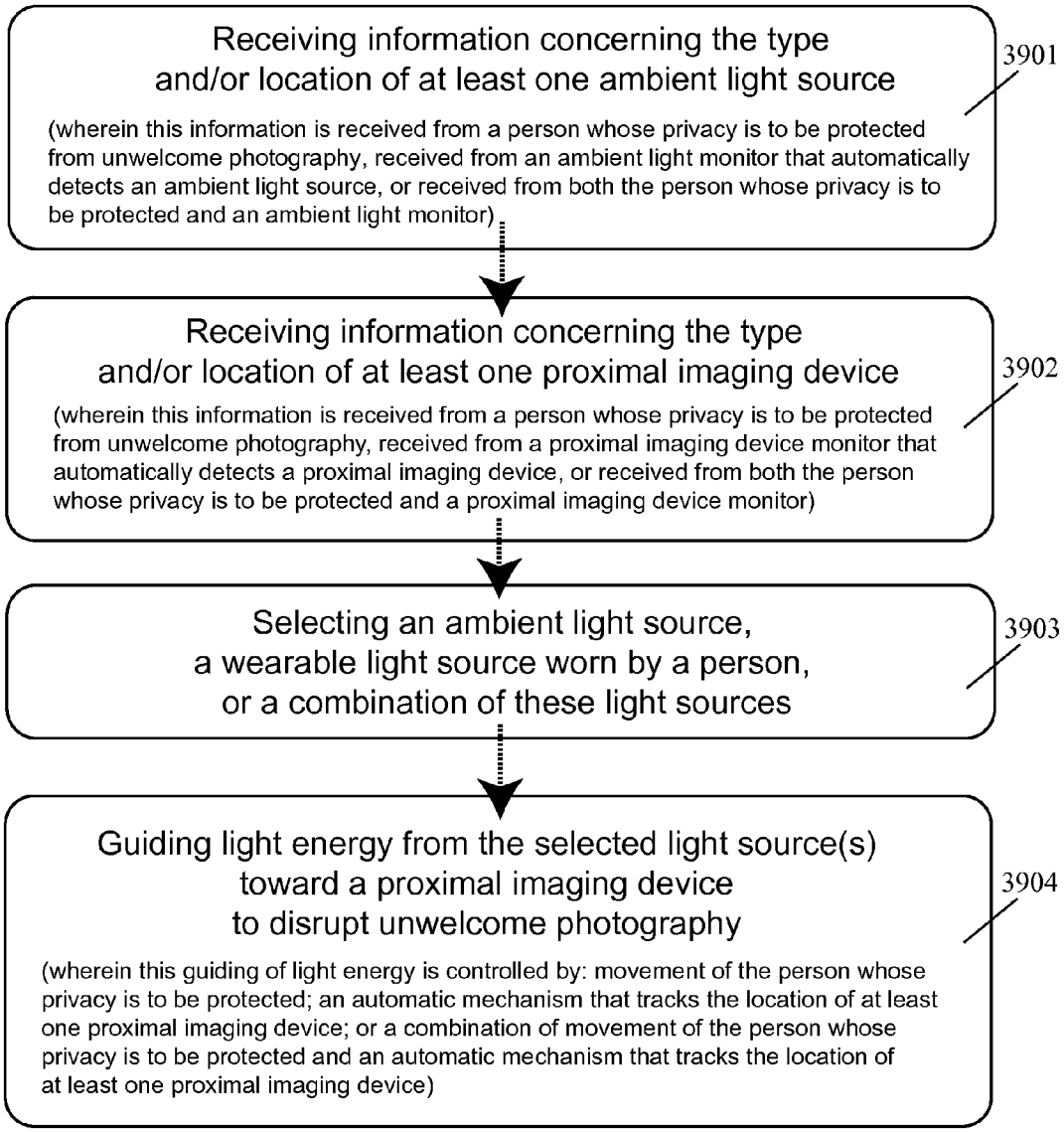

FIG. 39 shows an example of a method for disrupting unwelcome photography comprising: (3901) receiving information concerning the type and/or location of at least one ambient light source (wherein this information is received from a person whose privacy is to be protected from unwelcome photography, received from an ambient light monitor that automatically detects an ambient light source, or received from both the person whose privacy is to be protected and an ambient light monitor); (3902) receiving information concerning the type and/or location of at least one proximal imaging device (wherein this information is received from a person whose privacy is to be protected from unwelcome photography, received from a proximal imaging device monitor that automatically detects a proximal imaging device, or received from both the person whose privacy is to be protected and a proximal imaging device monitor); (3903) selecting an ambient light source, a wearable light source worn by a person, or a combination of these light sources; and (3904) guiding light energy from the selected light source(s) toward a proximal imaging device to disrupt unwelcome photography (wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device).

Figure 40:
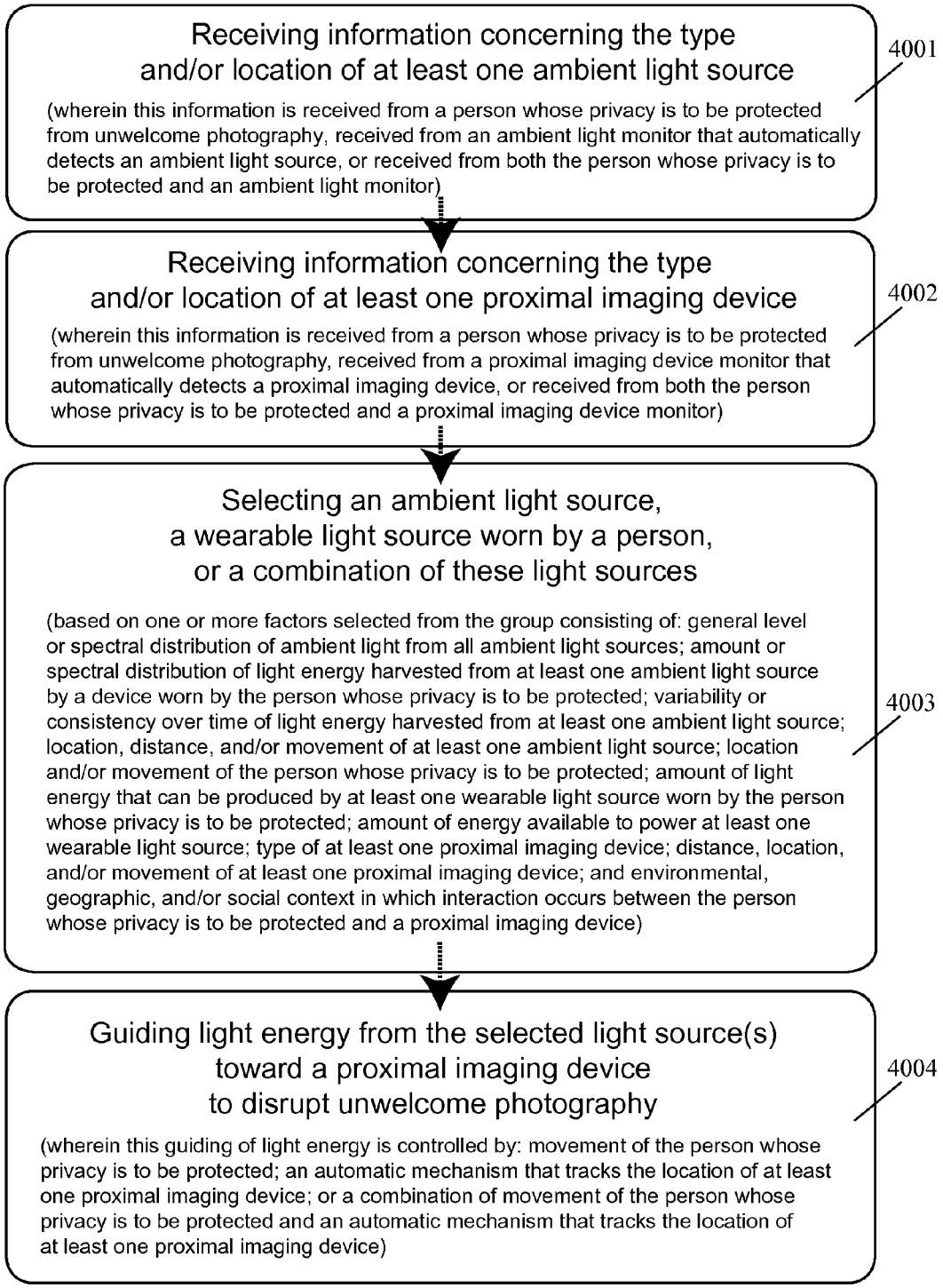

FIG. 40 shows an example of a method for disrupting unwelcome photography comprising: (4001) receiving information concerning the type and/or location of at least one ambient light source (wherein this information is received from a person whose privacy is to be protected from unwelcome photography, received from an ambient light monitor that automatically detects an ambient light source, or received from both the person whose privacy is to be protected and an ambient light monitor); (4002) receiving information concerning the type and/or location of at least one proximal imaging device (wherein this information is received from a person whose privacy is to be protected from unwelcome photography, received from a proximal imaging device monitor that automatically detects a proximal imaging device, or received from both the person whose privacy is to be protected and a proximal imaging device monitor); (4003) selecting an ambient light source, a wearable light source worn by a person, or a combination of these light sources (based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device); and (4004) guiding light energy from the selected light source(s) toward a proximal imaging device to disrupt unwelcome photography (wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device).

11. Device Embodiments for Disrupting Unwelcome Photography

Based on the figures and associated discussion of examples herein, this invention can be embodied in the following examples of a wearable device for disrupting unwelcome photography.

In an example, this invention can be embodied in a wearable device for disrupting unwelcome photography in order to protect a person's privacy comprising: (a) a wearable light source that is worn by a person whose privacy is to be protected from unwelcome photography; (b) an inbound light guide that harvests, refracts, reflects, focuses, directs, and/or guides light energy from an ambient light source; (c) a light sensor; (d) a data processing unit that uses results from the light sensor in order to select and/or adjust the use of light energy from the wearable light source, the use of light energy from the ambient light source, or the use of light energy from both the wearable light source and the ambient light source in order to disrupt unwelcome photography by the proximal imaging device; and (e) an outbound light guide that refracts, reflects, focuses, directs, and/or guides light energy from the wearable light source, light energy from the ambient light source, or light energy from both the wearable light source and the ambient light source toward the proximal imaging device in order to disrupt unwelcome photography by the proximal imaging device.

In this embodiment, a proximal imaging device can be defined with respect to the person whose privacy is to be protected from unwelcome photography as a device which is capable of recording images and/or taking pictures, which has a direct line-of-sight to the person, and which is within a sufficiently short distance from the person to record identifiable images and/or take identifiable pictures of that person.

This embodiment can further comprise an outbound light guide mover that moves the outbound light guide in order to better refract, reflect, focus, direct, and/or guide light energy toward a proximal imaging device. This embodiment can further comprise a proximal imaging device tracker that detects and/or tracks a proximal imaging device. This embodiment can further comprise an inbound light guide mover that moves an inbound light guide in order to better harvest, refract, reflect, focus, direct, and/or guide light energy from an ambient light source. This embodiment can further comprise an ambient light source tracker that detects and/or tracks an ambient light source. This embodiment can further comprise a wearable power source.

In this embodiment, a data processing unit can select and/or adjust the use of light energy from an ambient light source, the use of light energy from a wearable light source, or the use of a combination of light energy from both ambient and wearable light sources depending based on factors selected from the group consisting of: the absolute amount of ambient light energy from an ambient light source; the amount of ambient light energy that can be harvested from an ambient light source; the variation in light energy from an ambient light source over time; the area variability or homogeneity of ambient light; the area concentration or diffusion of ambient light; the total amount of ambient light energy from all ambient light sources; the movement of a person wearing a photography-disrupting device relative to an ambient light source; the movement of an ambient light source relative to the person wearing a photography-disrupting device; the type of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device as determined by a GPS system; the movement of a person wearing a photography-disrupting device relative to the pull of gravity, the earth, or a GPS system; and current or predicted weather conditions.

In an example, this invention can be embodied in a wearable device for disrupting unwelcome photography in order to protect a person's privacy comprising: (a) a wearable light source that is worn by a person whose privacy is to be protected from unwelcome photography; (b) a data processing unit; (c) an outbound light guide that refracts, reflects, focuses, directs, and/or guides light energy from the wearable light source toward a proximal imaging device in order to disrupt unwelcome photography by the proximal imaging device; and (d) an outbound light guide mover that moves the outbound light guide in order to better refract, reflect, focus, direct, and/or guide light energy toward the proximal imaging device.

In this embodiment, a proximal imaging device can be defined with respect to the person whose privacy is to be protected from unwelcome photography as a device which is capable of recording images and/or taking pictures, which has a direct line-of-sight to the person, and which is within a sufficiently short distance from the person to record identifiable images and/or take identifiable pictures of that person.

This embodiment can further comprise an inbound light guide that harvests, refracts, reflects, focuses, directs, and/or guides light energy from an ambient light source. This embodiment can further comprise an inbound light guide mover that moves the inbound light guide in order to better harvest, refract, reflect, focus, direct, and/or guide light energy from an ambient light source. In this embodiment, an outbound light guide can refract, reflect, focus, direct, and/or guide light energy from a wearable light source, light energy from an ambient light source, or light energy from both a wearable light source and an ambient light source toward a proximal imaging device in order to disrupt unwelcome photography by the proximal imaging device.

This embodiment can further comprise an ambient light source tracker that detects and/or tracks an ambient light source. This embodiment can further comprise a light sensor. In this embodiment, a data processing unit can use the results from this light sensor in order to select and/or adjust the use of light energy from a wearable light source, the use of light energy from an ambient light source, or the use of light energy from both a wearable light source and an ambient light source in order to disrupt unwelcome photography by the proximal imaging device. This embodiment can further comprise a proximal imaging device tracker that detects and/or tracks a proximal imaging device. This embodiment can further comprise a wearable power source.

In this embodiment, a data processing unit can select and/or adjust the use of light energy from an ambient light source, the use of light energy from a wearable light source, or the use of a combination of light energy from both ambient and wearable light sources based on one or more factors selected from the group consisting of: the absolute amount of ambient light energy from an ambient light source; the amount of ambient light energy that can be harvested from an ambient light source; the variation in light energy from an ambient light source over time; the area variability or homogeneity of ambient light; the area concentration or diffusion of ambient light; the total amount of ambient light energy from all ambient light sources; the movement of a person wearing a photography-disrupting device relative to an ambient light source; the movement of an ambient light source relative to the person wearing a photography-disrupting device; the type of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device as determined by a GPS system; the movement of a person wearing a photography-disrupting device relative to the pull of gravity, the earth, or a GPS system; and current or predicted weather conditions.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an outbound light guide, wherein this outbound light guide is worn by the person and wherein this outbound light guide guides, directs, focuses, reflects, and/or refracts light from the wearable light source toward a proximal imaging device to disrupt unwelcome photography by the proximal imaging device; and (c) a power source, wherein this power source is worn by the person and powers the wearable light source.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an outbound light guide, wherein this outbound light guide is worn by the person and wherein this outbound light guide guides, directs, focuses, reflects, and/or refracts light from the wearable light source toward a proximal imaging device to disrupt unwelcome photography by the proximal imaging device; (c) a data processing unit, wherein this data processing unit is worn by the person, wherein this data processing unit controls the operation of the wearable light source, and wherein this data processing unit can further comprise a wireless data transmitter and receiver; and (d) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an outbound light guide, wherein this outbound light guide is worn by the person and wherein this outbound light guide guides, directs, focuses, reflects, and/or refracts light from the wearable light source toward a proximal imaging device to disrupt unwelcome photography by the proximal imaging device; (c) an outbound light guide mover, wherein this light guide mover is used by the person to move the outbound light guide in order to guide, direct, focus, reflect, and/or refract light from the wearable light source toward the proximal imaging device to disrupt unwelcome photography by the proximal imaging device; (d) a data processing unit, wherein this data processing unit is worn by the person, wherein this data processing unit controls the operation of the wearable light source, and wherein this data processing unit can further comprise a wireless data transmitter and receiver; and (e) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an outbound light guide, wherein this outbound light guide is worn by the person and wherein this outbound light guide guides, directs, focuses, reflects, and/or refracts light from the wearable light source toward a proximal imaging device to disrupt unwelcome photography by the proximal imaging device; (c) a proximal imaging device tracker, wherein this tracker tracks the location of the proximal imaging device; (d) an outbound light guide mover, wherein this light guide mover automatically moves the outbound light guide based on the operation of the proximal imaging device tracker in order to guide, direct, focus, reflect, and/or refract light from the wearable light source toward the proximal imaging device to disrupt unwelcome photography by the proximal imaging device; (e) a data processing unit, wherein this data processing unit is worn by the person, wherein this data processing unit controls the operation of the wearable light source, and wherein this data processing unit can further comprise a wireless data transmitter and receiver; and (f) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) an outbound light guide mover, wherein this light guide mover is used by the person to move the outbound light guide in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (e) an ambient light sensor, wherein results from this ambient light sensor are used to adjust the use and/or relative amounts of light from the wearable light source and light from the ambient light source to disrupt unwelcome photography by the proximal imaging device; (f) a data processing unit, wherein this data processing unit is worn by the person, wherein this data processing unit controls the operation of the wearable light source, and wherein this data processing unit can further comprise a wireless data transmitter and receiver; and (g) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) a proximal imaging device tracker, wherein this tracker tracks the location of the proximal imaging device; (e) an outbound light guide mover, wherein this light guide mover automatically moves the outbound light guide based on the operation of the proximal imaging device tracker in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (f) an ambient light sensor, wherein results from this ambient light sensor are used to adjust the use and/or relative amounts of light from the wearable light source and light from the ambient light source to disrupt unwelcome photography by the proximal imaging device; (g) a data processing unit, wherein this data processing unit is worn by the person, wherein this data processing unit controls the operation of the wearable light source, and wherein this data processing unit can further comprise a wireless data transmitter and receiver; and (h) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an inbound light guide mover, wherein this light guide mover is used by the person to move the inbound light guide in order to guide, direct, focus, reflect, and/or refract light from the ambient light source to more efficiently harvest light energy from the ambient light source; (a) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) an ambient light sensor, wherein results from this ambient light sensor are used to adjust the use and/or relative amounts of light from the wearable light source and light from the ambient light source to disrupt unwelcome photography by the proximal imaging device; (e) a data processing unit, wherein this data processing unit is worn by the person, wherein this data processing unit controls the operation of the wearable light source, and wherein this data processing unit can further comprise a wireless data transmitter and receiver; and (f) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an ambient light source tracker, wherein this tracker tracks the location of an ambient light source; (d) an inbound light guide mover, wherein this light guide mover automatically moves the inbound light guide based on the operation of the ambient light source tracker in order harvest light energy more efficiently from the ambient light source; (e) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (f) an ambient light sensor, wherein results from this ambient light sensor are used to adjust the use and/or relative amounts of light from the wearable light source and light from the ambient light source to disrupt unwelcome photography by the proximal imaging device; (g) a data processing unit, wherein this data processing unit is worn by the person, wherein this data processing unit controls the operation of the wearable light source, and wherein this data processing unit can further comprise a wireless data transmitter and receiver; and (h) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) an ambient light sensor, wherein results from this ambient light sensor are used to adjust the use and/or relative amounts of light from the wearable light source and light from the ambient light source to disrupt unwelcome photography by the proximal imaging device; (e) a data processing unit, wherein this data processing unit is worn by the person, wherein this data processing unit controls the operation of the wearable light source, and wherein this data processing unit can further comprise a wireless data transmitter and receiver; and (f) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an inbound light guide mover, wherein this light guide mover is used by the person to move the inbound light guide in order to guide, direct, focus, reflect, and/or refract light from the ambient light source to more efficiently harvest light energy from the ambient light source; (d) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (e) an outbound light guide mover, wherein this light guide mover is used by the person to move the outbound light guide in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (f) an ambient light sensor, wherein results from this ambient light sensor are used to adjust the use and/or relative amounts of light from the wearable light source and light from the ambient light source to disrupt unwelcome photography by the proximal imaging device; (g) a data processing unit, wherein this data processing unit is worn by the person, wherein this data processing unit controls the operation of the wearable light source, and wherein this data processing unit can further comprise a wireless data transmitter and receiver; and (h) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an ambient light source tracker, wherein this tracker tracks the location of an ambient light source; (d) an inbound light guide mover, wherein this light guide mover automatically moves the inbound light guide based on the operation of the ambient light source tracker in order harvest light energy more efficiently from the ambient light source; (e) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (f) a proximal imaging device tracker, wherein this tracker tracks the location of the proximal imaging device; (g) an outbound light guide mover, wherein this light guide mover automatically moves the outbound light guide based on the operation of the proximal imaging device tracker in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (h) an ambient light sensor, wherein results from this ambient light sensor are used to adjust the use and/or relative amounts of light from the wearable light source and light from the ambient light source to disrupt unwelcome photography by the proximal imaging device; (i) a data processing unit, wherein this data processing unit is worn by the person, wherein this data processing unit controls the operation of the wearable light source, and wherein this data processing unit can further comprise a wireless data transmitter and receiver; and (j) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) an outbound light guide mover, wherein this light guide mover is used by the person to move the outbound light guide in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (e) an ambient light sensor; (f) a harvested light sensor, wherein results from the harvested light sensor and the ambient light sensor are used to adjust the use and/or relative amounts of light from the wearable light source and light from the ambient light source to disrupt unwelcome photography by the proximal imaging device; (g) a data processing unit, wherein this data processing unit is worn by the person, wherein this data processing unit controls the operation of the wearable light source, and wherein this data processing unit can further comprise a wireless data transmitter and receiver; and (h) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) a proximal imaging device tracker, wherein this tracker tracks the location of the proximal imaging device; (e) an outbound light guide mover, wherein this light guide mover automatically moves the outbound light guide based on the operation of the proximal imaging device tracker in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (f) an ambient light sensor; (g) a harvested light sensor, wherein results from the harvested light sensor and the ambient light sensor are used to adjust the use and/or relative amounts of light from the wearable light source and light from the ambient light source to disrupt unwelcome photography by the proximal imaging device; (h) a data processing unit, wherein this data processing unit is worn by the person, wherein this data processing unit controls the operation of the wearable light source, and wherein this data processing unit can further comprise a wireless data transmitter and receiver; and (i) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an inbound light guide mover, wherein this light guide mover is used by the person to move the inbound light guide in order to guide, direct, focus, reflect, and/or refract light from the ambient light source to more efficiently harvest light energy from the ambient light source; (d) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (e) an ambient light sensor; (f) a harvested light sensor, wherein results from the harvested light sensor and the ambient light sensor are used to adjust the use and/or relative amounts of light from the wearable light source and light from the ambient light source to disrupt unwelcome photography by the proximal imaging device; (g) a data processing unit, wherein this data processing unit is worn by the person, wherein this data processing unit controls the operation of the wearable light source, and wherein this data processing unit can further comprise a wireless data transmitter and receiver; and (h) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an ambient light source tracker, wherein this tracker tracks the location of an ambient light source; (d) an inbound light guide mover, wherein this light guide mover automatically moves the inbound light guide based on the operation of the ambient light source tracker in order harvest light energy more efficiently from the ambient light source; (e) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (f) an ambient light sensor; (g) a harvested light sensor, wherein results from the harvested light sensor and the ambient light sensor are used to adjust the use and/or relative amounts of light from the wearable light source and light from the ambient light source to disrupt unwelcome photography by the proximal imaging device; (h) a data processing unit, wherein this data processing unit is worn by the person, wherein this data processing unit controls the operation of the wearable light source, and wherein this data processing unit can further comprise a wireless data transmitter and receiver; and (i) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (d) an ambient light sensor; (e) a harvested light sensor, wherein results from the harvested light sensor and the ambient light sensor are used to adjust the use and/or relative amounts of light from the wearable light source and light from the ambient light source to disrupt unwelcome photography by the proximal imaging device; (f) a data processing unit, wherein this data processing unit is worn by the person, wherein this data processing unit controls the operation of the wearable light source, and wherein this data processing unit can further comprise a wireless data transmitter and receiver; and (g) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an inbound light guide mover, wherein this light guide mover is used by the person to move the inbound light guide in order to guide, direct, focus, reflect, and/or refract light from the ambient light source to more efficiently harvest light energy from the ambient light source; (d) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (e) an outbound light guide mover, wherein this light guide mover is used by the person to move the outbound light guide in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (f) an ambient light sensor; (g) a harvested light sensor, wherein results from the harvested light sensor and the ambient light sensor are used to adjust the use and/or relative amounts of light from the wearable light source and light from the ambient light source to disrupt unwelcome photography by the proximal imaging device; (h) a data processing unit, wherein this data processing unit is worn by the person, wherein this data processing unit controls the operation of the wearable light source, and wherein this data processing unit can further comprise a wireless data transmitter and receiver; and (i) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an ambient light source tracker, wherein this tracker tracks the location of an ambient light source; (d) an inbound light guide mover, wherein this light guide mover automatically moves the inbound light guide based on the operation of the ambient light source tracker in order harvest light energy more efficiently from the ambient light source; (e) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (f) a proximal imaging device tracker, wherein this tracker tracks the location of the proximal imaging device; (g) an outbound light guide mover, wherein this light guide mover automatically moves the outbound light guide based on the operation of the proximal imaging device tracker in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (h) an ambient light sensor; (i) a harvested light sensor, wherein results from the harvested light sensor and the ambient light sensor are used to adjust the use and/or relative amounts of light from the wearable light source and light from the ambient light source to disrupt unwelcome photography by the proximal imaging device; (j) a data processing unit, wherein this data processing unit is worn by the person, wherein this data processing unit controls the operation of the wearable light source, and wherein this data processing unit can further comprise a wireless data transmitter and receiver; and (k) a power source, wherein this power source is worn by the person, and wherein this power source powers the wearable light source and the data processing unit.

In an example, this invention can be embodied in a wearable device for disrupting unwelcome photography comprising: (a) a wearable light source, wherein this wearable light source is worn by a person and wherein light from this wearable light source is used to disrupt unwelcome photography by a proximal imaging device; (b) an inbound light guide, wherein this inbound light guide is worn by the person, wherein this inbound light guide harvests light energy from an ambient light source by guiding, directing, focusing, reflecting, refracting, or transducing light from this ambient light source, and wherein light energy harvested from this ambient light source is used to disrupt unwelcome photography by a proximal imaging device; (c) an ambient light source tracker, wherein this tracker tracks the location of an ambient light source; (d) an inbound light guide mover, wherein this light guide mover automatically moves the inbound light guide based on the operation of the ambient light source tracker in order harvest light energy more efficiently from the ambient light source; (e) an outbound light guide, wherein this outbound light guide is worn by the person and wherein this outbound light guide guides, directs, focuses, reflects, and/or refracts light from the wearable light source, light from the ambient light source, and/or light from both the wearable light source and the ambient light source toward a proximal imaging device to disrupt unwelcome photography by the proximal imaging device; (f) a proximal imaging device tracker, wherein this tracker tracks the location of the proximal imaging device; (g) an outbound light guide mover, wherein this light guide mover automatically moves the outbound light guide based on the operation of the proximal imaging device tracker in order to guide, direct, focus, reflect, and/or refract light from the wearable light source, light from the ambient light source, and/or light from both the wearable light source and the ambient light source toward the proximal imaging device to disrupt unwelcome photography by the proximal imaging device; (h) a harvested light sensor, wherein results from the harvested light sensor are used to adjust the use and/or relative amounts of light from the wearable light source and light from the ambient light source to disrupt unwelcome photography by the proximal imaging device; (i) a data processing unit, wherein this data processing unit is worn by the person, wherein this data processing unit controls the operation of the wearable light source, and wherein this data processing unit can further comprise a wireless data transmitter and receiver; and (j) a power source, wherein this power source is worn by the person, and wherein this power source powers the wearable light source and the data processing unit.

12. Method Embodiments for Disrupting Unwelcome Photography

Based on the figures and associated discussion of examples herein, this invention can be embodied in the following examples of a method device for disrupting unwelcome photography.

In an example, this invention can be embodied in a method for disrupting unwelcome photography in order to protect a person's privacy comprising: (a) selecting one or more light sources from a set of two or more light sources that includes at least one wearable light source worn by a person whose privacy is to be protected from unwelcome photography and at least one ambient light source; and (b) guiding, refracting, reflecting, focusing, directing, and/or channeling light energy from the one or more selected light sources toward a proximal imaging device in order to disrupt unwelcome photography by the proximal imaging device.

In an example, this invention can be embodied in a method for disrupting unwelcome photography to protect a person's privacy comprising: (a) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (b) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by movement of the person whose privacy is to be protected.

In an example, this invention can be embodied in a method for disrupting unwelcome photography to protect a person's privacy comprising: (a) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (b) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by an automatic mechanism that tracks the location of at least one proximal imaging device.

In an example, this invention can be embodied in a method for disrupting unwelcome photography to protect a person's privacy comprising: (a) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (b)

guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device.

In an example, this invention can be embodied in a method for disrupting unwelcome photography to protect a person's privacy comprising: (a) receiving information concerning the type and/or location of at least one ambient light source, wherein this information is received from a person whose privacy is to be protected from unwelcome photography; (b) receiving information concerning the type and/or location of at least one proximal imaging device, wherein this information is received from a person whose privacy is to be protected from unwelcome photography; (c) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (d) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by movement of the person whose privacy is to be protected.

In an example, this invention can be embodied in a method for disrupting unwelcome photography to protect a person's privacy comprising: (a) receiving information concerning the type and/or location of at least one ambient light source, wherein this information is received from an ambient light monitor that automatically detects an ambient light source; (b) receiving information concerning the type and/or location of at least one proximal imaging device, wherein this information is received from a proximal imaging device monitor that automatically detects a proximal imaging device; (c) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (d) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by an automatic mechanism that tracks the location of at least one proximal imaging device.

In an example, this invention can be embodied in a method for disrupting unwelcome photography to protect a person's privacy comprising: (a) receiving information concerning the type and/or location of at least one ambient light source, wherein this information is received from an ambient light monitor that automatically detects an ambient light source; (b) receiving information concerning the type and/or location of at least one proximal imaging device, wherein this information is received from a proximal imaging device monitor that automatically detects a proximal imaging device; (c) selecting a source of light energy or a blend of light energy from different light sources, wherein these different light sources include at least one ambient light source and at least one wearable light source that is worn by the person who privacy is to be protected from unwelcome photography; and (d) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by an automatic mechanism that tracks the location of at least one proximal imaging device.

In an example, this invention can be embodied in a method for disrupting unwelcome photography to protect a person's privacy comprising: (a) receiving information concerning the type and/or location of at least one ambient light source; wherein this information is received from a person whose privacy is to be protected from unwelcome photography, received from an ambient light monitor that automatically detects an ambient light source, or received from both the person whose privacy is to be protected and an ambient light monitor; (b) receiving information concerning the type and/or location of at least one proximal imaging device; wherein this information is received from a person whose privacy is to be protected from unwelcome photography, received from a proximal imaging device monitor that automatically detects a proximal imaging device, or received from both the person whose privacy is to be protected and a proximal imaging device monitor; (c) selecting a source of light energy or a blend of light energy from different light sources, wherein these different light sources include at least one ambient light source and at least one wearable light source that is worn by the person who privacy is to be protected from unwelcome photography, and wherein selection of a source of light energy or a blend of light energy from different light sources is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of the at least one proximal imaging device; distance, location, and/or movement of at least one proximal imaging device; and environmental, geographic, and/or social context in which interaction occurs between the person whose privacy is to be protected and the proximal imaging device; and (d) guiding, directing, reflecting, and/or refracting light energy from the selected source of light energy or blend of light energy from different light sources toward at least one proximal imaging device in order to disrupt unwelcome photography by this proximal imaging device, wherein this guiding, directing, reflecting, and/or refracting of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device.

In an example, this invention can be embodied in a method for disrupting unwelcome photography of a person whose privacy is to be protected comprising: (a) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (b) guiding light energy from the selected light source(s) toward a proximal imaging device to disrupt unwelcome photography, wherein this guiding of light energy is controlled by movement of the person whose privacy is to be protected.

In an example, this invention can be embodied in a method for disrupting unwelcome photography of a person whose privacy is to be protected comprising: (a) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (b) guiding light energy from the selected light source(s) toward a proximal imaging device to disrupt unwelcome photography, wherein this guiding of light energy is controlled by an automatic mechanism that tracks the location of at least one proximal imaging device.

In an example, this invention can be embodied in a method for disrupting unwelcome photography of a person whose privacy is to be protected comprising: (a) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (b) guiding light energy from the selected light source(s) toward a proximal imaging device to disrupt unwelcome photography, wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device.

In an example, this invention can be embodied in a method for disrupting unwelcome photography of a person whose privacy is to be protected comprising: (a) receiving information concerning the type and/or location of at least one ambient light source, wherein this information is received from the person whose privacy is to be protected from unwelcome photography; (b) receiving information concerning the type and/or location of at least one proximal imaging device, wherein this information is received from the person whose privacy is to be protected from unwelcome photography; (c) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (d) guiding light energy from the selected light source(s) toward a proximal imaging device to disrupt unwelcome photography, wherein this guiding of light energy is controlled by movement of the person whose privacy is to be protected.

In an example, this invention can be embodied in a method for disrupting unwelcome photography of a person whose privacy is to be protected comprising: (a) receiving information concerning the type and/or location of at least one ambient light source, wherein this information is received from an ambient light monitor that automatically detects an ambient light source; (b) receiving information concerning the type and/or location of at least one proximal imaging device, wherein this information is received from a proximal imaging device monitor that automatically detects a proximal imaging device; (c) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (d) guiding light energy from the selected light source(s) toward a proximal imaging device to disrupt unwelcome photography, wherein this guiding of light energy is controlled by an automatic mechanism that tracks the location of at least one proximal imaging device.

In an example, this invention can be embodied in a method for disrupting unwelcome photography of a person whose privacy is to be protected comprising: (a) receiving information concerning the type and/or location of at least one ambient light source, wherein this information is received from the person whose privacy is to be protected from unwelcome photography, received from an ambient light monitor that automatically detects an ambient light source, or received from both the person whose privacy is to be protected and an ambient light monitor; (b) receiving information concerning the type and/or location of at least one proximal imaging device, wherein this information is received from the person whose privacy is to be protected from unwelcome photography, received from a proximal imaging device monitor that automatically detects a proximal imaging device, or received from both the person whose privacy is to be protected and a proximal imaging device monitor; (c) selecting an ambient light source, a wearable light source worn by the person, or a combination of these light sources; and (d) guiding light energy from the selected light source(s) toward a proximal imaging device to disrupt unwelcome photography, wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device.

In an example, this invention can be embodied in a method for disrupting unwelcome photography of a person whose privacy is to be protected comprising: (a) receiving information concerning the type and/or location of at least one ambient light source, wherein this information is received from the person whose privacy is to be protected from unwelcome photography, received from an ambient light monitor that automatically detects an ambient light source, or received from both the person whose privacy is to be protected and an ambient light monitor; (b) receiving information concerning the type and/or location of at least one proximal imaging device, wherein this information is received from the person whose privacy is to be protected from unwelcome photography, received from a proximal imaging device monitor that automatically detects a proximal imaging device, or received from both the person whose privacy is to be protected and a proximal imaging device monitor; (c) selecting an ambient light source, a wearable light source worn by the person, or a combination of these light sources; wherein this selection is based on one or more factors selected from the group consisting of: general level or spectral distribution of ambient light from all ambient light sources; amount or spectral distribution of light energy harvested from at least one ambient light source by a device worn by the person whose privacy is to be protected; variability or consistency over time of light energy harvested from at least one ambient light source; location, distance, and/or movement of at least one ambient light source; location and/or movement of the person whose privacy is to be protected; amount of light energy that can be produced by at least one wearable light source worn by the person whose privacy is to be protected; amount of energy available to power at least one wearable light source; type of at least one proximal imaging device; distance, location, and/or movement of at least one proximal imaging device; and environmental, geographic, and/or social context in which interaction occurs between the person whose privacy is to be protected and a proximal imaging device; and (d) guiding light energy from the selected light source(s) toward a proximal imaging device to disrupt unwelcome photography, wherein this guiding of light energy is controlled by: movement of the person whose privacy is to be protected; an automatic mechanism that tracks the location of at least one proximal imaging device; or a combination of movement of the person whose privacy is to be protected and an automatic mechanism that tracks the location of at least one proximal imaging device.

In an example, this invention can be embodied in a method of using ambient and/or wearable light sources to disrupt unwelcome photography comprising: (a) collecting information using a wearable ambient light sensor concerning ambient light sources, wherein the ambient light sensor is worn by a person wishing to avoid unwelcome photography, wherein an ambient light source is a light source which illuminates the person's local environment, wherein an ambient light source is not worn by that person, and wherein an ambient light source can be a natural light source or an artificial light source, wherein information collected by the wearable ambient light sensor includes one or more parameters selected from the group consisting of: the absolute amount of light energy that can be collected from this ambient light source by the wearable device; the overall level of ambient light in the person's local environment from all light sources; the spectrum of light energy emitted by the ambient light source; variation in the amount of light energy from this ambient light source over time; and relative movement of the ambient light source and the person; (b) using this information concerning ambient light sources to determine whether there is an ambient light source whose local light energy is probably sufficient to disrupt unwelcome photography by a nearby imaging device; (c) if light energy from the ambient light source can be sufficient to disrupt unwelcome photography by a nearby imaging device, then using a wearable light guide to guide, reflect, redirect, and/or focus light energy from the ambient light source in one or more directions so that this light energy disrupts unwelcome photography by the nearby imaging device; and (d) if light energy from the ambient light source is not sufficient to disrupt unwelcome photography by a nearby imaging device, then using a wearable light guide to guide, reflect, direct, and/or focus light energy from a wearable light source that is worn by the person in one or more directions so that this light energy disrupts unwelcome photography by the nearby imaging device.

In an example, this invention can be embodied in a method of using ambient and/or wearable light sources to disrupt unwelcome photography comprising: (a) tracking the location of an ambient light source using a ambient light tracker, wherein the ambient light tracker is worn by a person wishing to avoid unwelcome photography, wherein an ambient light source is a light source which illuminates the person's local environment, wherein an ambient light source is not worn by that person, and wherein an ambient light source can be a natural light source or an artificial light source. (b) tracking the location of a proximal imaging device using an imaging device tracker, wherein the imaging device tracker is worn by a person wishing to avoid unwelcome photography, wherein a proximal imaging device is a camera or other imaging device in the person's local environment which is capable of taking unwelcome pictures of the person, and wherein the proximal imaging device is not worn by that person; (c) collecting information using a wearable ambient light sensor concerning ambient light sources, wherein the ambient light sensor is worn by the person, wherein information collected by the wearable ambient light sensor includes one or more parameters selected from the group consisting of: the absolute amount of light energy that can be collected from this ambient light source by the wearable device; the overall level of ambient light in the person's local environment from all light sources; the spectrum of light energy emitted by the ambient light source; variation in the amount of light energy from this ambient light source over time; and relative movement of the ambient light source and the person. (d) using this information concerning ambient light sources to determine whether there is an ambient light source whose local light energy is probably sufficient to disrupt unwelcome photography by a nearby imaging device; (e) if light energy from the ambient light source can be sufficient to disrupt unwelcome photography by a nearby imaging device, then using a wearable light guide to guide, reflect, redirect, and/or focus light energy from the ambient light source in one or more directions so that this light energy disrupts unwelcome photography by the nearby imaging device, and wherein the guiding, reflection, redirection, and/or focusing of light energy from the ambient light source changes with changes in the relative location of the ambient light source identified by tracking the location of the ambient light source; and (f) if light energy from the ambient light source is not sufficient to disrupt unwelcome photography by a nearby imaging device, then using a wearable light guide to guide, reflect, direct, and/or focus light energy from a wearable light source that is worn by the person in one or more directions so that this light energy disrupts unwelcome photography by the nearby imaging device; and wherein the guiding, reflection, direction, and/or focusing of light energy from the wearable light source changes with changes in the relative location of the proximal imaging device identified by tracking the location of the proximal imaging device.

In an example, this invention can be embodied in a method of using ambient and/or wearable light sources to disrupt unwelcome photography comprising: (a) tracking the location of an ambient light source using a ambient light tracker, wherein the ambient light tracker is worn by a person wishing to avoid unwelcome photography, wherein an ambient light source is a light source which illuminates the person's local environment, wherein an ambient light source is not worn by that person, and wherein an ambient light source can be a natural light source or an artificial light source. (b) collecting information using a wearable ambient light sensor concerning ambient light sources, wherein the ambient light sensor is worn by the person, wherein information collected by the wearable ambient light sensor includes one or more parameters selected from the group consisting of: the absolute amount of light energy that can be collected from this ambient light source by the wearable device; the overall level of ambient light in the person's local environment from all light sources; the spectrum of light energy emitted by the ambient light source; variation in the amount of light energy from this ambient light source over time; and relative movement of the ambient light source and the person. (c) using this information concerning ambient light sources to determine whether there is an ambient light source whose local light energy is probably sufficient to disrupt unwelcome photography by a nearby imaging device; (d) if light energy from the ambient light source can be sufficient to disrupt unwelcome photography by a nearby imaging device, then using a wearable light guide to guide, reflect, redirect, and/or focus light energy from the ambient light source in one or more directions so that this light energy disrupts unwelcome photography by the nearby imaging device, and wherein the guiding, reflection, redirection, and/or focusing of light energy from the ambient light source changes with changes in the relative location of the ambient light source identified by tracking the location of the ambient light source; and (e) if light energy from the ambient light source is not sufficient to disrupt unwelcome photography by a nearby imaging device, then using a wearable light guide to guide, reflect, direct, and/or focus light energy from a wearable light source that is worn by the person in one or more directions so that this light energy disrupts unwelcome photography by the nearby imaging device.

In an example, this invention can be embodied in a method of using ambient and/or wearable light sources to disrupt unwelcome photography comprising: (a) tracking the location of a proximal imaging device using an imaging device tracker, wherein the imaging device tracker is worn by a person wishing to avoid unwelcome photography, wherein a proximal imaging device is a camera or other imaging device in the person's local environment which is capable of taking unwelcome pictures of the person, and wherein the proximal imaging device is not worn by that person; (b) collecting information using a wearable ambient light sensor concerning ambient light sources, wherein the ambient light sensor is worn by the person, wherein information collected by the wearable ambient light sensor includes one or more parameters selected from the group consisting of: the absolute amount of light energy that can be collected from this ambient light source by the wearable device; the overall level of ambient light in the person's local environment from all light sources; the spectrum of light energy emitted by the ambient light source; variation in the amount of light energy from this ambient light source over time; and relative movement of the ambient light source and the person. (c) using this information concerning ambient light sources to determine whether there is an ambient light source whose local light energy is probably sufficient to disrupt unwelcome photography by a nearby imaging device; (d) if light energy from the ambient light source can be sufficient to disrupt unwelcome photography by a nearby imaging device, then using a wearable light guide to guide, reflect, redirect, and/or focus light energy from the ambient light source in one or more directions so that this light energy disrupts unwelcome photography by the nearby imaging device; and (e) if light energy from the ambient light source is not sufficient to disrupt unwelcome photography by a nearby imaging device, then using a wearable light guide to guide, reflect, direct, and/or focus light energy from a wearable light source that is worn by the person in one or more directions so that this light energy disrupts unwelcome photography by the nearby imaging device; and wherein the guiding, reflection, direction, and/or focusing of light energy from the wearable light source changes with changes in the relative location of the proximal imaging device identified by tracking the location of the proximal imaging device.

In an example, this invention can be embodied in a method of using ambient and/or wearable light sources to disrupt unwelcome photography comprising: (a) tracking the location of a proximal imaging device using an imaging device tracker, wherein the imaging device tracker is worn by a person wishing to avoid unwelcome photography, wherein a proximal imaging device is a camera or other imaging device in the person's local environment which is capable of taking unwelcome pictures of the person, and wherein the proximal imaging device is not worn by that person; and (b) using a wearable light guide to guide, reflect, direct, and/or focus light energy from a wearable light source that is worn by the person in one or more directions so that this light energy disrupts unwelcome photography by the nearby imaging device; and wherein the guiding, reflection, direction, and/or focusing of light energy from the wearable light source changes with changes in the relative location of the proximal imaging device identified by tracking the location of the proximal imaging device.

I claim:

1. A wearable device for disrupting unwelcome photography in order to protect a person's privacy comprising:

a wearable light source that is worn by a person whose privacy is to be protected from unwelcome photography;

a data processing unit;

an outbound light guide that refracts, reflects, focuses, directs, and/or guides light energy from the wearable light source toward a proximal imaging device in order to disrupt unwelcome photography by the proximal imaging device; and an outbound light guide mover that moves the outbound light guide in order to better refract, reflect, focus, direct, and/or guide light energy toward the proximal imaging device.

2. The wearable device in claim 1 wherein a proximal imaging device is defined with respect to the person whose privacy is to be protected from unwelcome photography as a device which is capable of recording images and/or taking pictures, which has a direct line-of-sight to the person, and which is within a sufficiently short distance from the person to record identifiable images and/or take identifiable pictures of that person.

3. The wearable device in claim 1 wherein this device further comprises an inbound light guide that harvests, refracts, reflects, focuses, directs, and/or guides light energy from an ambient light source.

4. The wearable device in claim 1 wherein this device further comprises a light sensor.

5. The wearable device in claim 1 wherein this device further comprises a proximal imaging device tracker that detects and/or tracks a proximal imaging device.

6. The wearable device in claim 1 wherein this device further comprises a wearable power source.

7. The wearable device in claim 1 wherein the data processing unit selects and/or adjusts the use of light energy from an ambient light source, the use of light energy from a wearable light source, or the use of a combination of light energy from both ambient and wearable light sources based on one or more factors selected from the group consisting of: the absolute amount of ambient light energy from an ambient light source; the amount of ambient light energy that can be harvested from an ambient light source; the variation in light energy from an ambient light source over time; the area variability or homogeneity of ambient light; the area concentration or diffusion of ambient light; the total amount of ambient light energy from all ambient light sources; the movement of a person wearing a photography-disrupting device relative to an ambient light source; the movement of an ambient light source relative to the person wearing a photography-disrupting device; the type of ambient light source; the spectrum of ambient light; the location or direction of an ambient light source relative to the location, direction, or orientation of a proximal imaging device; the location or direction of an ambient light source relative to the location, direction, or orientation of a wearable photography-disrupting device; the amount of ambient light energy from a single ambient light source relative to the total amount of ambient light energy; the amount of light energy that can be produced by a wearable light source; the amount of energy in a wearable power source that is available to power a wearable light source; the type of proximal imaging device detected; the location of a person wearing a photography-disrupting device as determined by a GPS system; the movement of a person wearing a photography-disrupting device relative to the pull of gravity, the earth, or a GPS system; and current or predicted weather conditions.

8. The wearable device in claim 3 wherein this device further comprises an inbound light guide mover that moves the inbound light guide in order to better harvest, refract, reflect, focus, direct, and/or guide light energy from an ambient light source.

9. The wearable device in claim 3 wherein the outbound light guide refracts, reflects, focuses, directs, and/or guides light energy from the wearable light source, light energy from an ambient light source, or light energy from both the wearable light source and an ambient light source toward a proximal imaging device in order to disrupt unwelcome photography by the proximal imaging device.

10. The wearable device in claim 3 wherein this device further comprises an ambient light source tracker that detects and/or tracks an ambient light source.

11. The wearable device in claim 4 wherein the data processing unit uses results from the light sensor in order to select and/or adjust the use of light energy from a wearable light source, the use of light energy from an ambient light source, or the use of light energy from both a wearable light source and an ambient light source in order to disrupt unwelcome photography by the proximal imaging device.

12. A wearable device for disrupting unwelcome photography in order to protect a person's privacy comprising:

a wearable light source that is worn by a person whose privacy is to be protected from unwelcome photography;

an inbound light guide that harvests, refracts, reflects, focuses, directs, and/or guides light energy from an ambient light source;

a light sensor;

a data processing unit that uses results from the light sensor in order to select and/or adjust the use of light energy from the wearable light source, the use of light energy from the ambient light source, or the use of light energy from both the wearable light source and the ambient light source in order to disrupt unwelcome photography by the proximal imaging device;

an outbound light guide that refracts, reflects, focuses, directs, and/or guides light energy from the wearable light source, light energy from the ambient light source, or light energy from both the wearable light source and the ambient light source toward the proximal imaging device in order to disrupt unwelcome photography by the proximal imaging device; and an outbound light guide mover that moves the outbound light guide in order to better refract, reflect, focus, direct, and/or guide light energy toward a proximal imaging device.

13. A method for disrupting unwelcome photography in order to protect a person's privacy comprising:

selecting one or more light sources from a set of two or more light sources that includes at least one wearable light source worn by a person whose privacy is to be protected from unwelcome photography and at least one ambient light source; and guiding, refracting, reflecting, focusing, directing, and/or channeling light energy from the one or more selected light sources toward a proximal imaging device in order to disrupt unwelcome photography by the proximal imaging device.

* * * * *